US010074935B2

(12) United States Patent
Kato et al.

(10) Patent No.: US 10,074,935 B2
(45) Date of Patent: Sep. 11, 2018

(54) FLOATING CONNECTOR

(71) Applicant: ACES ELECTRONICS CO., LTD., Zhongli, Taoyuan County (TW)

(72) Inventors: Nobukazu Kato, Fussa (JP); Hiroaki Hashimoto, Sagamihara (JP)

(73) Assignee: ACES ELECTRONICS CO., LTD., Zhongli, Taoyuan County (TW)

( * ) Notice: Subject to any disclaimer, the term of this patent is extended or adjusted under 35 U.S.C. 154(b) by 0 days.

(21) Appl. No.: 15/488,882

(22) Filed: Apr. 17, 2017

(65) Prior Publication Data

US 2017/0310048 A1 Oct. 26, 2017

(30) Foreign Application Priority Data

Apr. 26, 2016 (JP) ..... 2016-087696
Oct. 7, 2016 (JP) ..... 2016-198739

(51) Int. Cl.
*H01R 13/631* (2006.01)
*H01R 13/6581* (2011.01)
(Continued)

(52) U.S. Cl.
CPC ..... *H01R 13/6315* (2013.01); *H01R 13/6581* (2013.01); *H01R 24/60* (2013.01); *H01R 2107/00* (2013.01)

(58) Field of Classification Search
CPC ..... H01R 13/6315; H01R 13/6581–13/6584; H01R 13/6586; H01R 13/659
(Continued)

(56) References Cited

U.S. PATENT DOCUMENTS 3,573,716 A * 4/1971 Garver ..... H01R 13/743 439/353
5,161,997 A * 11/1992 Defibaugh ..... H01R 13/518 248/222.51
(Continued)

FOREIGN PATENT DOCUMENTS

CN 202167673 U 3/2012
JP H10-172665 A 6/1998
(Continued)

OTHER PUBLICATIONS

Japanese Decision of Rejection from Japanese Patent Application No. 2016-198739; dated Sep. 11, 2017; 7 pgs.
(Continued)

*Primary Examiner* — Harshad C Patel
(74) *Attorney, Agent, or Firm* — Chiesa Shahinian & Giantomasi PC

(57) ABSTRACT

{Problem} To provide a connector which includes two or more predetermined standard connectors and is capable of securely absorbing deviation in a position and a posture of the two or more predetermined standard connectors during mounting thereof.
{Solution to Problem} A connector including a plurality of predetermined standard connectors 2*a*, 2*b* which connects with a partner connector; and covers 4, 5 having a first opening portion covering the plurality of predetermined standard connectors and allowing an engagement portion to be exposed, the engagement portion to be engaged with the partner connector of the predetermined standard connector, in which between an outer wall portion 33*a* of the predetermined standard connector and a wall portion forming the first opening portion, a predetermined space is formed such that the predetermined standard connector can move relative to the cover on a cross plane crossing an engagement direction of engagement with the partner connector, and a
(Continued)

first control portion which controls, with respect to the first opening portion, at least either one of a position and a posture of at least one of the predetermined standard connectors.

10 Claims, 47 Drawing Sheets

(51) Int. Cl.
*H01R 24/60* (2011.01)
*H01R 107/00* (2006.01)

(58) Field of Classification Search
USPC .... 439/544, 545, 552, 555, 557, 567, 540.1, 439/541.5
See application file for complete search history.

(56) References Cited

U.S. PATENT DOCUMENTS 5,366,388 A * 11/1994 Freeman ..... H01R 13/518 439/49
5,658,154 A * 8/1997 Bumsted ..... H01R 12/725 439/532
5,876,246 A * 3/1999 Martin ..... H01R 13/5804 439/557
6,887,098 B1 * 5/2005 Luo ..... H01R 13/518 439/540.1
7,303,432 B1 * 12/2007 Chen ..... H01R 13/518 439/540.1
8,932,071 B2 * 1/2015 Venema ..... H01R 13/62 439/248
8,968,031 B2 * 3/2015 Simmel ..... H01R 13/659 439/108
9,502,827 B2 * 11/2016 Feng ..... H01R 13/6581
2009/0269977 A1 * 10/2009 Chen ..... H01R 13/518 439/540.1
2013/0005179 A1 1/2013 Leonardo et al.
2013/0295796 A1 11/2013 Kato et al.
2016/0111804 A1 4/2016 Saito et al.

FOREIGN PATENT DOCUMENTS

JP H11-3745 A 1/1999
JP H11288760 A 10/1999
JP 2013-48073 A 3/2013
JP 2016-167462 A 9/2016

OTHER PUBLICATIONS

Notification of Reasons for Refusal from Japanese Patent Application No. 2016-198739; dated Jul. 18, 2017; 6 pgs.
Notification of Reasons for Refusal dated Dec. 19, 2017 from JP Patent Application No. 2017-220622; 10 pgs.

* cited by examiner

FLOATING CONNECTOR

CROSS-REFERENCE TO RELATED APPLICATIONS

The present application claims priority from Japanese Patent Application No. 2016-087696 filed on Apr. 26, 2016 and Japanese Patent Application No. 2016-198739 filed on Oct. 7, 2016, disclosures of which are all incorporated herein.

TECHNICAL FIELD

The present invention relates to a connector including a plurality of predetermined standard connectors.

RELATED ART

Background Art

There are provided connectors having numerous contacts in order to realize high-speed transmission. For example, Patent Literature 1 recites a connector including a pair of connectors each having numerous contacts aligned, in which one connector is engaged with the other connector.

CITATION LIST

Patent Literature

Patent Literature 1: JP H11-288760 A

SUMMARY OF INVENTION

Technical Problem

In the connector recited in the Patent Literature 1, one connector can be engaged only with other connector, but not with a connector conforming to a different standard from that of the other connector.

Thus, use of a connector has been studied which includes two or more connectors conforming to the standard specification (hereinafter, referred to as a predetermined standard connector) such as the USB Type-C or the like. For example, a receptacle connector having two predetermined standard receptacle connectors can be connected not only with a plug connector having two predetermined standard plug connectors but also with an apparatus mounted with one predetermined standard plug connector or with a cable. In other words, one of the two predetermined standard receptacle connectors provided in the receptacle connector can be connected with an apparatus mounted with one predetermined standard plug connector or with the cable as well. Further, the other of the two predetermined standard receptacle connectors provided in the above receptacle connector can be connected with other apparatus mounted with a predetermined standard plug connector or with other cable as well.

However, in a step of assembling such a connector having two or more predetermined standard connectors as described above, it is difficult to mount two predetermined standard connectors at an accurate position and in an accurate posture. When positions and postures of the two predetermined standard connectors deviate from each other during mounting, connection of the predetermined standard connector with a partner connector might develop a failure, or engagement of the predetermined standard connector with the partner connector might cause breakage.

Additionally, in order to realize higher speed transmission by increasing the number of contacts, it is demanded to mount an additional connector on such a connector including two or more of such predetermined standard connectors as described above. However, also when an additional connector is mounted, it is difficult to mount two predetermined standard connectors and the additional connector at an accurate position and in an accurate posture during a step of assembling the connector.

An object of the present invention is to provide a connector which includes two or more predetermined standard connectors and is capable of securely absorbing deviation in a position and a posture of the two or more predetermined standard connectors during mounting thereof.

Solution to Problem

A connector of the present invention includes a plurality of predetermined standard connectors which connects with a partner connector; and a cover covering the plurality of predetermined standard connectors and having a first opening portion allowing an engagement portion to be exposed, the engagement portion to be engaged with the partner connector of the predetermined standard connector, in which between an outer wall portion of the predetermined standard connector and a wall portion forming the first opening portion, a predetermined space is formed such that the predetermined standard connector is movable relative to the cover on a cross plane crossing an engagement direction of engagement with the partner connector, and a first control portion is provided which controls, with respect to the first opening portion, at least either one of a position and a posture of at least one of the predetermined standard connectors.

Additionally, the connector of the present invention includes an additional connector to be connected with a partner's additional connector, in which the cover covers the additional connector and has a second opening portion allowing an engagement portion of the additional connector to be exposed, the engagement portion to be engaged with the partner's additional connector, between an outer wall portion of the additional connector and a wall portion forming the second opening portion, a predetermined space is formed such that the additional connector is movable on the cross plane, and a second control portion is provided which controls, with respect to the second opening portion, at least either one of a position and a posture of the additional connector.

Additionally, in the connector of the present invention, the first control portion and the second control portion each include an elastic body.

Additionally, in the connector of the present invention, the first control portion is provided in the outer wall portion of the predetermined standard connector or in the wall portion forming the first opening portion.

Additionally, in the connector of the present invention, the second control portion is provided in the outer wall portion of the additional connector or in the wall portion forming the second opening portion.

Additionally, in the connector of the present invention, the first control portion is provided between the predetermined standard connector and the cover.

Additionally, in the connector of the present invention, the first control portion includes a convex portion which supports the predetermined standard connector in a direction orthogonal to a surface in which the first opening portion is formed; and a correction portion which corrects a slant of the predetermined standard connector when the predetermined standard connector slants with respect to the surface in which the first opening portion is formed, and the first control portion controls a posture of the predetermined standard connector with respect to the first opening portion by using the convex portion and the correction portion.

Additionally, in the connector of the present invention, the cover and a shell of the predetermined standard connector electrically conduct with each other.

Additionally, the connector of the present invention further includes a flexible portion which follow movement of the predetermined standard connector; a first holding portion fixed to the predetermined standard connector for holding one of the flexible portion; and a second holding portion fixed to the cover for holding the other of the flexible portion.

Additionally, in the connector of the present invention, the predetermined standard connector includes a first contact having a first connection portion which is pushed to a first conductor to electrically connect with the first conductor; a first supporting portion which receives a force to push the first connection portion to the first conductor; a second contact having a second connection portion which is pushed to a second conductor to electrically connect with the second conductor; a second supporting portion which receives a force to push the second connection portion to the second conductor; a ground plate arranged between the first contact and the second contact and having a shield connection portion which is pushed to at least one of a first shield portion covering the first conductor and a second shield portion covering the second conductor to electrically connect with at least one of the first shield portion and the second shield portion; and a third supporting portion which receives a force to push the shield connection portion to at least one of the first shield portion and the second shield portion.

Additionally, the connector of the present invention includes a first contact having a first connection portion which is pushed to a first conductor to electrically connect with the first conductor; a first supporting portion which receives a force to push the first connection portion to the first conductor; a second contact having a second connection portion which is pushed to a second conductor to electrically connect with the second conductor; a second supporting portion which receives a force to push the second connection portion to the second conductor; a ground plate arranged between the first contact and the second contact and having a shield connection portion which is pushed to at least one of a first shield portion covering the first conductor and a second shield portion covering the second conductor to electrically connect with at least one of the first shield portion and the second shield portion; and a third supporting portion which receives a force to push the shield connection portion to at least one of the first shield portion and the second shield portion.

Additionally, in the connector of the present invention, at least one of the first connection portion and the second connection portion is integrally formed with the third supporting portion.

Additionally, in the connector of the present invention, the first conductor and the second conductor are each a conductor configuring a flexible flat cable or a conductor foil configuring a flexible printed board.

Additionally, in the connector of the present invention, the predetermined standard connector is of the USB Type C.

Advantageous Effects of Invention

According to the present invention, a connector can be provided which includes two or more predetermined standard connectors and is capable of securely absorbing deviation in a position and a posture of the two or more predetermined standard connectors during mounting thereof.

DESCRIPTION OF EMBODIMENTS

Figure 1:
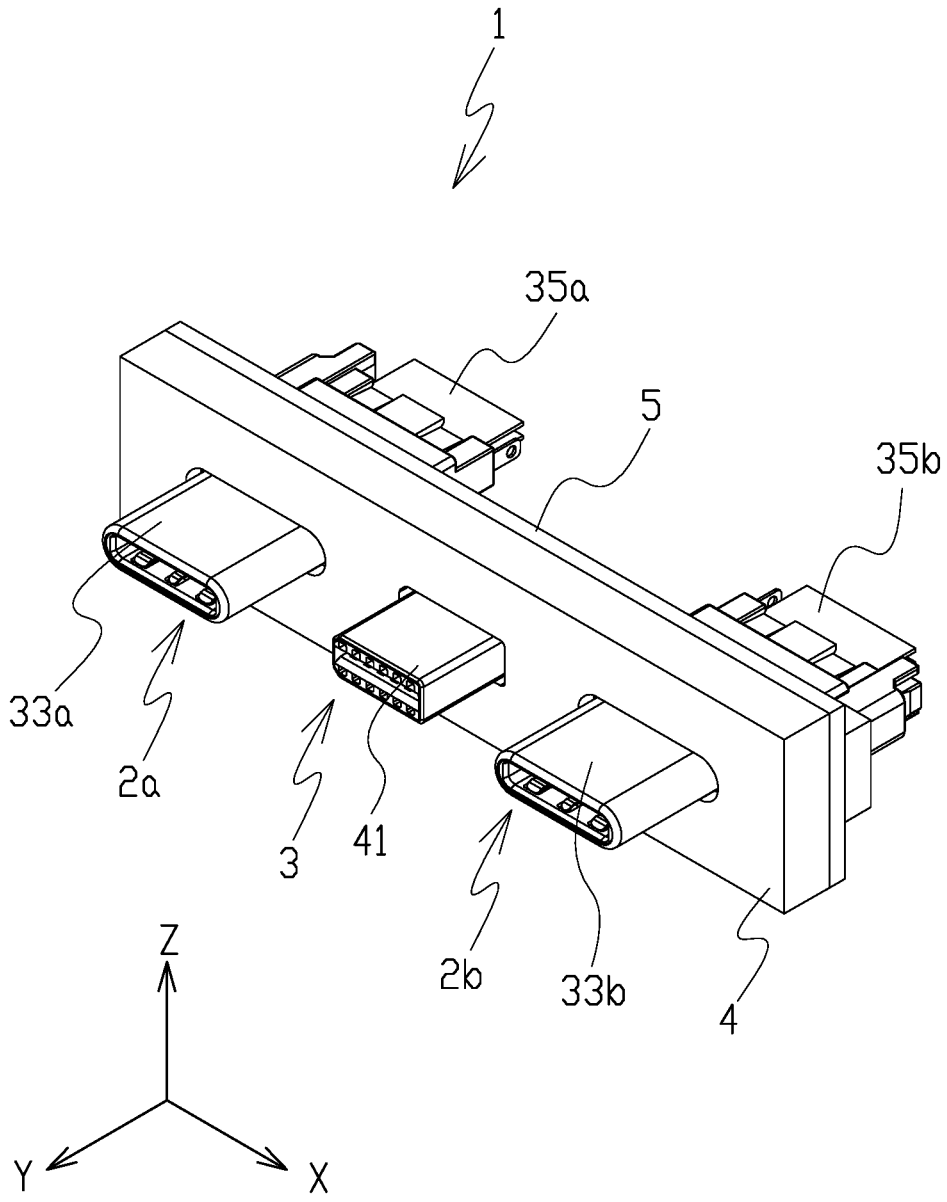
FIG. 1 is a perspective view showing an appearance of a connector according to a first embodiment.
Figure 2:
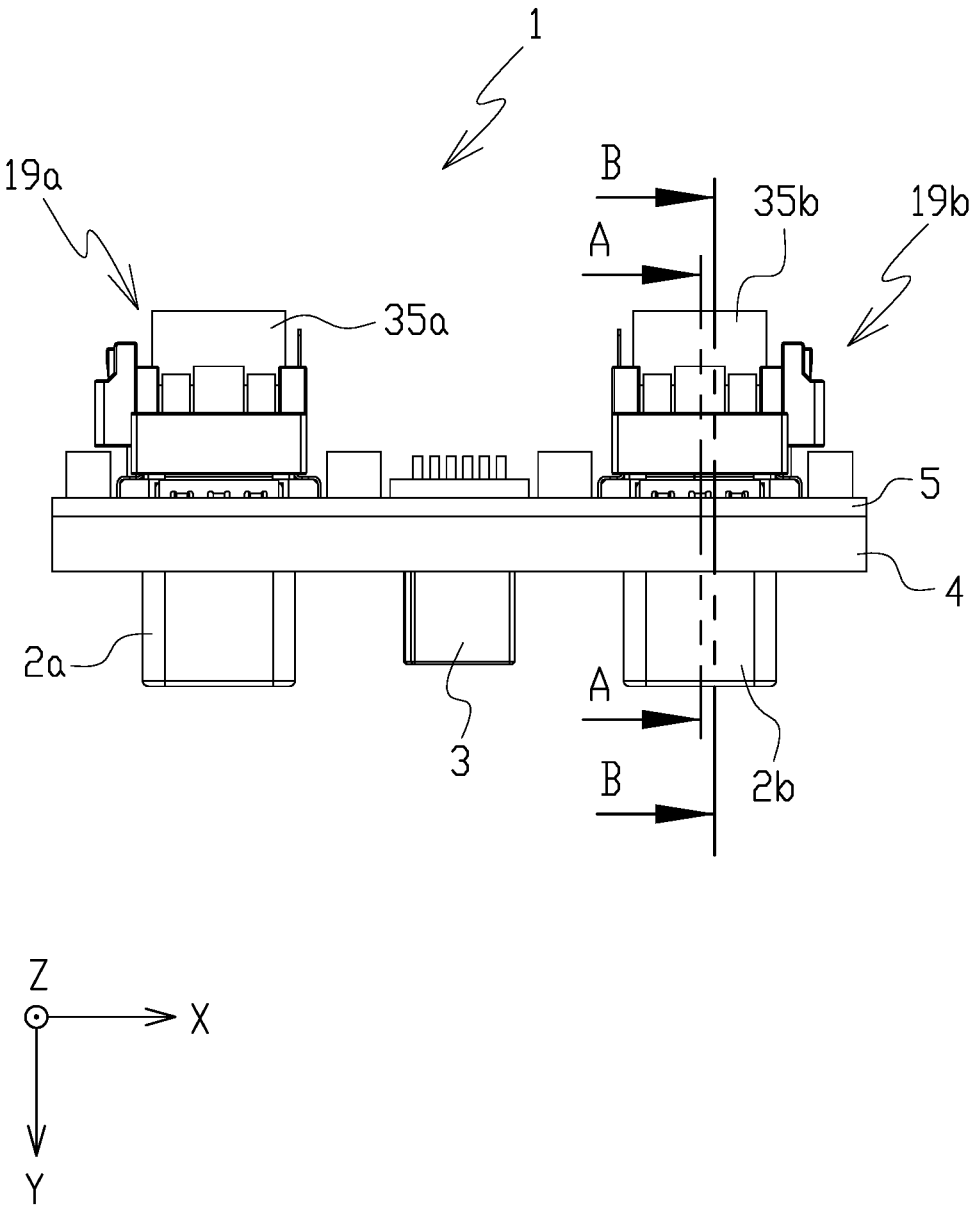
FIG. 2 is a view of the connector according to the first embodiment seen from above.

In the following, with reference to the drawings, a connector (plug connector) according to a first embodiment of the present invention will be described. FIG. 1 is a perspective view showing an appearance of a connector according to the first embodiment, and FIG. 2 is a view of the connector seen from above. As shown in FIG. 1 and FIG. 2, a connector 1 includes two USB Type-C plug connectors (hereinafter, referred to simply as plug connectors) 2*a* and 2*b*, an additional plug connector 3, a casing 4, and a mount plate 5. FIG. 1 and FIG. 2 show a state where to the plug connectors 2*a* and 2*b*, a first flexible flat cable (hereinafter, referred to as a first FFC) 35*a*, a second flexible flat cable (hereinafter, referred to as a second FFC) not shown, a first FFC 35*b* and a second FFC 36*b* (see FIG. 6) are connected.

Additionally, in the following, with an XYZ orthogonal coordinate system set as shown in FIG. 1, description will be made of a positional relationship and the like of each member with reference to the orthogonal coordinate system. An X axis is set to be parallel to a direction in which the plug connector 2*a*, the additional plug connector 3, and the plug connector 2*b* are arranged. A Y axis is set to be parallel to a direction in which the connector 1 is engaged with a partner connector (a receptacle connector not shown). A Z axis is set to be orthogonal to an XY plane. Additionally, a side of the plug connector 2*b* is set to be a +X direction, a side of the plug connector 2*a* is set to be a −X direction, a direction in which the connector 1 is engaged with the partner connector is set to be a +Y direction, and a direction in which the connector 1 is pulled out from the partner connector is set to be a −Y direction.

Figure 3:
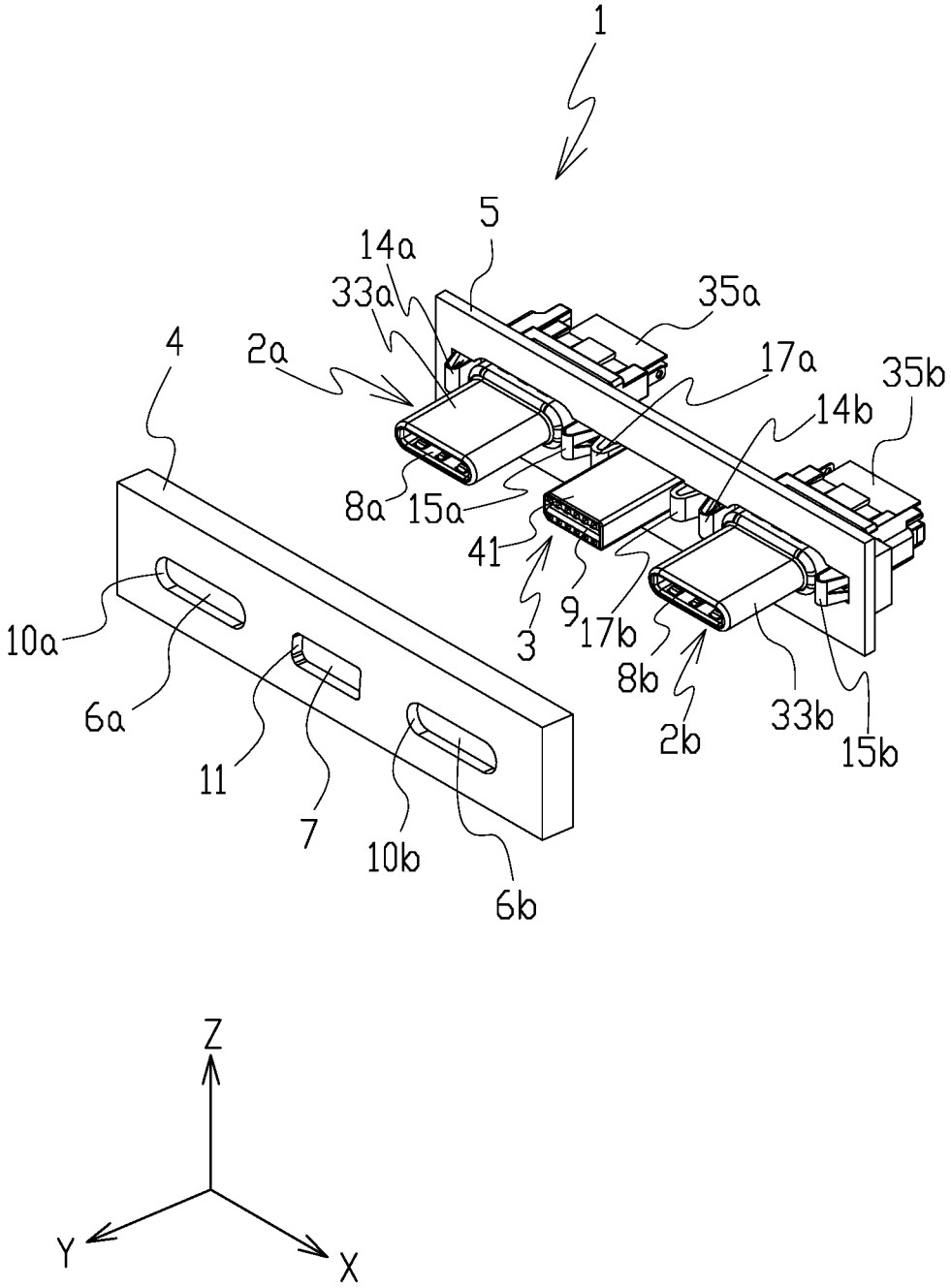
FIG. 3 is a view showing a state where a casing is taken out from the connector according to the first embodiment.

FIG. 3 is a view showing a state where the casing 4 is taken out from the connector 1. As shown in FIG. 3, on the −X direction side of the casing 4, there is formed a first opening portion 6*a* covering the plug connector 2*a* and for exposing an engagement portion 8*a* by which the plug connector 2*a* engages with a USB Type-C receptacle connector (hereinafter, simply referred to as a receptacle connector) not shown. Additionally, on the +X direction side of the casing 4, there is formed a first opening portion 6*b* covering the plug connector 2*b* and for exposing an engagement portion 8*b* by which the plug connector 2*b* engages with a receptacle connector (not shown). Further, between the first opening portion 6*a* and the first opening portion 6*b*, there is formed a second opening portion 7 covering the additional plug connector 3 and for exposing an engagement portion 9 by which the additional plug connector 3 engages with a partner's additional receptacle connector (not shown).

Between an outer wall portion of the plug connector 2*a*, i.e. a plug shell 33*a* which will be described later and a wall portion 10*a* forming the first opening portion 6*a*, a predetermined space is formed such that on a surface in which the first opening portion 6*a* is formed (a ZX plane), the plug connector 2*a* can move as shown in FIG. 1. Similarly, between an outer wall portion of the plug connector 2*b*, i.e. a plug shell 33*b* which will be described later and a wall portion 10*b* forming the first opening portion 6*b*, a predetermined space is formed such that on a surface in which the first opening portion 6*b* is formed (the ZX plane), the plug connector 2*b* can move. Additionally, between an outer wall portion of the additional plug connector 3, i.e. an addition side shell 41 which will be described later and a wall portion 11 forming the second opening portion 7, a predetermined space is formed such that on a surface in which the second opening portion 7 is formed (the ZX plane), the additional plug connector 3 can move.

Figure 4:
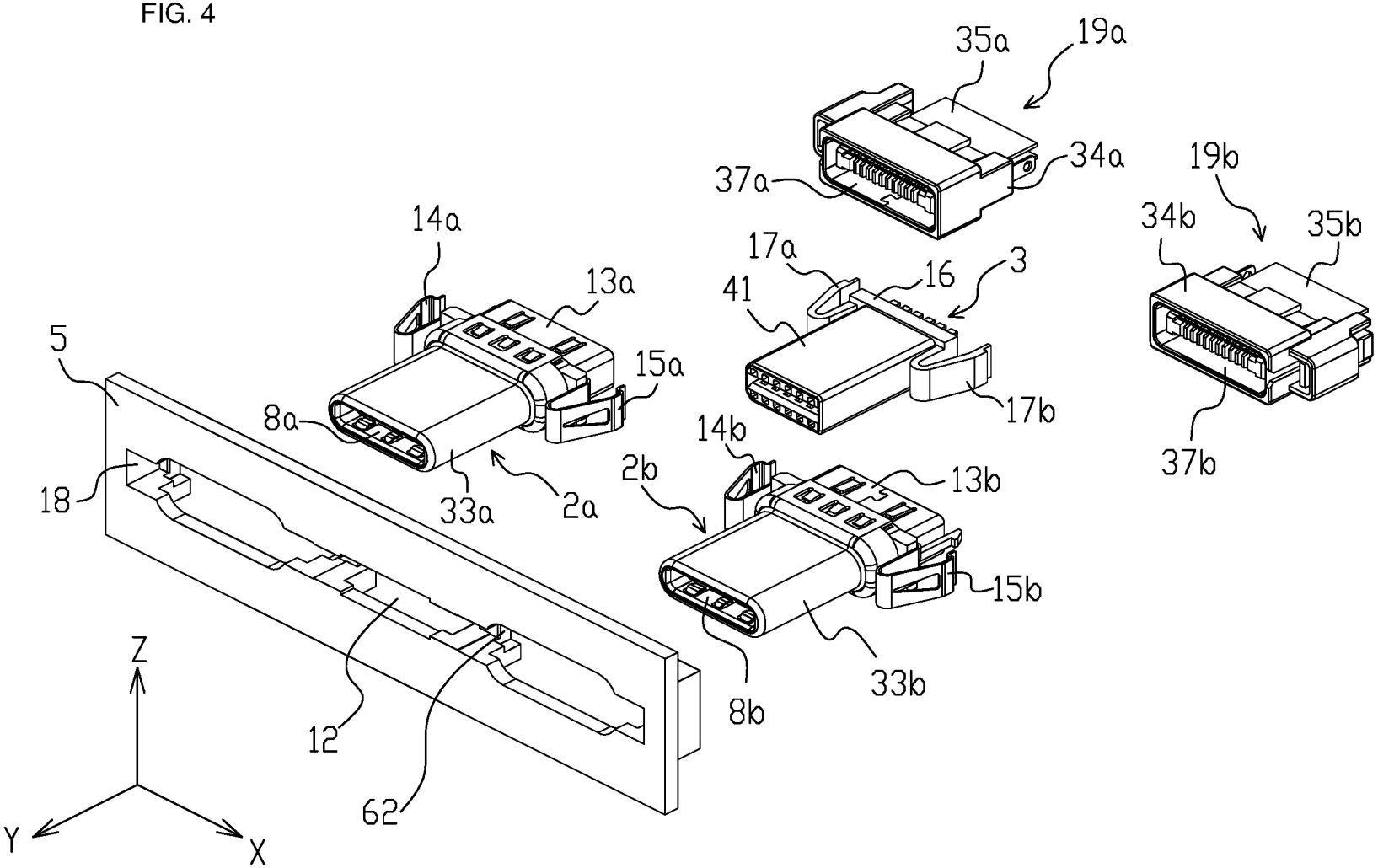
FIG. 4 is a view showing a state where a plug connector and an additional plug connector are taken out from a mount plate.

FIG. 4 is a view showing a state where the plug connectors 2a and 2b and the additional plug connector 3 are taken out from the mount plate 5, and a state where adaptors 19a and 19b to be described later are taken out from the plug connectors 2a and 2b. The mount plate 5 is formed of a member having conductive properties and functions as a cover which covers the plug connectors 2a and 2b and the additional plug connector 3. As shown in FIG. 4, in the mount plate 5, there is formed an opening portion 12 covering the plug connectors 2a and 2b and the additional plug connector 3 and for exposing the engagement portions 8a and 8b of the plug connectors 2a and 2b, and the engagement portion 9 of the additional plug connector 3.

The plug connector 2a includes a first control portion 13a at the rear of the plug shell 33a (a −Y direction side). The first control portion 13a is formed of a member having conductive properties, for example, of metal and includes two elastic members 14a and 15a. The elastic member 14a is formed on the −X direction side of the first control portion 13a, and the elastic member 15a is formed on the +X direction side of the first control portion 13a. As shown in FIG. 3, the elastic members 14a and 15a are arranged in the opening portion 12 and in contact with the mount plate 5 and the plug shell 33a. Specifically, the mount plate 5 is electrically connected to the plug shell 33a via the elastic members 14a and 15a, so that the mount plate 5 and the plug shell 33a electrically conduct with each other. The elastic member 14a pushes the −X direction side of a wall portion 18 forming the opening portion 12 in the −X direction by an elastic force. The −X direction side of the wall portion 18 forming the opening portion 12 receives the elastic force of the elastic member 14a. Additionally, the elastic member 15a pushes a rear of the opening portion 12, i.e. a wall portion (not shown) formed on the −Y direction side of the mount plate 5 in the +X direction by an elastic force. The wall portion (not shown) formed on the −Y direction side of the mount plate 5 receives the elastic force of the elastic member 15a.

The first control portion 13a controls a position and a posture of the plug connector 2a in the X direction with respect to the first opening portion 6a, i.e. a slant with respect to an X axis direction by using elastic forces of the elastic members 14a and 15a. When a force in the −X direction is applied to the plug connector 2a, the elastic member 14a contracts in the −X direction and the elastic member 15a extends in the −X direction. Accordingly, the plug connector 2a moves in the −X direction within a predetermined space formed between the plug shell 33a and the wall portion 10a. When a force in the +X direction is applied to the plug connector 2a, the elastic member 14a extends in the +X direction and the elastic member 15a contracts in the +X direction. Accordingly, the plug connector 2a moves in the +X direction within the predetermined space formed between the plug shell 33a and the wall portion 10a.

Additionally, applying, to the plug connector 2a, a force in a direction slanting with respect to the X axis direction changes the elastic forces of the elastic members 14a and 15a, so that a posture of the plug connector 2a changes to a direction in which the force is applied within the predetermined space formed between the plug shell 33a and the wall portion 10a. When the force applied to the plug connector 2a is released, by the elastic forces of the elastic members 14a and 15a, the plug connector 2a returns to a position and a posture of the plug connector 2a as of before the force is applied thereto.

Additionally, to the plug connector 2a, the adaptor 19a is coupled as shown in FIG. 2. The adaptor 19a is configured to include a housing 34a, a first FFC 35a, a second FFC not shown, and a shell 37a as shown in FIG. 4. The first FFC 35a is arranged on the +Z direction side of the adaptor 19a, and the second FFC not shown is arranged on the −Z direction side of the adaptor 19a. The adaptor 19a is a member for assisting connection between the first FFC 35a and a first contact not shown of the plug connector 2a, and connection between the second FFC not shown and a second contact not shown of the plug connector 2a. The housing 34a holds the first FFC 35a, the second FFC not shown, and the shell 37a. The shell 37a and the housing 34a regulate positions and postures, in the Z direction, of +Y direction side parts of the first FFC 35a and the second FFC not shown. Accordingly, a reaction force in the Z direction generated when the adaptor 19a engages with the plug connector 2a is suppressed.

Next, a configuration of the plug connector 2b will be described. The plug connector 2b includes a first control portion 13b (see FIG. 5) at the rear of the plug shell 33b (the −Y direction side). The first control portion 13b is formed of a member having conductive properties, for example, of metal and includes two elastic members 14b and 15b. The elastic member 14b is formed on the −X direction side of the first control portion 13b, and the elastic member 15b is formed on the +X direction side of the first control portion 13b. As shown in FIG. 3, the elastic members 14b and 15b are arranged in the opening portion 12 and in contact with the mount plate 5 and the plug shell 33b. Specifically, the mount plate 5 is electrically connected with the plug shell 33b via the elastic members 14b and 15b, so that the mount plate 5 and the plug shell 33b electrically conduct with each other. The elastic member 14b pushes a wall portion 62 formed on the −Y direction side of the mount plate 5 in the −X direction by an elastic force. The wall portion 62 formed on the −Y direction side of the mount plate 5 receives the elastic force of the elastic member 14b. Additionally, the elastic member 15b pushes the +X direction side of the wall portion 18 forming the opening portion 12 in the +X direction by an elastic force. The +X direction side of the wall portion 18 forming the opening portion 12 receives the elastic force of the elastic member 14b. The first control portion 13b controls a position and a posture of the plug connector 2b in the X direction with respect to the first opening portion 6b, i.e. a slant with respect to the X axis direction by using the elastic forces of the elastic members 14b and 15b. Since position control and posture control of the plug connector 2b in the first control portion 13b are the same as position control and posture control of the plug connector 2a in the first control portion 13a, no description will be made thereof.

Additionally, to the plug connector 2b, the adaptor 19b is coupled as shown in FIG. 2. The adaptor 19b is configured to include a housing 34b, the first FFC 35b, the second FFC 36b (see FIG. 6), and a shell 37b as shown in FIG. 4. The first FFC 35b is arranged on the +Z direction side of the adaptor 19b, and the second FFC 36b is arranged on the −Z direction side of the adaptor 19b. The adaptor 19b is a member for assisting connection between the first FFC 35b and a first contact 20b of the plug connector 2b (see FIG. 5), and connection between the second FFC 36b and a second contact 21b of the plug connector 2b (see FIG. 5). The housing 34b holds the first FFC 35b, the second FFC 36b, and the shell 37*b*. The shell 37*a* and the housing 34*a* regulate positions and postures, in the Z direction, of +Y direction side parts of the first FFC 35*a* and the second FFC not shown. Accordingly, a reaction force in the Z direction generated when the adaptor 19*b* engages with the plug connector 2*b* is suppressed.

Figure 5:
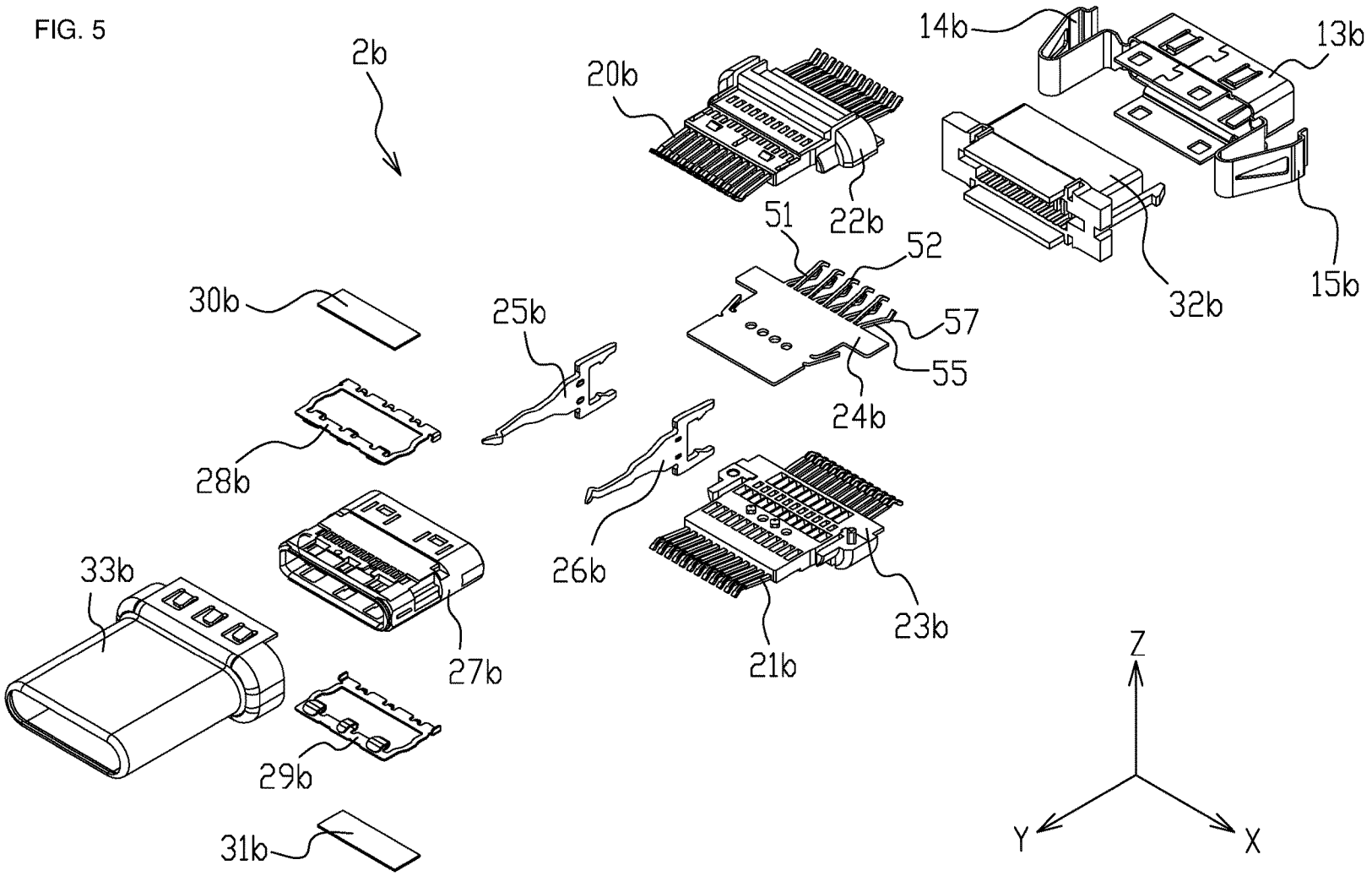
FIG. 5 is an exploded view showing a configuration of the plug connector according to the first embodiment.
Figure 6:
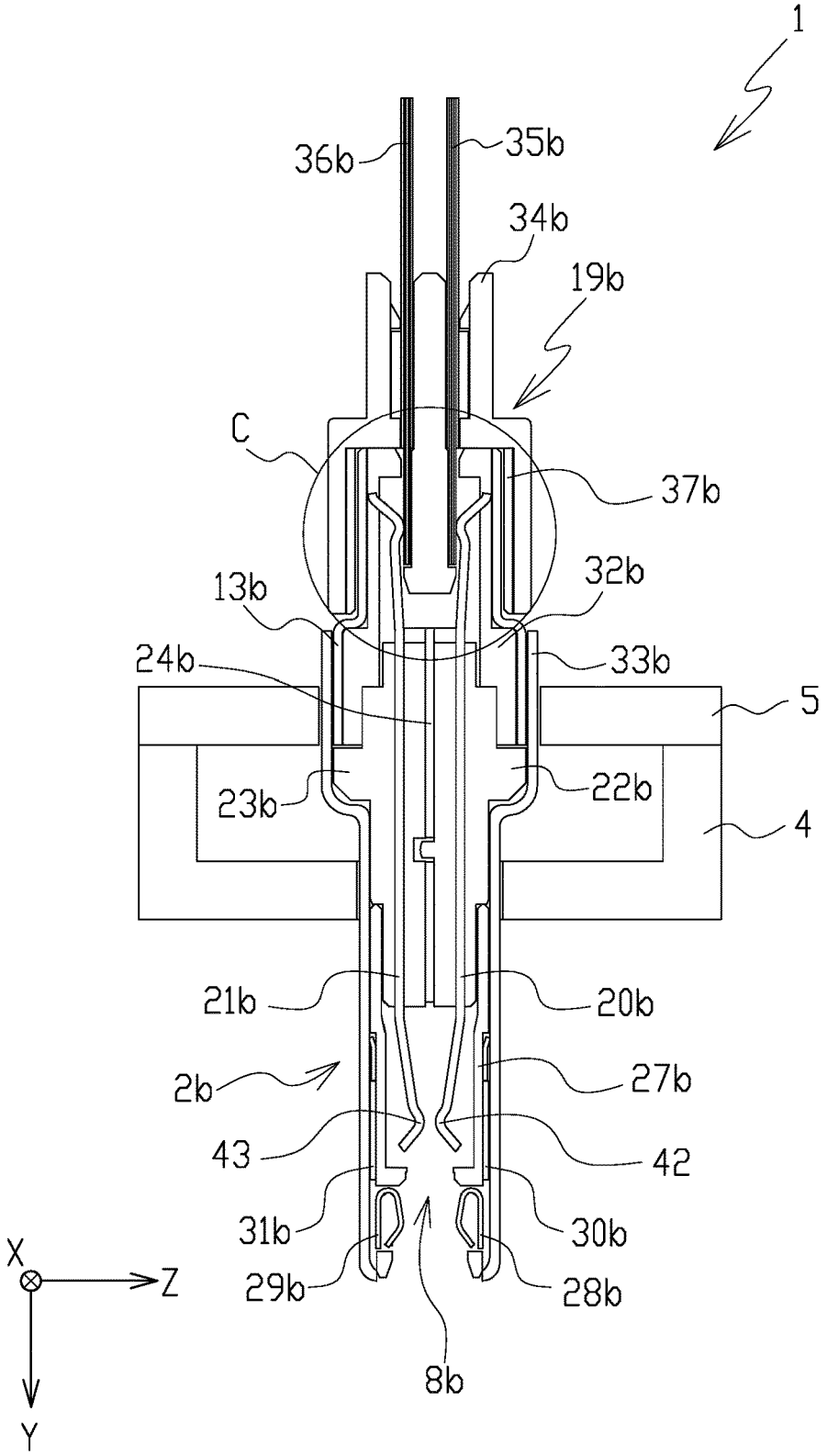
FIG. 6 is an end view showing the configuration of the plug connector according to the first embodiment.
Figure 7:
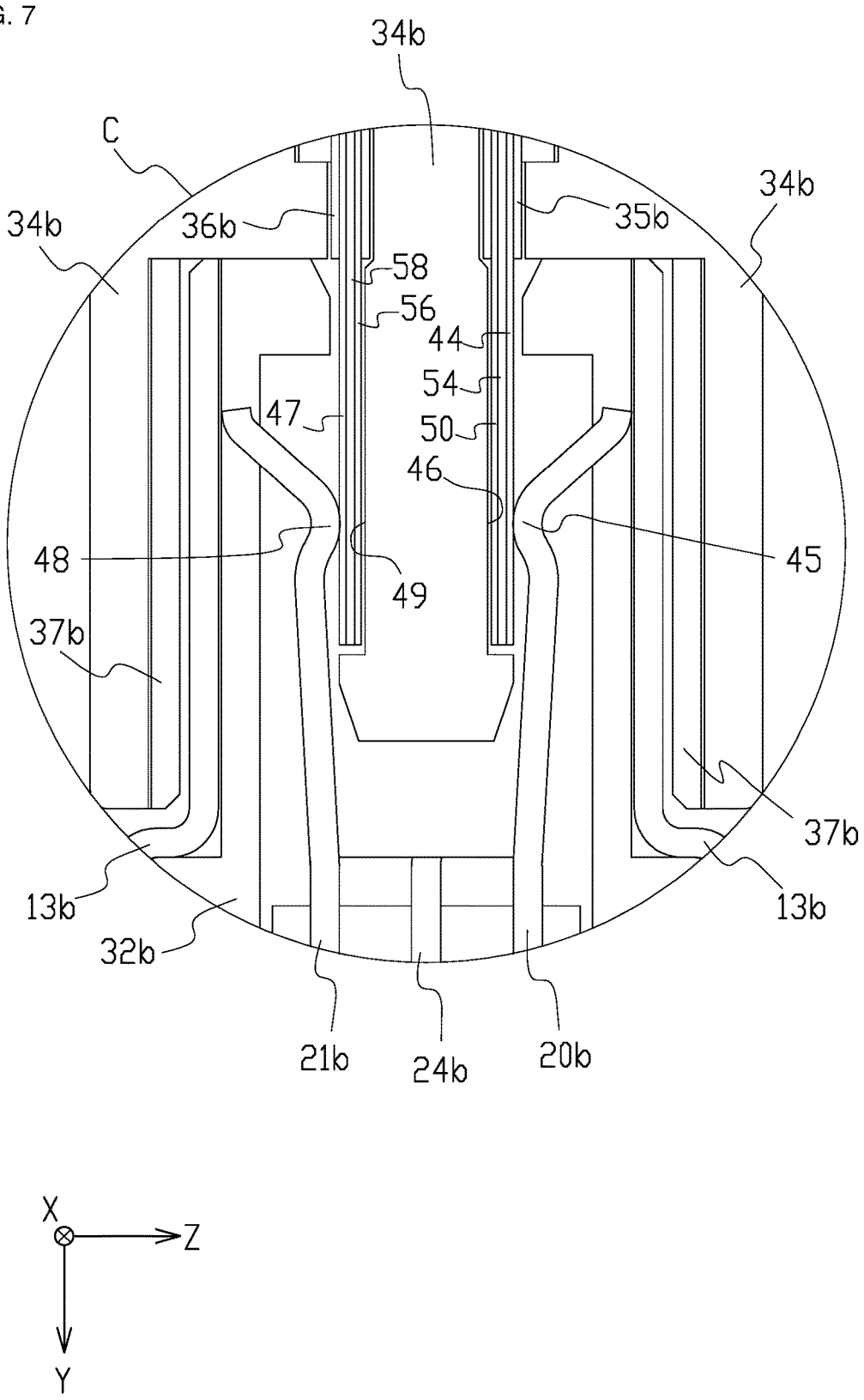
FIG. 7 is an extended view showing configurations of a contact portion between a first contact and a first conductor and a contact portion between a second contact and a second conductor of the plug connector according to the first embodiment.

FIG. 5 is an exploded view showing a configuration of the plug connector 2*b*, FIG. 6 is an end view taken along A-A of FIG. 2, and FIG. 7 is an extended view of the members surrounded by a circle C shown in FIG. 6. As shown in FIG. 5 and FIG. 6, the plug connector 2*b* includes a plurality (12 in this first embodiment) of first contacts 20*b* and a plurality (12 in this first embodiment) of second contacts 21*b*, which contacts connect with a plurality of contacts of the receptacle connector not shown. The plurality of first contacts 20*b* is arranged on the +Z direction side of the plug connector 2*b*, and the plurality of second contacts 21*b* is arranged on the −Z direction side of the plug connector 2*b*. Additionally, as shown in FIG. 6, each of the first contacts 20*b* includes a contact portion 42 at an end portion thereof on the +Y direction side, the contact portion for coming into contact with a contact of the receptacle connector not shown. Additionally, each of the second contacts 21*b* includes a contact portion 43 at an end portion thereof on the +Y direction side, the contact portion for coming into contact with a contact of the receptacle connector not shown.

Additionally, as shown in FIG. 7, at an end portion of the first contact 20*b* on the −Y direction side, a first connection portion 45 is formed for the connection with a first conductor 44 of the first FFC 35*b*. The end portion of the first contact 20*b* on the −Y direction side is formed of an elastic body including the first connection portion 45. Accordingly, the first contact 20*b* electrically connects with the first conductor 44 by pushing of the first connection portion 45 to the first conductor 44 (the −Z direction) by an elastic force of the elastic body. Additionally, a first supporting surface 46 of the housing 34*b* provided in the adaptor 19*b* receives a force of pressing the first connection portion 45 to the first conductor 44 (the elastic force of the elastic body). The first FFC 35*b* includes a plurality of the first conductors 44 connecting to the plurality of first contacts 20*b*, respectively.

At an end portion of the second contact 21*b* on the −Y direction side, a second connection portion 48 is formed for the connection with a second conductor 47 of the second FFC 36*b*. The end portion of the second contact 21*b* on the −Y direction side is formed of an elastic body including the second connection portion 48. Accordingly, the second contact 21*b* electrically connects with the second conductor 47 by pushing of the second connection portion 48 to the second conductor 47 (the +Z direction) by an elastic force of the elastic body. Additionally, a second supporting surface 49 of the housing 34*b* provided in the adaptor 19*b* receives a force of pressing the second connection portion 48 to the second conductor 47 (the elastic force of the elastic body). The second FFC 36*b* includes a plurality of the second conductors connecting to the plurality of second contacts 21*b*, respectively.

Additionally, the plug connector 2*b* includes an insert housing 22*b* and an insert housing 23*b* each formed of an insulator as shown in FIG. 5 and FIG. 6. The insert housing 22*b* holds the plurality of first contacts 20*b*, and the insert housing 23*b* holds the plurality of second contacts 21*b*.

Figure 8:
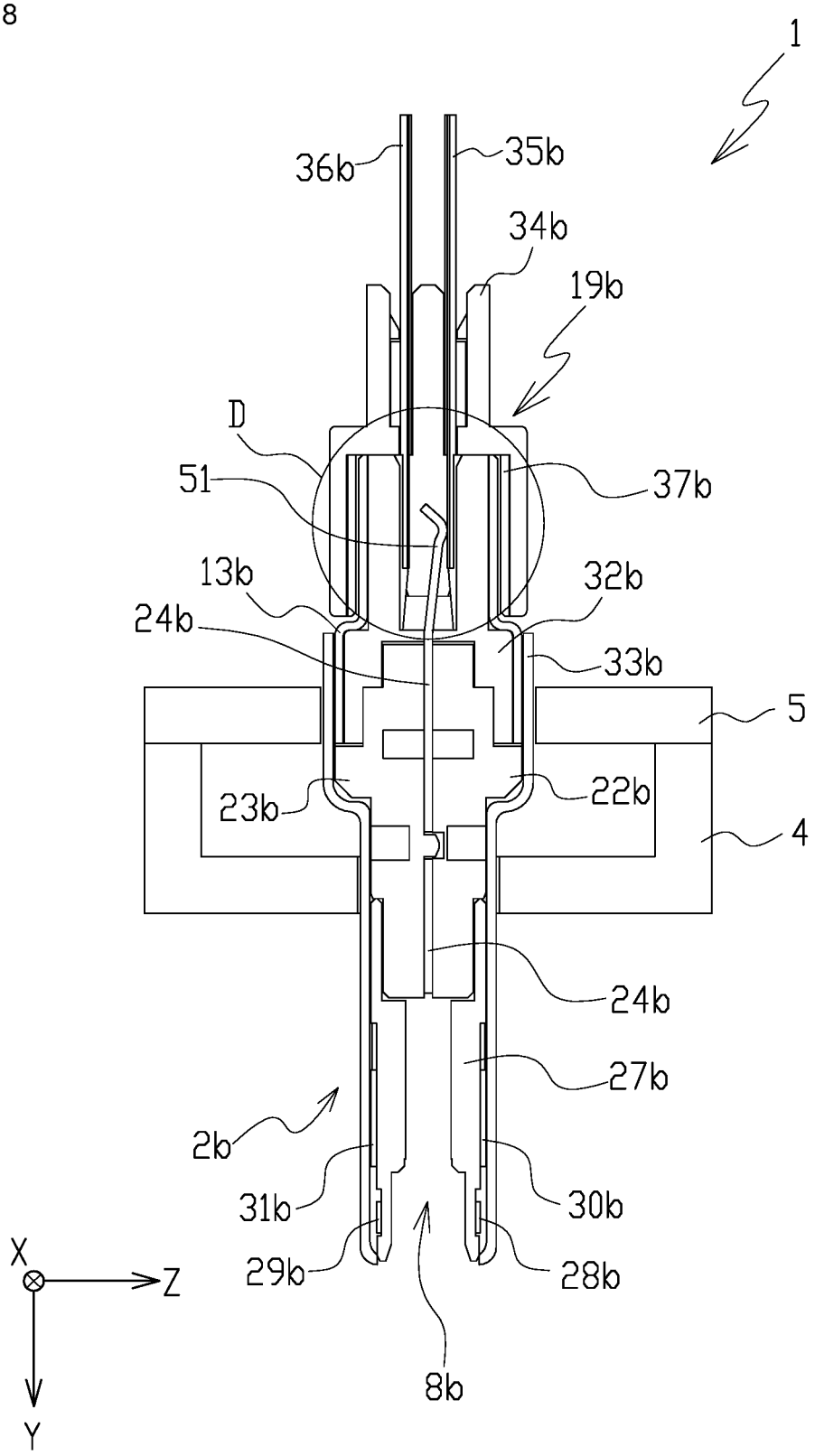
FIG. 8 is an end view showing the configuration of the plug connector according to the first embodiment.
Figure 9:
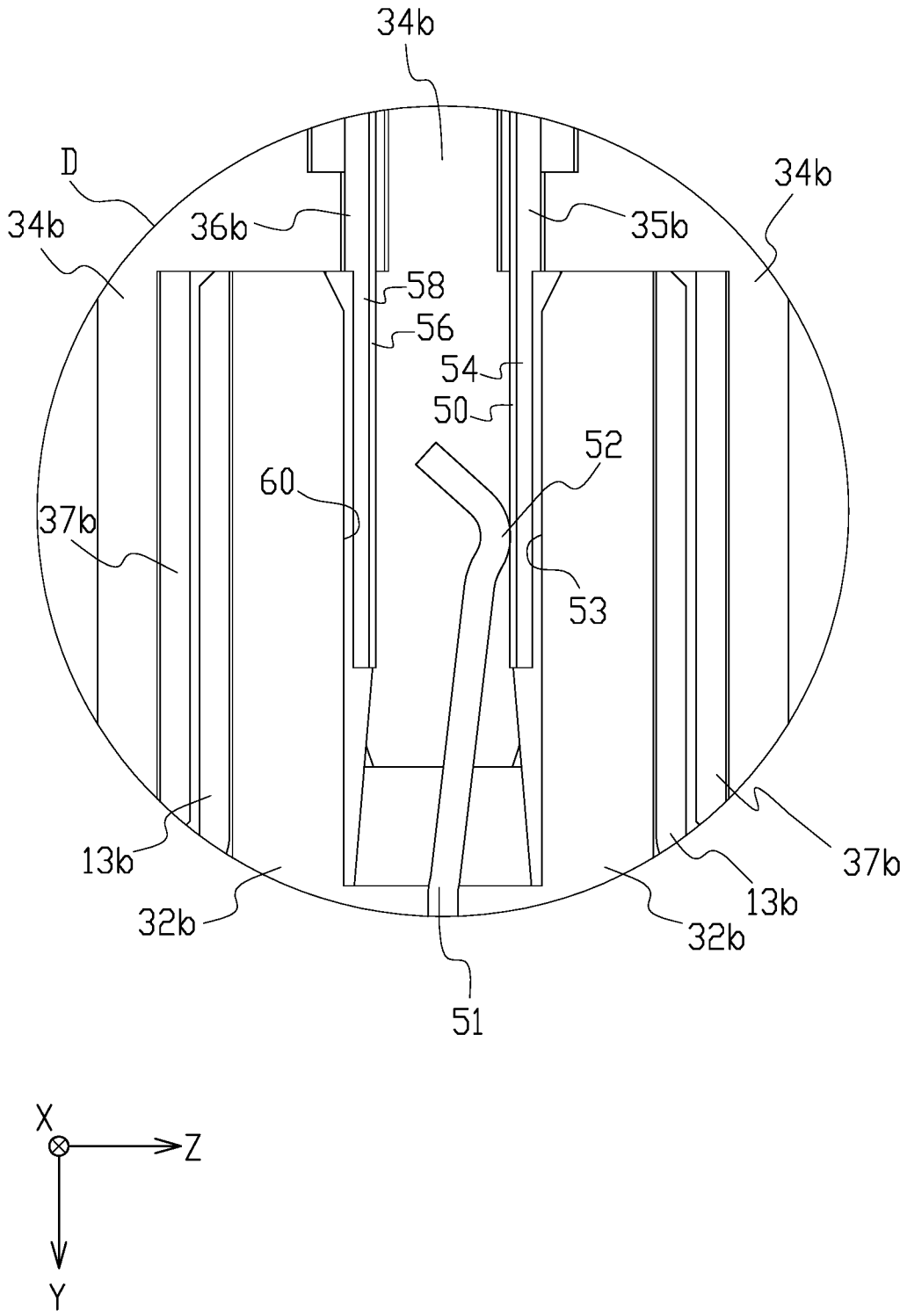
FIG. 9 is an extended view showing a configuration of a contact portion between a ground plate and a first shield portion of the plug connector according to the first embodiment.

Additionally, the plug connector 2*b* includes a ground plate 24*b* between the first contact 20*b* and the second contact 21*b*. At an end portion of the ground plate 24*b* on the −Y direction side, a plurality (five in the first embodiment) of first elastic members 51 is provided for the connection with a first shield portion 50 of the first FFC 35*b*. FIG. 8 is an end view taken along B-B in FIG. 2, and FIG. 9 is an extended view of the members surrounded by a circle D shown in FIG. 8. As shown in FIG. 9, at an end portion of the first elastic member 51 on the −Y direction side, a first shield connection portion 52 is formed for the connection with the first shield portion 50 of the first FFC 35*b*. The first shield connection portion 52 and the first shield portion 50 electrically connect with each other by pushing of the first shield connection portion 52 to the first shield portion 50 (the +Z direction) by an elastic force of the first elastic member 51. As a result, the ground plate 24*b* electrically connects with the first shield portion 50 of the first FFC 35*b* via the first elastic member 51. Additionally, a third supporting surface 53 of a housing 32*b* (to be described later) provided in the plug connector 2*b* receives the force which pushes the first shield connection portion 52 to the first shield portion 50 (the elastic force of the first elastic member 51). The first FFC 35*b* includes one first shield portion 50 to be connected with the plurality of first elastic members 51. Additionally, between the plurality of first conductors 44 of the first FFC 35*b* and one first shield portion 50, an insulator 54 is interposed.

Additionally, as shown in FIG. 5, at the end portion of the ground plate 24*b* on the −Y direction side, a plurality (five in this first embodiment) of second elastic members 55 is provided for the connection with a second shield portion 56 of the second FFC 36*b* (see FIG. 7). At an end portion of the second elastic members 55 on the −Y direction side, a second shield connection portion 57 is formed for the connection with the second shield portion 56 of the second FFC 36*b*. The second shield connection portion 57 and the second shield portion 56 electrically connect with each other by pushing of the second shield connection portion 57 to the second shield portion 56 (the −Z direction) by an elastic force of the second elastic members 55. In other words, the ground plate 24*b* electrically connects with the second shield portion 56 of the second FFC 36*b* via the second elastic members 55. Additionally, a third supporting surface 60 (see FIG. 9) of the housing 32*b* provided in the plug connector 2*b* receives the force which pushes the second shield connection portion 57 to the second shield portion 56 (the elastic force of the second elastic members 55). The second FFC 36*b* includes one second shield portion 56 to be connected with the plurality of second elastic members 55. Additionally, an insulator 58 is interposed between the plurality of second conductors 47 and one second shield portion 56 of the second FFC 36*b*.

Additionally, as shown in FIG. 5, the plug connector 2*b* includes two ground contacts 25*b* and 26*b*. The ground contact 25*b* is arranged on the −X direction side of the plug connector 2*b*, and the ground contact 26*b* is arranged on the +X direction side of the plug connector 2*b*, the ground contacts 25*b* and 26*b* being connected to the ground plate 24*b*.

Additionally, the plug connector 2*b* includes a plug housing 27*b*. In the plug housing 27*b*, there are provided a part on the +Y direction side of the plurality of first contacts 20*b*, the part being held by the insert housing 22*b*, a part on the +Y direction side of the plurality of the first contacts 20*b*, the part being held by the insert housing 23*b*, the ground plate 24*b*, and parts on the +Y direction side of the two ground contacts 25*b* and 26*b*. The insert housings 22*b* and 23*b* and the plug housing 27*b* regulate positions and postures, in the Z direction, of the part on the +Y direction side of the plurality of first contacts 20*b*, the part on the +Y direction side of the plurality of first contacts 20*b*, and the part on the +Y direction side of the ground plate 24*b*. Additionally, the plug housing 27*b* holds ground plate contacts 28*b* and 29*b*, and in the vicinity of the ground plate contacts 28*b* and 29*b*, insulation plates 30*b* and 31*b* are arranged, respectively.

The ground plate contact 28*b* and the insulation plate 30*b* are arranged on the +Z direction side of the plug housing 27*b*. When the plug connector 2*b* engages with a receptacle connector not shown, the ground plate contact 28*b* connects with a ground shell of the receptacle connector. The ground plate contact 29*b* and the insulation plate 31*b* are arranged on the −Z direction side of the plug housing 27*b*. The ground plate contact 29*b* connects with the ground shell of the receptacle connector when the plug connector 2*b* engages with the receptacle connector.

Additionally, the plug connector 2*b* includes the housing 32*b*. In the housing 32*b*, there are arranged a part on the −Y direction side of the plurality of first contacts 20*b*, the part being held in the insert housing 22*b*, a part on the −Y direction side of the plurality of second contacts 21*b*, the part being held in the insert housing 23*b*, the ground plate 24*b*, and parts on the −Y direction side of the two ground contacts 25*b* and 26*b*. The housing 32*b* has an outer circumference thereof covered with the first control portion 13*b*. The housing 32*b* and the first control portion 13*b* regulate positions and postures, in the Z direction, of the part on the −Y direction side of the plurality of first contacts 20*b*, the part on the −Y direction side of the plurality of first contacts 20*b*, and the part on the −Y direction side of the ground plate 24*b*. Accordingly, a reaction force generated in the Z direction when the plug connector 2*b* couples with the adaptor 19*b* is suppressed.

Additionally, the plug connector 2*b* has the plug shell 33*b*, which plug shell 33*b* covers an outer circumference of the plug housing 27*b* and an outer circumference on the +Y direction side of the first control portion 13*b*. Similarly to the insert housings 22*b* and 23*b*, and the plug housing 27*b*, a plug shell 33 regulates positions and postures, in the −Z direction, of the part on the +Y direction side of the plurality of first contacts 20*b*, the part on the +Y direction side of the plurality of first contacts 20*b*, and the part on the +Y direction side of the ground plate 24*b*. Accordingly, reaction force generated in the Z direction when the plug connector 2*b* engages with the receptacle connector is suppressed.

The plug connector 2*a* includes a plurality of first contacts not shown, a plurality of second contacts not shown, two insert housings not shown, a ground plate not shown, two ground contacts not shown, a plug housing not shown, two ground plate contacts not shown, two insulation plates not shown, a housing not shown, and the plug shell 33*a* (see FIG. 4). With a Y axis direction of the connector 1 as a center line, configurations of these portions are line-symmetrically the same as the plurality of first contacts 20*b*, the plurality of second contacts 21*b*, the insert housings 22*b* and 23*b*, the ground plate 24*b*, the ground contacts 25*b* and 26*b*, the plug housing 27*b*, the ground plate contacts 28*b* and 29*b*, the insulation plates 30*b* and 31*b*, the housing 32*b*, and the plug shell 33*b*.

Figure 10:
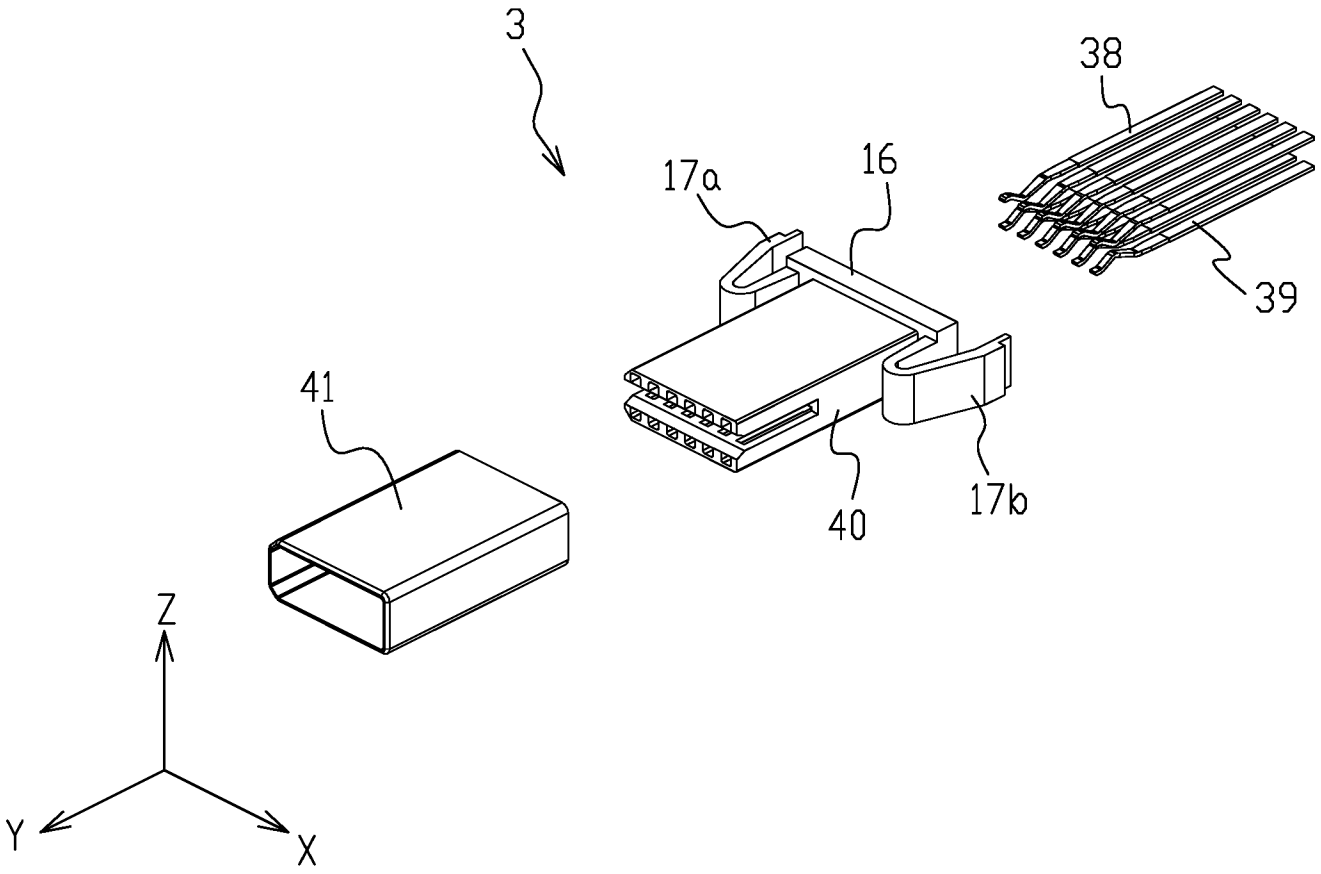
FIG. 10 is an exploded view showing a configuration of the additional plug connector according to the first embodiment.

Next, a configuration of the additional plug connector 3 will be described. FIG. 10 is an exploded view showing the configuration of the additional plug connector 3. The additional plug connector 3 includes a second control portion 16 at the rear (the −Y direction side) of the addition side shell 41. The second control portion 16 is formed of an insulator, e.g. a resin, and includes two elastic members 17*a* and 17*b*. The elastic member 17*a* is formed on the −X direction side of the second control portion 16, and the elastic member 17*b* is formed on the +X direction side of the second control portion 16. As shown in FIG. 3, the elastic members 17*a* and 17*b* are arranged in the opening portion 12, with the elastic member 17*a* pushing, in the −X direction, a wall portion (not shown) formed at the rear of the opening portion 12, i.e. on the −Y direction side of the mount plate 5, by an elastic force. The wall portion (not shown) formed on the −Y direction side of the mount plate 5 receives the elastic force of the elastic member 17*a*. Additionally, the elastic member 17*b* pushes, in the +X direction, a wall portion (not shown) formed at the rear of the opening portion 12, i.e. on the −Y direction side of the mount plate 5, by an elastic force. The wall portion (not shown) formed on the −Y direction side of the mount plate 5 receives the elastic force of the elastic member 17*b*. The second control portion 16 controls a position and a posture of the additional plug connector 3 in the X direction with respect to the second opening portion 7 by using the elastic forces of the elastic members 17*a* and 17*b*. Since the position control and posture control of the additional plug connector 3 by the second control portion 16 are the same as the position control and posture control of the plug connector 2*a* by the first control portion 13*a*, no description will be made thereof.

Additionally, the additional plug connector 3 includes a plurality of contacts 38 and 39 to be connected with a plurality of contacts of an additional receptacle connector not shown. The plurality (six in this first embodiment) of contacts 38 is arranged on the +Z direction side of the additional plug connector 3, and the plurality (six in this first embodiment) of contacts 39 is arranged on the −Z direction side of the additional plug connector 3. Additionally, the additional plug connector 3 includes an addition side housing 40 formed integrally with the second control portion 16. The addition side housing 40 holds the plurality of contacts 38 and 39. Additionally, the additional plug connector 3 has the addition side shell 41, which addition side shell 41 covers an outer circumference of the addition side housing 40.

Since the connector 1 according to the first embodiment includes the first control portions 13*a* and 13*b* and the second control portion 16, and the plug connector is connected with the first FFC and the second FFC, position control and posture control of the plug connectors 2*a* and 2*b* and the additional plug connector 3 can be conducted. Specifically, since the plug connectors 2*a* and 2*b* and the additional plug connector 3 are configured to be movable within a predetermined space, the plug connectors 2*a* and 2*b* and the additional plug connector 3 can be securely engaged with the receptacle connector not shown and the partner's additional receptacle connector without damages. Additionally, without engagement with the receptacle connector, the plug connectors 2*a* and 2*b* can be maintained at a predetermined position and in a predetermined posture by position control and posture control by the first control portions 13*a* and 13*b*. Similarly, without engagement with the partner's additional receptacle connector, the additional plug connector 3 can be maintained at a predetermined position and in a predetermined posture by position control and posture control by the second control portion 16. Specifically, deviation in a position and a posture of the plug connectors 2*a* and 2*b* and the additional plug connector 3 during mounting thereof can be securely absorbed.

Additionally, even in a case where the connector 1 is mounted on an electronic apparatus, when a position of the connector with respect to a printed board mounted on the electronic apparatus is different, the connector can be easily connected with the printed board without changing a configuration or a length of the first contact, the second contact, and the ground plate. Specifically, since the first contact, the second contact, and the ground plate are connected with the first FFC and the second FFC, by connecting the first FFC and the second FFC with the printed board of the electronic apparatus, the connector 1 and printed board can be electrically connected with each other via the first FFC and the second FFC.

The above-described connector 1 according to the first embodiment, which includes the first control portions 13*a* and 13*b* and the second control portion 16 that control a position in the X direction of the plug connectors 2*a* and 2*b* and the additional plug connector 3 and a slant of the same with respect to the X axis direction, may include a floating that controls a position in the Z direction of the plug connectors 2*a* and 2*b* and the additional plug connector 3 and a slant of the same with respect to the Z axis direction. For example, with a floating having an elastic member on the ±Z direction side arranged in the opening portion 12, position control and posture control of the plug connectors 2*a* and 2*b* and the additional plug connector 3 are conducted using an elastic force of the elastic member in the ±Z direction. When a force in the ±Z direction is applied to the plug connector 2*a*, the plug connector 2*a* moves in the ±Z direction within a predetermined space formed between the plug shell 33*a* and the wall portion 10*a* due to the elastic force of the elastic member. Additionally, when the force applied to the plug connector 2*a* is released, the plug connector 2*a* returns to a previous position and posture as of before application of the force due to the elastic force of the elastic member. Control of the positions of the plug connector 2*b* and the additional plug connector 3 in the Z direction and a slant with respect to the Z axis direction can be also conducted similarly to control of a position of the plug connector 2*a* in the Z direction and a slant with respect to the Z axis direction.

Additionally, in the above connector 1 according to the first embodiment, although the first control portions 13*a* and 13*b* integrally control a position of the plug connectors 2*a* and 2*b* in the X direction and a slant with respect to the X axis direction, control may be conducted individually. For example, with one first control portion including the elastic members 14*a* and 14*b* and the other first control portion including the elastic members 15*a* and 15*b* provided, positions of the plug connectors 2*a* and 2*b* in the X direction and slants of the same in the X axis direction may be controlled by these two first control portions. Similarly, the second control portion 16, which integrally controls a position of the additional plug connector 3 in the X direction and a slant of the same in the X axis direction, may separately control the same. For example, with one second control portion including the elastic member 17*a* and the other second control portion including the elastic member 17*b* provided, a position of the additional plug connector 3 in the X direction and a slant of the same in the X axis direction may be controlled by these two second control portions.

Additionally, in the above-described connector 1 according to the first embodiment, the first control portions 13*a* and 13*b*, which are provided in the outer wall portions of the plug connectors 2*a* and 2*b*, may be provided in a wall portion forming the opening portion 12 or the wall portion 62 formed in the mount plate 5, or the like. Additionally, the second control portion 16, which is provided in the outer wall portion of the additional plug connector 3, may be provided in the wall portion forming the opening portion 12 or in the wall portion formed in the mount plate 5.

Figure 11:
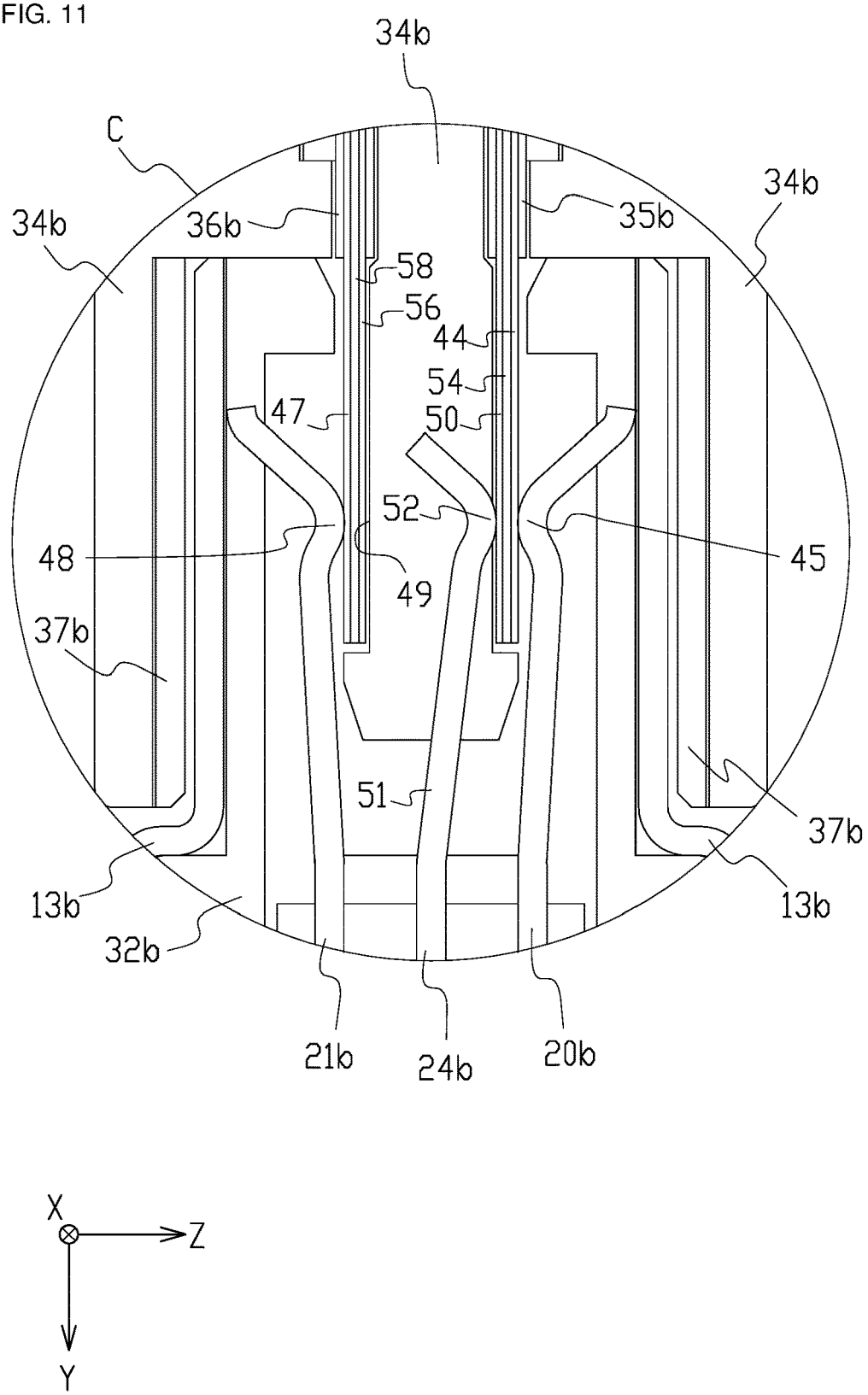
FIG. 11 is an extended view showing another configuration of the contact portion between the ground plate and the first shield portion.

Additionally, in the above-described connector 1 according to the first embodiment, although the first supporting surface 46 and the first shield connection portion 52 are separately configured, the first supporting surface and the first shield connection portion may be integrally formed. Specifically, although the first supporting surface 46 receives a force which pushes the first connection portion 45 to the first conductor 44 (an elastic force of the elastic body), the first shield connection portion 52 may function as a first supporting portion which receives an elastic force of the elastic body. For example, as shown in FIG. 11, the first shield connection portion 52 may be arranged at a position where the force which pushes the first connection portion 45 to the first conductor 44 can be received so that the first shield connection portion 52 functions as the first supporting portion. In this case, however, the third supporting surface 53 and the first connection portion 45 are not configured separately, but the third supporting portion and the first connection portion are integrally formed. Specifically, in place of the third supporting surface 53, the first connection portion 45 functions as the third supporting portion that receives a force which pushes the first shield connection portion 52 to the first shield portion 50 (an elastic force of the first elastic member 51).

Additionally, in the above-described connector 1 according to the first embodiment, although the second supporting surface 49 and the second shield connection portion 57 are separately configured, the second supporting surface and the second shield connection portion may be integrally formed. Specifically, while the second supporting surface 49 receives a force which pushes the second connection portion 48 to the second conductor 47 (an elastic force of the elastic body), the second shield connection portion 57 may function as the second supporting portion which receives the elastic force of the elastic body. For example, the second shield connection portion 57 is arranged at a position where a force which pushes the second connection portion 48 to the second conductor 47 can be received so that the second shield connection portion 57 functions as the second supporting portion. In this case, however, the third supporting surface 60 and the second connection portion 48 are not separately configured, but the third supporting portion and the second connection portion are integrally formed. Specifically, in place of the third supporting surface 60, the second connection portion 48 functions as the third supporting portion that receives a force which pushes the second shield connection portion 57 to the second shield portion 56 (an elastic force of the second elastic members 55).

Additionally, although the above-described connector 1 according to the first embodiment has been described with respect to a case where the first connection portion 45, the first shield connection portion 52, the second connection portion 48, and the second shield connection portion 57 are points, at least one of the first connection portion, the first shield connection portion, the second connection portion, and the second shield connection portion may be a surface. Additionally, at least one of the first connection portion, the first shield connection portion, the second connection portion, and the second shield connection portion is formed of two or more points, or two or more surfaces.

Additionally, although in the above-described connector 1 according to the first embodiment, one additional plug connector 3 is provided, two or more additional plug connectors may be provided.

Additionally, although in the above-described first embodiment, the ground plate 24*b* is electrically connected with the first shield portion 50 of the first FFC 35*b* and with the second shield portion 56 of the second FFC 36*b*, at least one of the first shield portion and the second shield portion needs to be connected.

Additionally, while the above first embodiment has been described with respect to a case where as the first conductor to be connected with the plurality of first contacts 20*b* and as the second conductor to be connected with the plurality of second contacts 21*b*, a conductor configuring an FFC is used, other than an FFC, for example, a conductor foil configuring a flexible printed board (FPC) or the like may be used as the first conductor and the second conductor.

Figure 12:
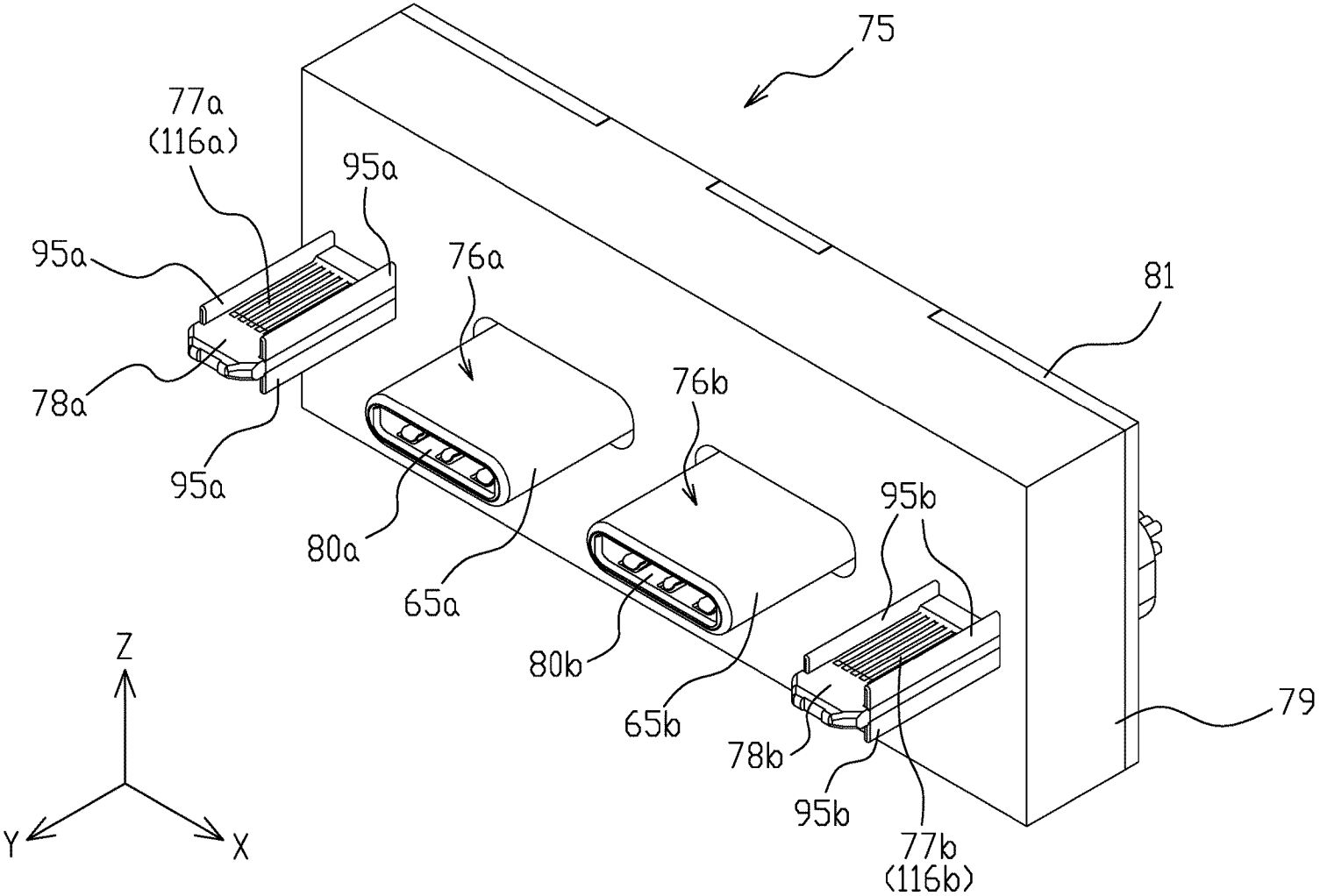
FIG. 12 is a perspective view showing an appearance of a plug docking connector according to a second embodiment.
Figure 13:
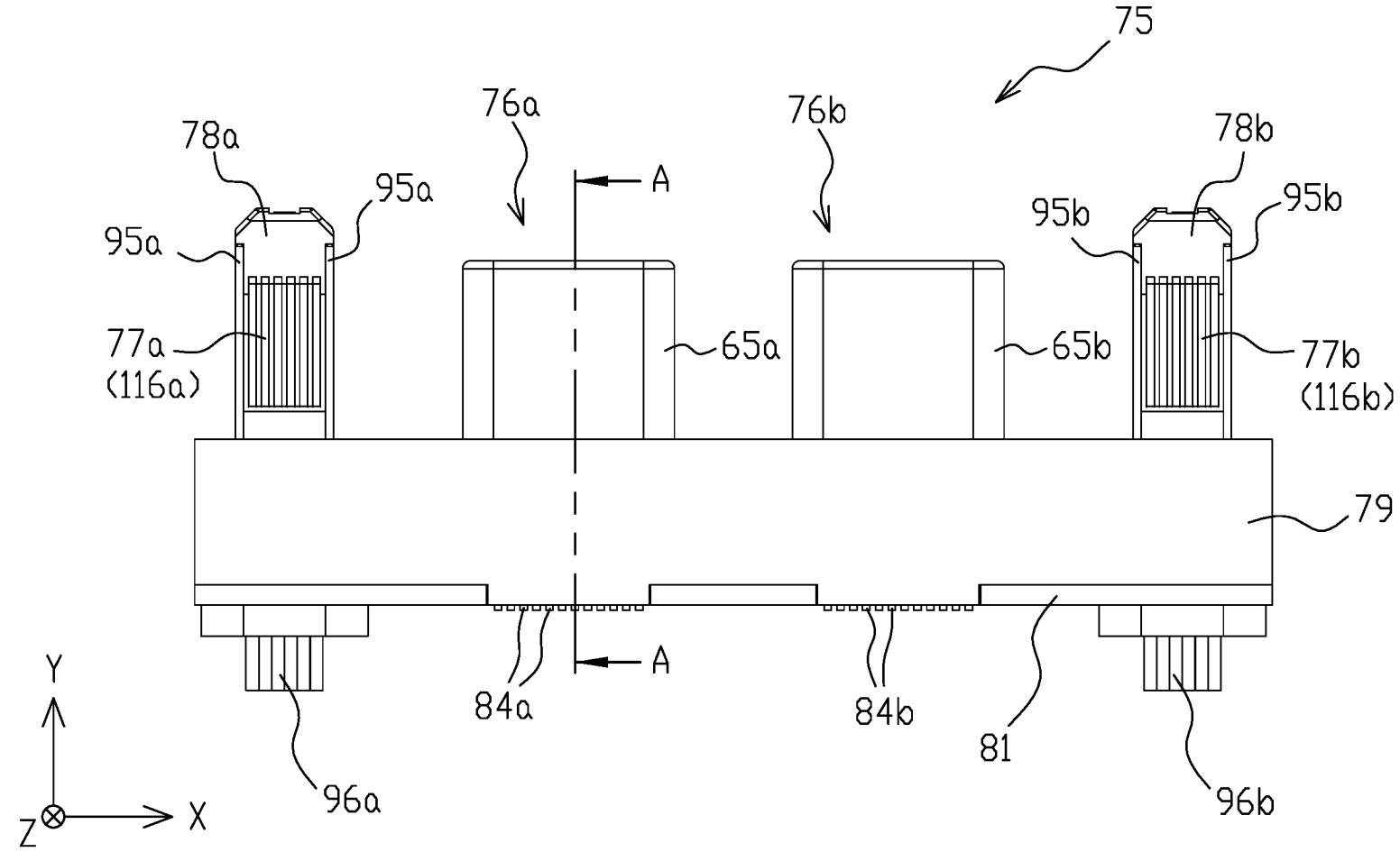
FIG. 13 is a bottom plan view showing the appearance of the plug docking connector according to the second embodiment.

Next, a docking connector according to a second embodiment of the present invention will be described with reference to the drawings. FIG. 12 is a perspective view showing an appearance of a plug docking connector as a plug unit according to the second embodiment, FIG. 13 is a bottom plan view showing the appearance of the plug docking connector according to the second embodiment. As shown in FIG. 12 and FIG. 13, a plug docking connector 75 includes a front cover 79 having two USB Type-C plug connectors (hereinafter, referred to simply as a plug connector) 76*a* and 76*b*, two additional plug connectors 77*a* and 77*b*, and two guide portions 78*a* and 78*b*, and a rear cover 81. The docking connector is a connector for connecting a portable terminal device with an external apparatus, which represents, in a broad sense, such a docking connector as incorporated into an apparatus main body, as housed in a housing or the like and as connected with an apparatus via a cable or the like, or other.

Additionally, in the following, with an XYZ orthogonal coordinate system set as shown in FIG. 12, description will be made of a positional relationship and the like of each member with reference to the orthogonal coordinate system. An X axis is set to be parallel to a direction in which the two plug connectors 76*a* and 76*b* are arranged. A Y axis is set to be parallel to a direction in which the plug docking connector 75 is docked with a receptacle docking connector 73 (see FIG. 18). A Z axis is set to be in a direction orthogonal to an YZ plane. Additionally, a side of the plug connector 76*b* is set to be a +X direction and a side of the plug connector 76*a* is set to be a −X direction, and a direction in which the plug docking connector 75 is docked with the receptacle docking connector is set to be a +Y direction and a direction in which the plug docking connector 75 is pulled out from the receptacle docking connector is set to be a −Y direction.

Figure 14:
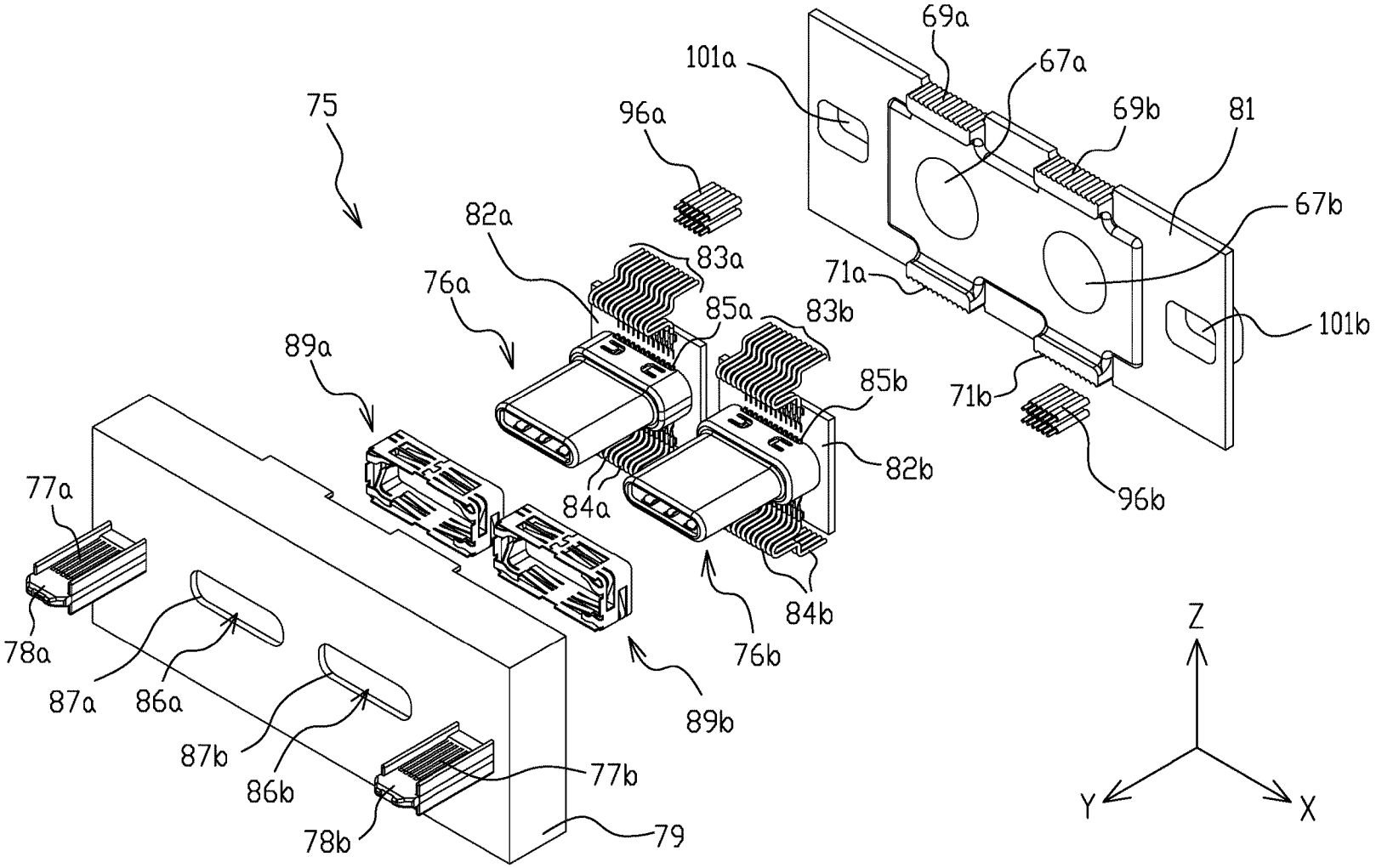
FIG. 14 is an exploded view showing a configuration of the plug docking connector according to the second embodiment.
Figure 15:
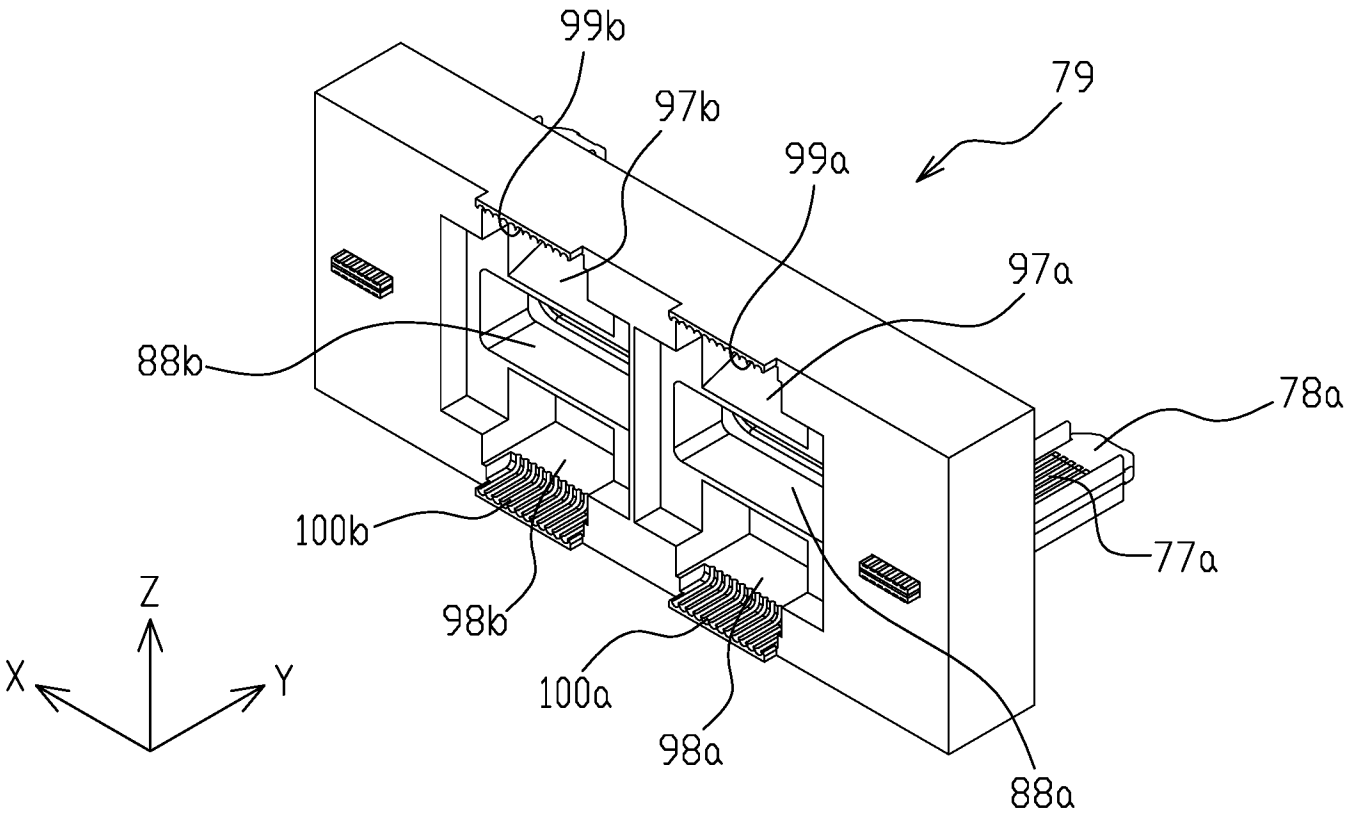
FIG. 15 is a perspective view showing an appearance of a front cover according to the second embodiment.

FIG. 14 is an exploded view showing a configuration of the plug docking connector 75, and FIG. 15 is a perspective view showing an appearance of the front cover 79 seen from the −Y direction. As shown in FIG. 12 to FIG. 15, the front cover 79 functions as a cover which covers the plug connectors 76*a* and 76*b*.

When docking with the receptacle docking connector 73 including two USB Type-C receptacle connectors (hereinafter, referred to simply as receptacle connectors) 113*a* and 113*b* (see FIG. 18), the front cover 79 includes the two guide portions 78*a* and 78*b* to be inserted into guide reception portions 102*a* and 102*b* (see FIG. 18) of the receptacle docking connector 73 before the plug connectors 76*a* and 76*b* fit in the two receptacle connectors 113*a* and 113*b* (see FIG. 18). The two guide portions 78*a* and 78*b* are formed integrally with the front cover 79, and the front cover 79 and the two guide portions 78*a* and 78*b* are formed of resin. The guide portion 78*a* is formed on the −X direction side of the plug connector 76*a*, and the guide portion 78*b* is formed on the +X direction side of the plug connector 76*b*.

The guide portion 78*a* has a member 95*a* with a high strength (metal in this embodiment) insert-molded therein. Similarly, the guide portion 78*b* has a member 95*b* with a high strength (metal in this embodiment) insert-molded therein. Insert-molding of the metals 95*a* and 95*b* in the guide portions 78*a* and 78*b* enables an increase in the guide portions 78*a* and 78*b* in strength, and enables breakage of the guide portions 78*a* and 78*b* to be prevented when the guide portions 78*a* and 78*b* are inserted into the guide reception portions 102*a* and 102*b* of the receptacle docking connector 73. The metals 95*a* and 95*b* can be incorporated into the guide portions 78*a* and 78*b* by fitting-in, embedding and the like other than by insert-molding.

Additionally, front end portions on the +Y direction side of the guide portions 78*a* and 78*b* protrude more in the +Y direction than front end portions on the +Y direction side of the plug connectors 76*a* and 76*b*. Specifically, the guide portions 78*a* and 78*b* protrude more than the plug connectors 76*a* and 76*b* to a side of an insertion direction (the +Y direction) in which the guide portions 78*a* and 78*b* are inserted into the guide reception portions 102*a* and 102*b* of the receptacle docking connector 73. Accordingly, when the plug docking connector 75 docks with the receptacle docking connector 73, the guide portions 78*a* and 78*b* are inserted into the guide reception portions 102*a* and 102*b* of the receptacle docking connector 73 before the plug connectors 76*a* and 76*b* fit in the receptacle connectors 113*a* and 113*b*.

Additionally, a width W (mm) of each of the guide portions 78*a* and 78*b* in a direction (Z direction) orthogonal to a direction in which the plug connectors 76*a* and 76*b* are aligned is equal to or more than an internal diameter width D (mm) in the Z direction of an internal diameter of each of the receptacle connectors 113*a* and 113*b*. The width W (mm) of each of the guide portions 78*a* and 78*b* preferably satisfies $D \leq W \leq (D+0.6)$ and more preferably satisfies $D \leq W \leq (D+1)$. Accordingly, when the plug docking connector 75 docks with the receptacle docking connector 73, erroneous insertion of the guide portions 78*a* and 78*b* into the receptacle connectors 113*a* and 113*b* can be prevented.

Additionally, the guide portion 78*a* has the additional plug connector 77*a* arranged therein, i.e., incorporated, and the additional plug connector 77*a* includes a plurality of contacts 116*a* as shown in FIG. 13. The contacts 116*a* each have a connection surface which connects with a connection terminal 108*a* of a contact 107*a* of an additional receptacle connector 103*a* (see FIG. 24). The connection surface is arranged on a plane substantially flush with a surface on the +Z side of the guide portion 78*a*. Additionally, the additional plug connector 77*a* also includes a plurality of contacts (not shown) on a surface on the −Z side of the guide portion 78*a*. The contacts not shown each have a connection surface which connects with the connection terminal 108*a* of the contact 107*a* of the additional receptacle connector 103*a* (see FIG. 24). The connection surface is arranged on a plane substantially flush with a surface on the −Z side of the guide portion 78*a*. The contacts 116*a* and contacts not shown of the additional plug connector 77*a* are electrically connected with cables 96*a* shown in FIG. 14.

Additionally, the guide portion 78*b* has the additional plug connector 77*b* arranged therein, i.e., incorporated, and the additional plug connector 77*b* includes a plurality of contacts 116*b* as shown in FIG. 13. The contacts 116*b* each have a connection surface which connects with a connection terminal (not shown) of a contact of an additional receptacle connector 103*b* (see FIG. 18). The connection surface is arranged on a plane substantially flush with a surface on the +Z side of the guide portion 78*b*. Additionally, the additional plug connector 77*b* also includes a plurality of contacts (not shown) on a surface on the −Z side of the guide portion 78*b*. The contacts not shown each have a connection surface which connects with a connection terminal (not shown) of a contact 107*b* of the additional receptacle connector 103*b*. The connection surface is arranged on a plane substantially flush with a surface on the −Z side of the guide portion 78*b*. The contacts 116*b* and contacts not shown of the additional plug connector 77*b* are electrically connected with cables 96*b* shown in FIG. 14.

Figure 18:
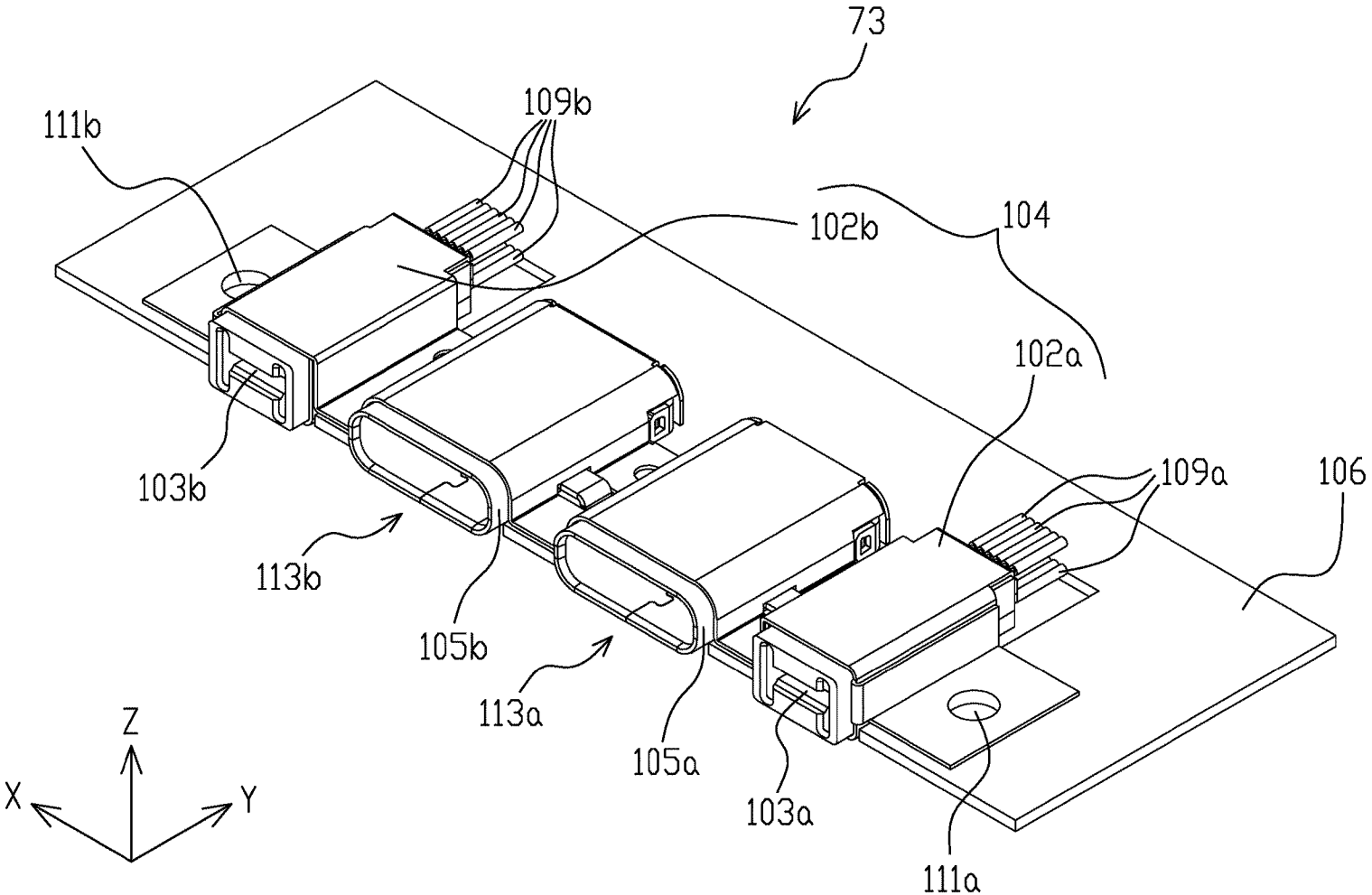
FIG. 18 is a perspective view showing an appearance of a receptacle docking connector according to the second embodiment.

Additionally, on the −X direction side between the guide portion 78*a* and the guide portion 78*b* of the front cover 79, an opening portion 86*a* is formed which covers the plug connector 76*a* and is for exposing a fit-in portion 80*a* at which the plug connector 76*a* fits in the receptacle connector 113*a* (see FIG. 18). Additionally, on the +X direction side between the guide portion 78*a* and the guide portion 78*b* of the front cover 79, an opening portion 86*b* is formed which covers the plug connector 76*b* and is for exposing a fit-in portion 80*b* at which the plug connector 76*b* fits in the receptacle connector 113*b* (see FIG. 18).

Additionally, in the front cover 79 (the rear of a surface on which the guide portions 78*a* and 78*b* are formed), as shown in FIG. 15, cable housing portions 97*a* and 98*a* are formed on the −X direction side, and cable housing portions 97*b* and 98*b* are formed on the +X direction side. The cable housing portion 97*a* is located on the +Z direction side to house a cable 83*a* (see FIG. 17). The cable housing portion 98*a* is located on the −Z direction side to house a cable 84*a* (see FIG. 17). The cable housing portion 97*b* is located on the +Z direction side to house a cable 83*b* (see FIG. 14). The cable housing portion 98*b* is located on the −Z direction side to house a cable 84*b* (see FIG. 14).

Further, in the front cover 79 (the rear of a surface on which the guide portions 78*a* and 78*b* are formed), as shown in FIG. 15, cable holding portions 99*a* and 100*a* are formed on the −X direction side, and cable holding portions 99*b* and 100*b* are formed on the +X direction side. The cable holding portion 99*a* is located on the +Z direction side and holds the cable 83*a* (see FIG. 14), together with a cable holding portion 69*a* of the rear cover 81 (see FIG. 14). The cable holding portion 100*a* is located on the −Z direction side and holds the cable 84*a* (see FIG. 14), together with a cable holding portion 71*a* of the rear cover 81 (see FIG. 14). The cable holding portion 99*b* is located on the +Z direction side and holds the cable 83*b* (see FIG. 14), together with a cable holding portion 69*b* of the rear cover 81 (see FIG. 14). The cable holding portion 100*b* is located on the −Z direction side and holds the cable 84*b* (see FIG. 14), together with a cable holding portion 71*b* of the rear cover 81 (see FIG. 14). The cable holding portions 99*a*, 99*b*, 100*a*, and 100*b* function as second holding portions which hold the cables 83*a*, 83*b*, 84*a*, and 84*b*, respectively, together with the cable holding portions 69*a*, 69*b*, 71*a*, and 71*b* of the rear cover 81 which will be described later. The second holding portion will be detailed later.

Additionally, between an outer wall portion of the plug connector 76*a*, i.e., a plug shell 65*a* which will be described later, and a wall portion 87*a* formed on the +Y direction side of the opening portion 86*a*, a predetermined space is formed such that on a surface on which the opening portion 86*a* is formed (ZX plane), the plug connector 76*a* can move relative to the front cover 79 (the rear cover 81 fixed to the front cover 79) as shown in FIG. 12. Similarly, between an outer wall portion of the plug connector 76*b*, i.e. a plug shell 65*b* which will be described later, and a wall portion 87*b* formed on the +Y direction side of the opening portion 86*b*, a predetermined space is formed such that on a surface on which the opening portion 86*b* is formed (ZX plane), the plug connector 76*b* can move relative to the front cover 79 (the rear cover 81 fixed to the front cover 79).

Figure 16:
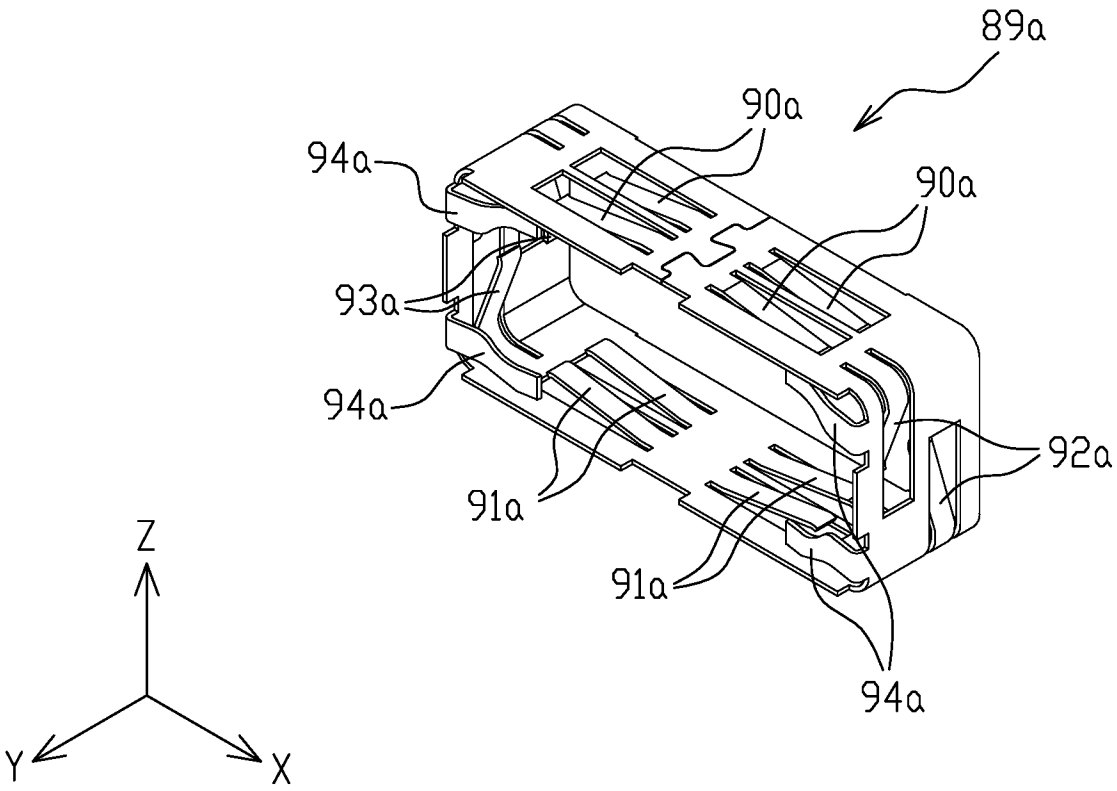
FIG. 16 is a view showing a configuration of a control portion according to the second embodiment.

Between the outer wall portion of the plug connector 76*a* and the front cover 79 (a wall portion 88*a* formed on the −Y direction side of the opening portion 86*a*), a control portion 89*a* is provided. FIG. 16 is a view showing a configuration of the control portion 89*a*. The control portion 89*a* is formed of a conductive member, e.g., metal, and on the +Z direction side of the control portion 89*a*, as shown in FIG. 16, four Z side elastic portions 90*a* are formed. Additionally, on the −Z direction side of the control portion 89*a*, four Z side elastic portions 91*a* are formed. The control portion 89*a* is incorporated into the opening portion 86*a*, and the Z side elastic portion 90*a* pushes the outer wall portion on the +Z direction side of the plug connector 76*a* toward the −Z direction by an elastic force. The outer wall portion on the +Z direction side of the plug connector 76*a* receives the elastic force of the Z side elastic portion 90*a*. The Z side elastic portion 91*a* pushes the outer wall portion on the −Z direction side of the plug connector 76*a* toward the +Z direction by an elastic force. The outer wall portion on the −Z side of the plug connector 76*a* receives an elastic force of the Z side elastic portion 91*a*.

The control portion 89*a* controls a position of the plug connector 76*a* in the Z direction relative to the opening portion 86*a* by using elastic forces of the Z side elastic portions 90*a* and 91*a*. For example, when a force in the −Z direction is applied to the plug connector 76*a*, the Z side elastic portion 90*a* extends in the −Z direction and the Z side elastic portion 91*a* contracts in the −Z direction. Accordingly, the plug connector 76*a* moves in the −Z direction within a predetermined space formed between the outer wall portion of the plug connector 76*a* and the wall portion 88*a*. When a force in the +Z direction is applied to the plug connector 76*a*, the Z side elastic portion 90*a* contracts in the +Z direction, and the Z side elastic portion 91*a* extends in the +Z direction. Accordingly, the plug connector 76*a* moves in the +Z direction within the predetermined space formed between the outer wall portion of the plug connector 76*a* and the wall portion 88*a*.

Additionally, on the +X direction side of the control portion 89*a*, as shown in FIG. 16, two X side elastic portions 92*a* are formed. Additionally, on the −X direction side of the control portion 89*a*, two X side elastic portions 93*a* are formed. The X side elastic portion 92*a* pushes the outer wall portion on the +X direction side of the plug connector 76*a* toward the −X direction by an elastic force. The outer wall portion on the +X direction side of the plug connector 76*a* receives the elastic force of the X side elastic portion 92*a*. The X side elastic portion 93*a* pushes the outer wall portion on the −X direction side of the plug connector 76*a* toward the +X direction by an elastic force. The outer wall portion on the −X direction side of the plug connector 76*a* receives the elastic force of the X side elastic portion 93*a*.

The control portion 89*a* controls a position of the plug connector 76*a* in the X direction relative to the opening portion 86*a* by using elastic forces of the X side elastic portions 92*a* and 93*a*. For example, when a force in the −X direction is applied to the plug connector 76*a*, the X side elastic portion 92*a* extends in the −X direction, and the X side elastic portion 93*a* contracts in the −X direction. Accordingly, the plug connector 76*a* moves in the −X direction within the predetermined space formed between the outer wall portion of the plug connector 76*a* and the wall portion 88*a*. When a force in the +X direction is applied to the plug connector 76*a*, the X side elastic portion 92*a* contracts in the +X direction, and the X side elastic portion 93*a* extends in the +X direction. Accordingly, the plug connector 76*a* moves in the +X direction within the predetermined space formed between the outer wall portion of the plug connector 76*a* and the wall portion 88*a*.

Additionally, on the +Y direction side of the control portion 89*a*, as shown in FIG. 16, four Y side elastic portions 94*a* are formed. The control portion 89*a* controls a posture of the plug connector 76*a* relative to the opening portion 86*a* by using the Y side elastic portion 94*a* and a convex portion 67*a* formed in the rear cover 81 (see FIG. 14). Posture control of the control portion 89*a* will be detailed later.

Additionally, between the outer wall portion of the plug connector 76*b* and the front cover 79 (a wall portion 88*b* formed on the −Y direction side of the opening portion 86*b*), a control portion 89*b* is provided. The control portion 89*b* is formed of a conductive member, e.g., metal, and is incorporated in the opening portion 86*b*. On the +Z direction side of the control portion 89*b*, four Z side elastic portions are formed which have the same function and effect as those of the Z side elastic portion 90*a* of the control portion 89*a*. Additionally, on the −Z direction side of the control portion 89*b*, four Z side elastic portions are formed which have the same function and effect as those of the Z side elastic portion 91*a* of the control portion 89*a*.

Additionally, on the +X direction side of the control portion 89*b*, two X side elastic portions are formed which have the same function and effect as those of the X side elastic portion 92*a* of the control portion 89*a*. Additionally, on the −X direction side of the control portion 89*b*, two X side elastic portions are formed which have the same function and effect as those of the X side elastic portion 93*a* of the control portion 89*a*. Additionally, on the +Y direction side of the control portion 89*b*, four Y side elastic portions are formed which have the same function and effect as those of the Y side elastic portion 94*a* of the control portion 89*a*. Since position control and posture control of the plug connector 76*b* of the control portion 89*b* are the same as the position control and the posture control of the plug connector 76*a* in the control portion 89*a*, no description will be made thereof.

Figure 17:
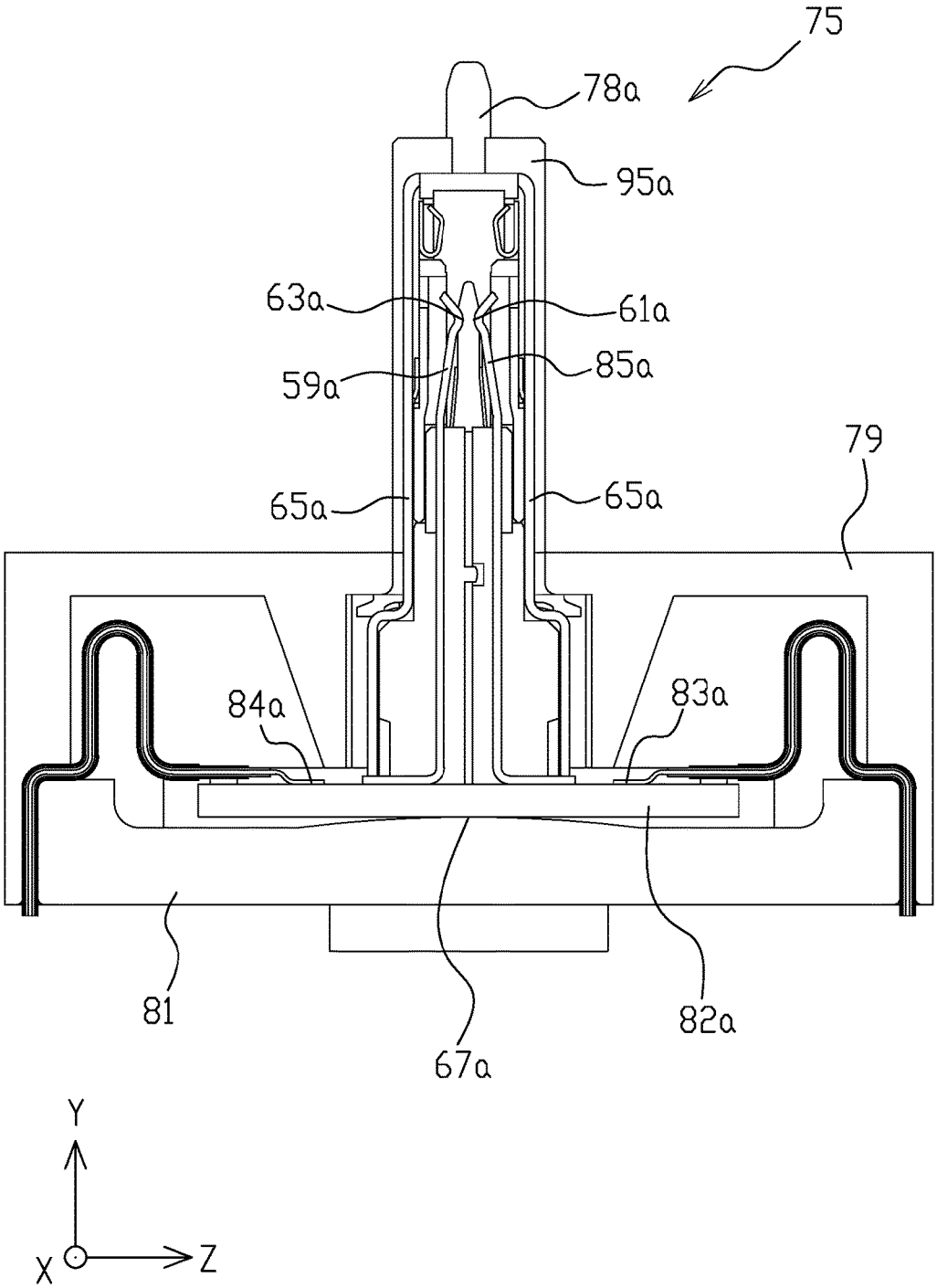
FIG. 17 is a sectional view showing a configuration of the plug docking connector according to the second embodiment.

Next, a configuration of the plug connector 76*a* will be described. FIG. 17 is a sectional view taken along A-A in FIG. 13. The plug connector 76*a* is mounted on a circuit board 82*a* as shown in FIG. 14 and FIG. 17. As shown in FIG. 17, the plug connector 76*a* includes a plurality of contacts 85*a* and a plurality of contacts 59*a* which connect with a plurality of contacts (not shown) of the receptacle connectors 113*a* and 113*b* (see FIG. 18), and the plug shell 65*a* covering the plurality of contacts 85*a* and 59*a*. Each of the plurality of contacts 85*a* is arranged on the +Z direction side of the plug connector 76*a*, and an end portion on the −Y direction side of the contact 85*a* is fixed to the circuit board 82*a* by soldering or the like. Additionally, each of the plurality of contacts 85*a* includes a contact portion 61*a* at an end portion thereof on the +Y direction side, the contact portion 61*a* for coming into contact with the contacts (not shown) of the receptacle connectors 113*a* and 113*b* (see FIG. 18). Each of the plurality of contacts 59*a* is arranged on the −Z direction side of the plug connector 76*a*, and an end portion on the −Y direction side of the contact 59*a* is fixed to the circuit board 82*a* by soldering or the like. Additionally, each of the plurality of contacts 59*a* includes a contact portion 63*a* at an end portion thereof on the +Y direction side, the contact portion 63*a* for coming into contact with the contacts (not shown) of the receptacle connectors 113*a* and 113*b*.

Additionally, on the +Z direction side of the circuit board 82*a*, one end of each of the plurality of cables 83*a* is fixed by soldering or the like. Each of the plurality of cables 83*a* is electrically connected with each of the plurality of contacts 85*a* arranged on the +Z direction side of the plug connector 76*a* via the circuit board 82*a*. Additionally, to the −Z direction side of the circuit board 82*a*, one end of each of the plurality of cables 84*a* is fixed by soldering or the like. Each of the plurality of cables 84*a* is electrically connected with each of the plurality of contacts 59*a* arranged on the −Z direction side of the plug connector 76*a* via the circuit board 82*a*.

Next, a configuration of the plug connector 76*b* will be described. The plug connector 76*b* is mounted on a circuit board 82*b* as shown in FIG. 14. Additionally, the plug connector 76*b* includes a plurality of contacts not shown and the plug shell 65*b* (see FIG. 12). Configurations of these contacts and the shell are line-symmetrically the same as those of the plurality of contacts 85*a* and 59*a* and the plug shell 65*a*, i.e., with respect to a center line in the Y axis direction of the plug docking connector 75. Additionally, on the +Z direction side of the circuit board 82*b*, one end of each of the plurality of cables 83*b* is fixed by soldering or the like. Each of the plurality of cables 83*b* is electrically connected with each of a plurality of contacts 85*b* arranged on the +Z direction side of the plug connector 76*b*. Additionally, on the −Z direction side of the circuit board 82*b*, one end of the plurality of cables 84*b* is fixed by soldering or the like. Each of the plurality of cables 84*b* is electrically connected with each of a plurality of contacts (not shown) arranged on the −Z direction side of the plug connector 76*b*.

Here, the circuit boards 82*a* and 82*b* on which the plug connectors 76*a* and 76*b* are mounted function as first holding portions which hold one ends of the plurality of cables 83*a*, 84*a*, 83*b* and 84*b*, respectively, because one ends of the plurality of cables 83*a*, 84*a*, 83*b* and 84*b* are fixed to the circuit boards 82*a* and 82*b*, respectively. The first holding portion will be detailed later.

Next, a configuration of the rear cover 81 will be described. As shown in FIG. 12, the rear cover 81 is attached and fixed to the front cover 79 to support the plug connectors 76*a* and 76*b* from the −Y direction side. As shown in FIG. 14, on the −X direction side of the rear cover 81, an opening portion 101*a* is formed for leading the cable 96*a* from a space formed between the front cover 79 and the rear cover 81 to the outside. The cable 96*a* is fixed in the opening portion 101*a* by an adhesive not shown or the like. Additionally, on the +X direction side of the rear cover 81, an opening portion 101*b* is formed for leading the cable 96*b* from the space formed between the front cover 79 and the rear cover 81 to the outside. The cable 96*b* is fixed in the opening portion 101*b* by an adhesive not shown or the like.

Additionally, on a surface on the +Y direction side of the rear cover 81, the convex portion 67*a* as a part of the configuration of the control portion 89*a*, and a convex portion 67*b* as a part of the configuration of the control portion 89*b* are formed. The two convex portions 67*a* and 67*b* each have a convex surface on the +Y direction side, and the convex portion 67*a* is arranged on the +X direction side of the rear cover 81 to support the plug connector 76*a* in the +Y direction. The convex portion 67*b* is arranged on the −X direction side of the rear cover 81 to support the plug connector 76*b* in the +Y direction.

Using the Y side elastic portion 94*a* (see FIG. 16) and the convex portion 67*a* (see FIG. 14), the control portion 89*a* controls a posture of the plug connector 76*a* relative to the opening portion 86*a*, i.e. an inclination relative to the Y axis direction. For example, applying, to the plug connector 76*a*, a force in a direction slanting relative to the Y axis direction changes a direction in which the convex portion 67*a* supports the plug connector 76*a* and an elastic force of the Y side elastic portion 94*a*. Then, the posture of the plug connector 76*a* changes to a direction in which a force is applied in a predetermined space formed between the plug shell 65*a* and the wall portion 87*a*. Specifically, the plug connector 76*a* slants relative to a surface on which the opening portion 86*a* is formed. The Y side elastic portion 94*a* arranged on the side to which the plug connector 76*a* slants functions as a correction portion which uses an elastic force thereof to push the plug connector 76*a*, thereby correcting an inclination of the plug connector 76*a*. When the force applied to the plug connector 76*a* is released, by the elastic force of the Y side elastic portion 94*a*, the plug connector 76*a* returns to a posture as of before the force is applied to the plug connector 76*a*.

Additionally, in the rear cover 81, on a side portion on the +Z direction side, the cable holding portions 69*a* and 69*b* are formed, and on a side portion on the −Z direction side, the cable holding portions 71*a* and 71*b* are formed as shown in FIG. 14. The cable holding portion 69*a* is located on the −X direction side to support the cable 83*a* together with the cable holding portion 99*a* of the front cover 79 (see FIG. 15). The cable holding portion 69*b* is located on the +X direction side to support the cable 83*b* together with the cable holding portion 99*b* of the front cover 79 (see FIG. 15). The cable holding portion 71*a* is located on the −X direction side to hold the cable 84*a* together with the cable holding portion 100*a* of the front cover 79 (see FIG. 15). The cable holding portion 71*b* is located on the +X direction side to hold the cable 84*b* together with the cable holding portion 100*b* (see FIG. 15). The cable holding portions 69*a*, 69*b*, 71*a*, and 71*b* function as the second holding portions which hold the cables 83*a*, 83*b*, 84*a*, and 84*b*, together with the cable holding portions 99*a*, 99*b*, 100*a*, and 100*b* of the front cover 79 respectively.

In the second embodiment, the cable 83*a*, 83*b*, 84*a* and 84*b* (see FIG. 14) have a flexible portion which follows movement of the plug connector 76*a*, the flexible portion being housed in the cable housing portion 97*a*, 97*b*, 98*a* and 98*b* (see FIG. 15) between the circuit boards 82*a* and 82*b* (see FIG. 14) as the first holding portions and the cable holding portions 99*a*, 99*b*, 100*a* and 100*b* (see FIG. 15) and the cable holding portions 69*a*, 69*b*, 71*a* and 71*b* (see FIG. 14) as the second holding portions. The circuit board 82*a* and 82*b* are fixed to the plug connector 76*a* and 76*b* and function as the first holding portions which hold one ends of the cable 83*a*, 83*b*, 84*a* and 84*b* as flexible portions. The cable holding portions 99*a*, 99*b*, 100*a* and 100*b* of the front cover 79 and the cable holding portions 69*a*, 69*b*, 71*a* and 71*b* of the rear cover 81 are provided at the front cover 79 and the rear cover 81 as the covers, respectively, and function as the second holding portions which hold the other ends of the cables 83*a*, 83*b*, 84*a* and 84*b* as the flexible portions.

Provision of the flexible portion, the first holding portion and the second holding portion allows the plug connector 76*a* to move relative to the front cover 79 and the rear cover 81 without being restricted by other member. The flexible portion need not necessarily to be the cable 83*a* and can be the contact 85*a* of the plug connector 76*a*, for example. Additionally, the first holding portion need not to be the circuit board 82*a* and can be the plug connector 76*a*, for example.

Figure 19:
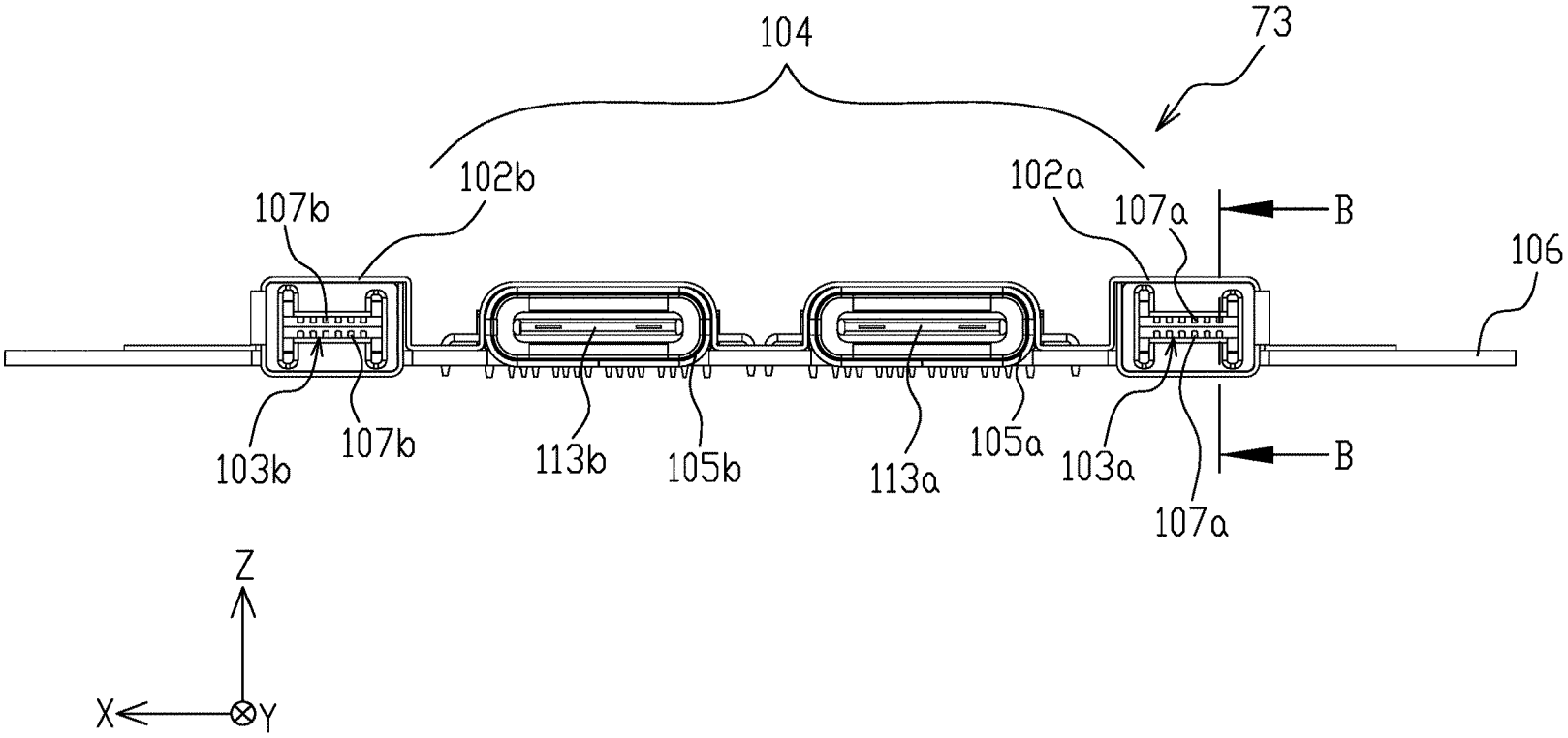
FIG. 19 is a front view showing the appearance of the receptacle docking connector according to the second embodiment.
Figure 20:
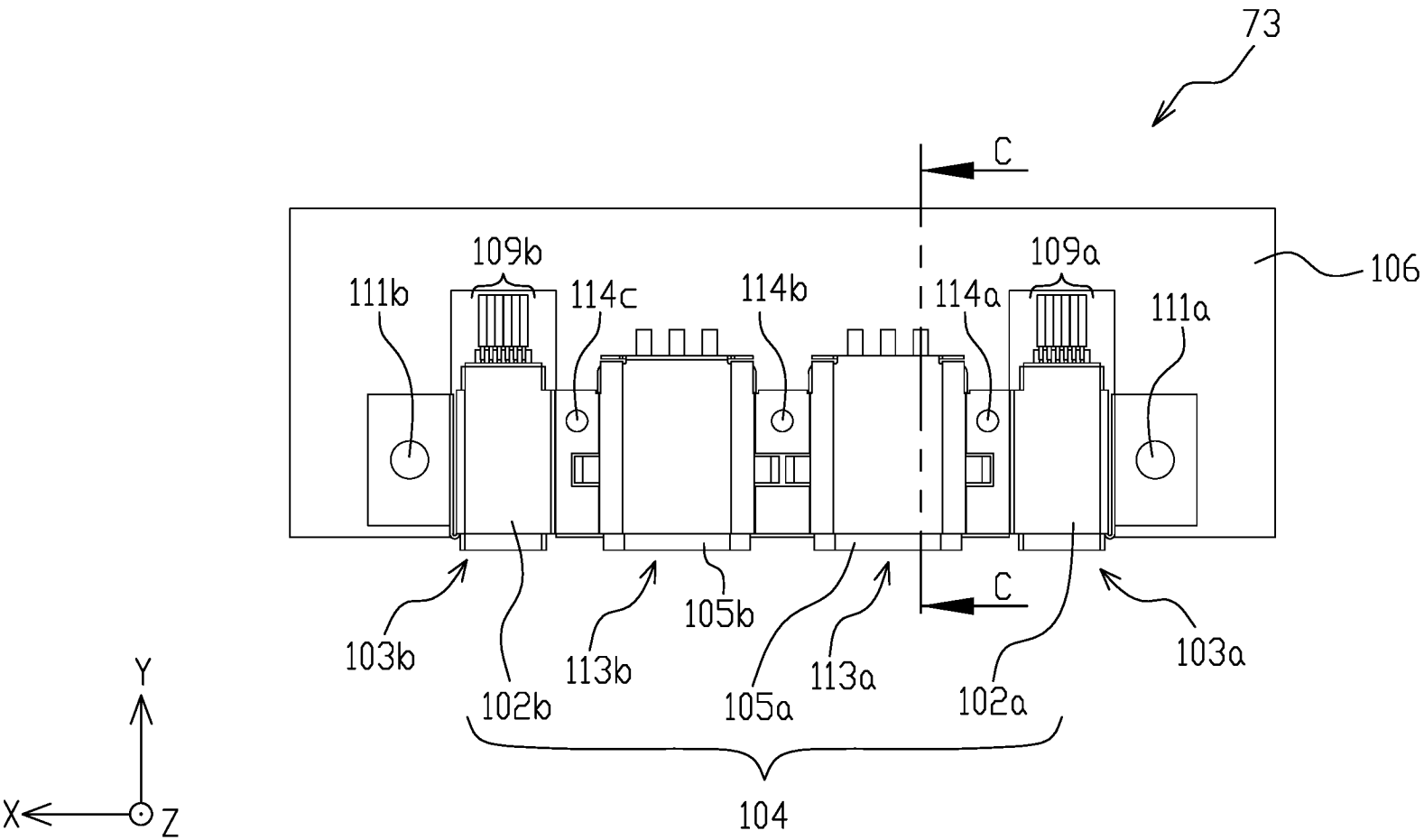
FIG. 20 is a plan view showing the appearance of the receptacle docking connector according to the second embodiment.
Figure 21:
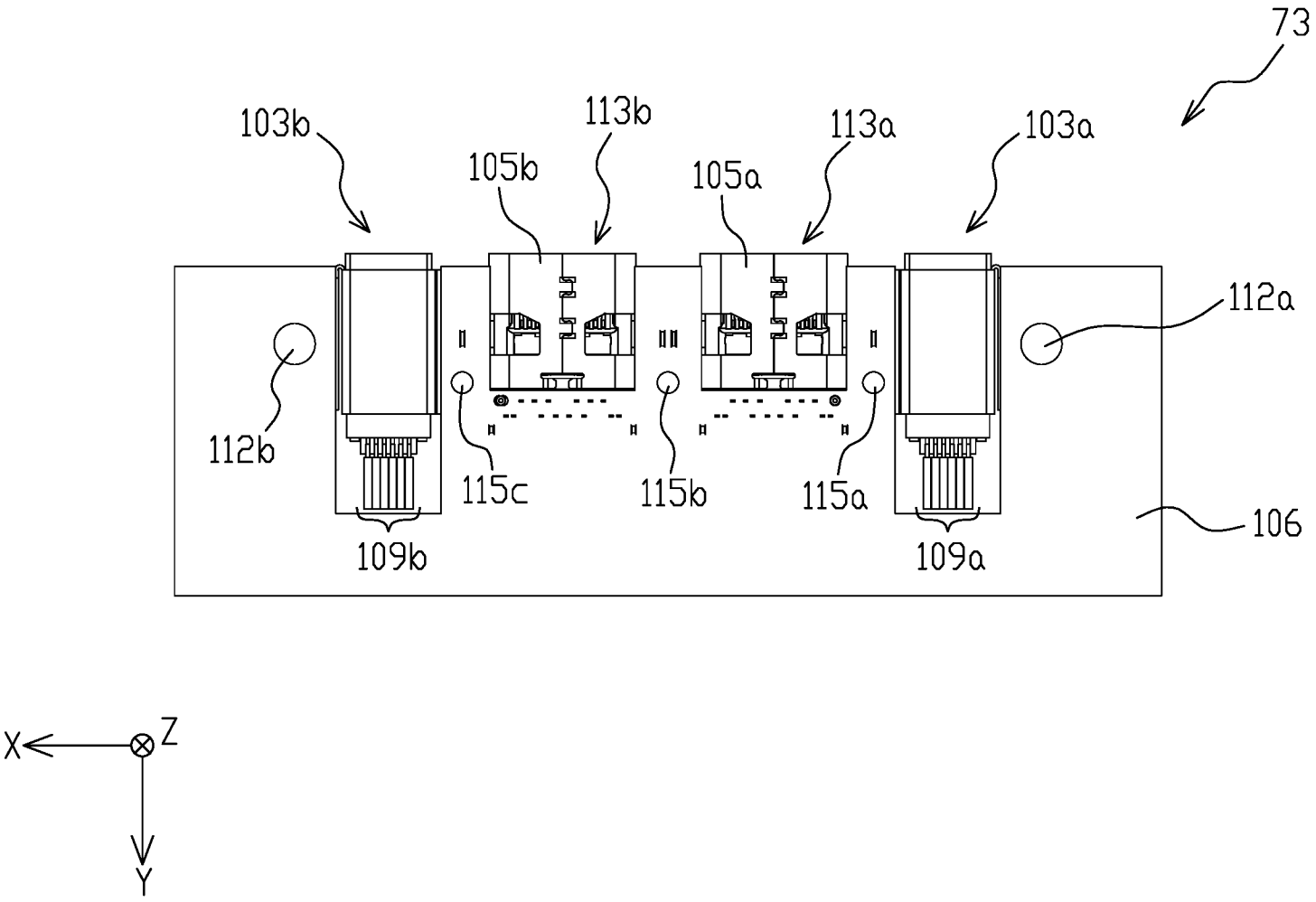
FIG. 21 is a bottom plan view showing the appearance of the receptacle docking connector according to the second embodiment.

Next, description will be made of a docking connector on a receptacle side (hereinafter, referred to as a receptacle docking connector) as a receptacle unit according to the second embodiment of the present invention with reference to the drawings. FIG. 18 is a perspective view showing an appearance of a receptacle docking connector according to the second embodiment, FIG. 19 is a front view showing the appearance of the receptacle docking connector according to the second embodiment, FIG. 20 is a plan view showing the appearance of the receptacle docking connector according to the second embodiment, and FIG. 21 is a bottom plan view showing the appearance of the receptacle docking connector according to the second embodiment. The receptacle docking connector 73 is mounted on a portable terminal device (electronic apparatus) such as a tablet type PC or the like, and as shown in FIG. 18, includes a guide shell 104 having the two receptacle connectors 113*a* and 113*b*, the two additional receptacle connectors 103*a* and 103*b*, and the two guide reception portions 102*a* and 102*b*.

Figure 22:
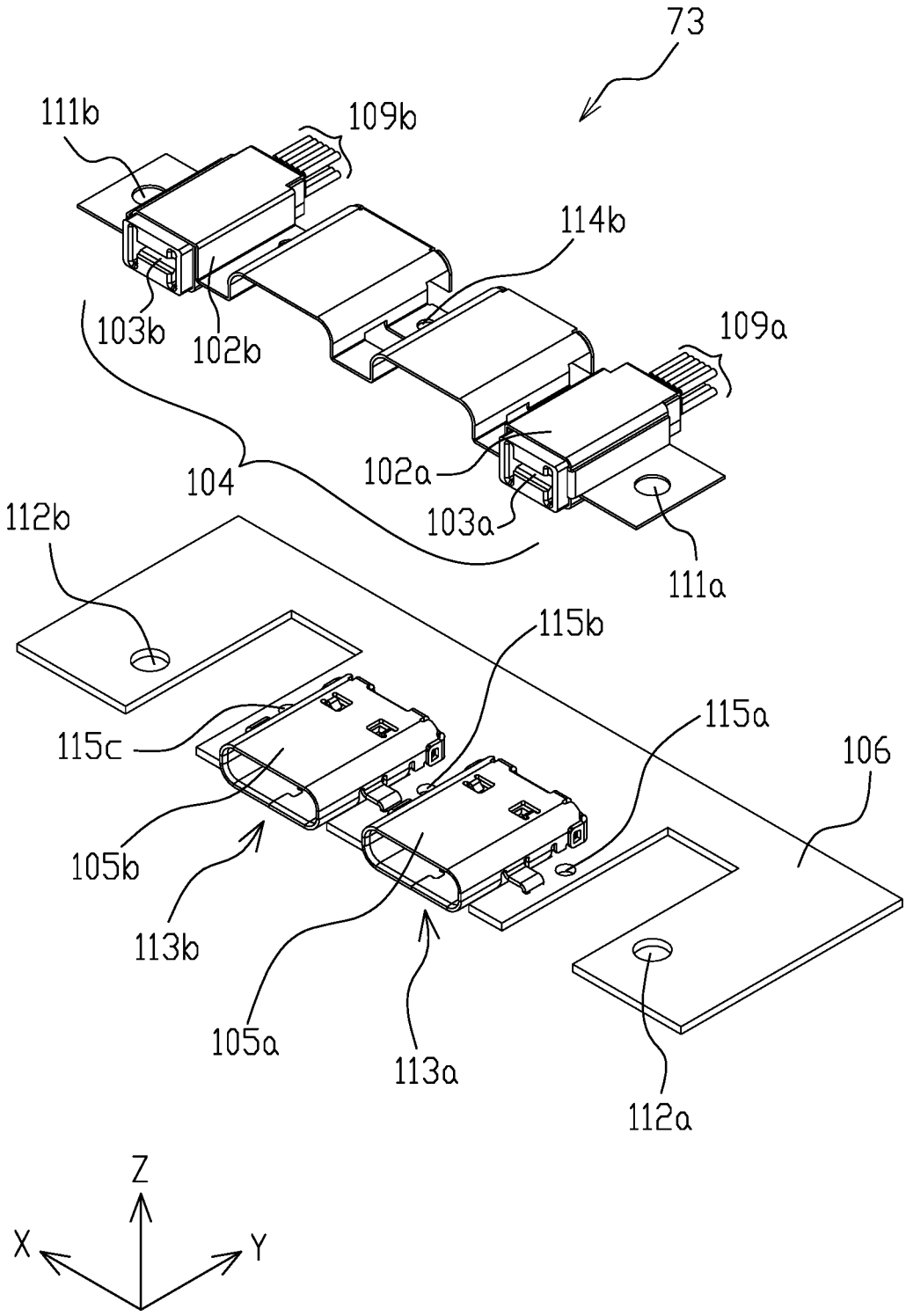
FIG. 22 is an exploded view showing a configuration of the receptacle docking connector according to the second embodiment.
Figure 23:
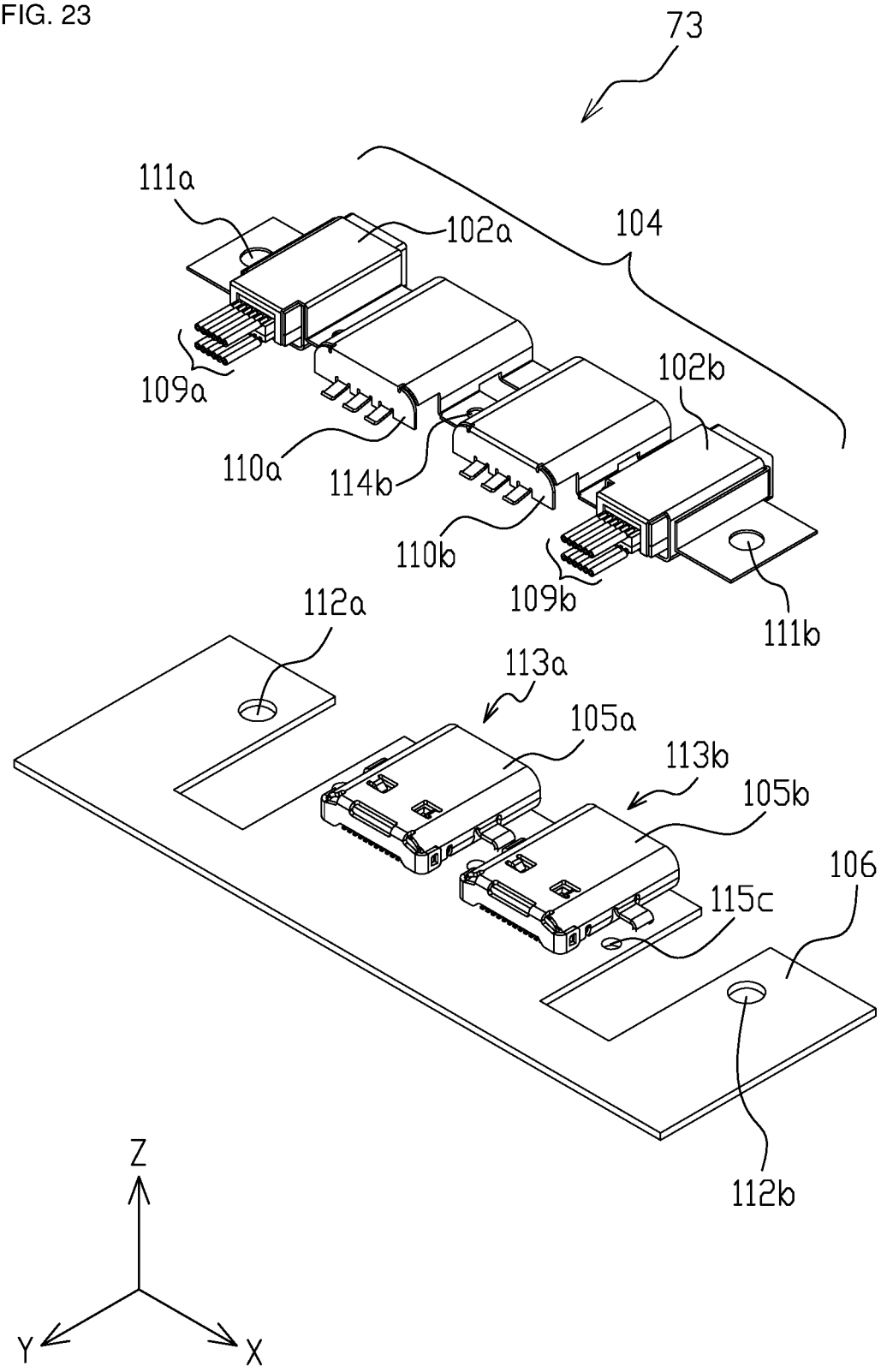
FIG. 23 is an exploded view showing the configuration of the receptacle docking connector according to the second embodiment.

FIG. 22 and FIG. 23 are exploded views for explaining a configuration of the receptacle docking connector 73, FIG. 22 as a perspective view seen from the front side and FIG. 23 as a perspective view seen from the back side. The receptacle connector 113*a* includes a receptacle shell 105*a* which engages with the plug connector 76*a* (see FIG. 12) and as shown in FIG. 19, covers a contact and the like (not shown) provided in the receptacle connector 113*a*. The receptacle connector 113*b* includes a receptacle shell 105*b* which engages with the plug connector 76*b* (see FIG. 12) and as shown in FIG. 19, covers a contact and the like (not shown) provided in the receptacle connector 113*b*.

The receptacle connectors 113*a* and 113*b* are mounted on a mounting surface (a surface on the +Z direction side) of a board 106 such that an engagement direction (Y direction) as a direction of engagement with the plug connectors 76*a* and 76*b* and the mounting surface are parallel to each other. Additionally, the receptacle connectors 113*a* and 113*b* are mounted on the board 106 individually. Specifically, the receptacle connector 113*a* is mounted on the board 106 independently of the receptacle connector 113*b*. Although in the second embodiment, the two receptacle connectors 113*a* and 113*b* are provided, three or more receptacle connectors can be provided. Additionally, when three or more receptacle connectors are provided, at least one receptacle connector of the three or more receptacle connectors is mounted on the board 106 independently of at least one other receptacle connector. For example, when three receptacle connectors are provided, each receptacle connector is individually mounted on the board 106, or two receptacle connectors are integrally mounted on the board 106 and one receptacle connector is mounted on the board 106 independently of the other two receptacle connectors.

Figure 24:
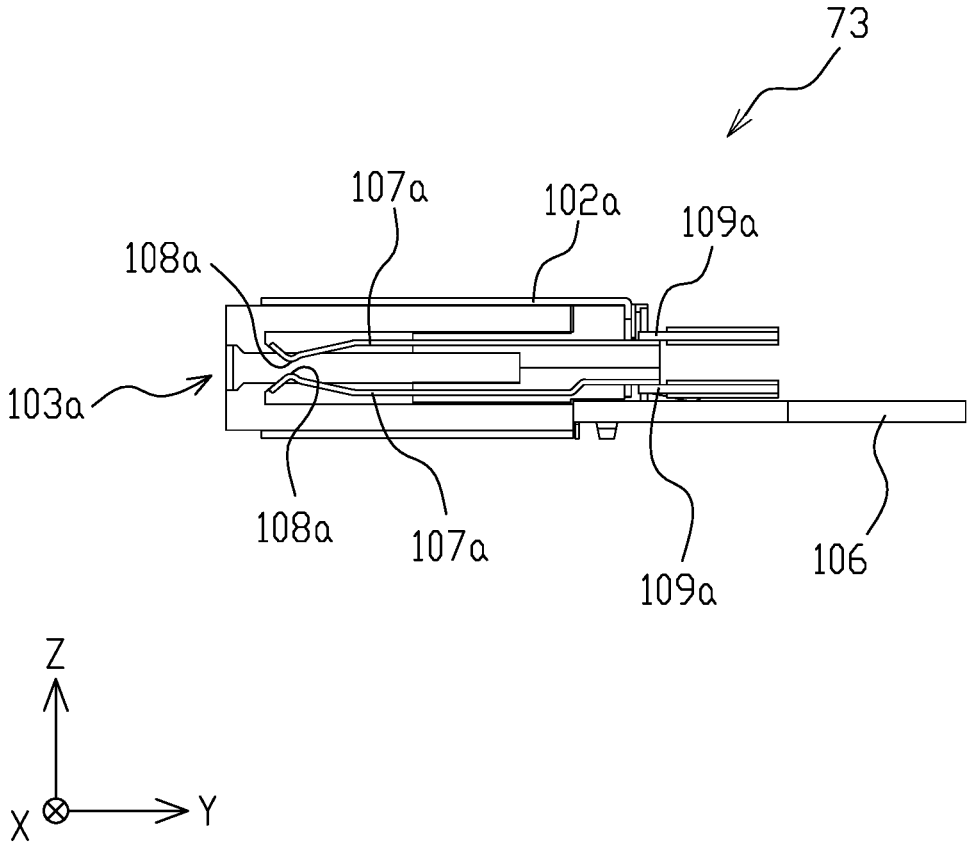
FIG. 24 is a sectional view showing the configuration of the receptacle docking connector according to the second embodiment.

The additional receptacle connector 103*a* is located on the −X direction side of the receptacle docking connector 73 and is arranged within the guide reception portion 102*a* as shown in FIG. 18. FIG. 24 is a sectional view taken along B-B in FIG. 19. The additional receptacle connector 103*a* includes a plurality (12 in the second embodiment) of contacts 107*a* as shown in FIG. 19 and FIG. 24. At one end portion of the contact 107*a*, the connection terminal 108*a* as an elastic body is formed which connects with the contact 116*a* and a contact not shown of the additional plug connector 77*a*, as shown in FIG. 24. The other end portion of the contact 107*a* is electrically connected with a wire 109*a* as shown in FIG. 24.

The additional receptacle connector 103*b* is located on the +X direction side of the receptacle docking connector 73 and is arranged within the guide reception portion 102*b* as shown in FIG. 18. The additional receptacle connector 103*b* includes a plurality (12 in the second embodiment) of contacts 107*b*. At one end portion of the contact 107*b*, a connection terminal (not shown) as an elastic body is formed which connects with the contact 116*b* and a contact not shown of the additional plug connector 77*b* similarly to the contact 107*a* of the additional receptacle connector 103*a*. The other end portion of the contact 107*b* is electrically connected with a wire 109*b*.

In the above second embodiment, description has been made of a case where the plug connector 76*a* is engaged with the receptacle connector 113*a* and the plug connector 76*b* is engaged with the receptacle connector 113*b*. In this case, the additional receptacle connector 103*a* engages with the additional plug connector 77*a*, and the additional receptacle connector 103*b* engages with the additional plug connector 77*b*. However, the plug docking connector 75 and the receptacle docking connector 73 according to the second embodiment are reversible connectors, and also the receptacle connector 113*a* can be engaged with the plug connector 76*b* and the receptacle connector 113*b* can be engaged with the plug connector 76*a*. In this case, the additional receptacle connector 103*a* and the additional plug connector 77*b* engage with each other and the additional receptacle connector 103*b* engages with the additional plug connector 77*a*.

Next, a configuration of the guide shell 104 will be described. The guide shell 104 is formed of metal or the like and includes the guide reception portion 102*a* and the additional receptacle connector 103*a* arranged in the −X direction side, and the guide reception portion 102*b* and the additional receptacle connector 103*b* arranged in the +X direction side. Specifically, the guide reception portions 102*a* and 102*b* integrally formed. As shown in FIG. 18, the guide shell 104 covers outer circumferences on the +Z direction side of the receptacle connectors 113*a* and 113*b*.

Additionally, as shown in FIG. 23, the guide shell 104 includes supporting portions 110*a* and 110*b* which support the receptacle connectors 113*a* and 113*b* in the insertion direction (the +Y direction) in which the guide portions 78*a* and 78*b* (see FIG. 12) are inserted into the guide reception portions 102*a* and 102*b*. As shown in FIG. 23, the guide shell 104 (the supporting portions 110*a* and 110*b*) covers the outer circumferences on the +Y direction side of the receptacle connectors 113*a* and 113*b*. The supporting portions 110*a* and 110*b* receive a force applied to the +Y direction when the guide portions 78*a* and 78*b* are inserted into the guide reception portions 102*a* and 102*b*. Additionally, the supporting portions 110*a* and 110*b* prevent coming-off of the receptacle connectors 113*a* and 113*b* from the board 106.

Additionally, the guide shell 104 is provided with a hole 111*a* for allowing a screw to pass to the −X direction side in the vicinity of the additional receptacle connector 103*a*, and a hole 111*b* for allowing a screw to pass to the +X direction side in the vicinity of the additional receptacle connector 103*b*. Additionally, the guide shell 104 is provided with a hole 114*a* for allowing a screw to be inserted between the additional receptacle connector 103*a* and the receptacle connector 113*a*, a hole 114*b* for allowing a screw to be inserted between the receptacle connector 113*a* and the receptacle connector 113*b*, and a hole 114*c* for allowing a screw to be inserted between the receptacle connector 113*b* and the additional receptacle connector 103*b*. The holes 111*a*, 111*b*, and 114*a* to 114*c* function as fixing portions for fixing the guide shell 104 to a casing of a portable terminal device. The guide shell 104 and the board 106 are screwed to the casing (not shown) of the portable terminal device by inserting a screw into the hole 111*a* and a hole 112*a* formed in the board 106, inserting a screw into the hole 111*b* and a hole 112*b* formed in the board 106, inserting a screw into the hole 114*a* and a hole 115*a* formed in the board 106, inserting a screw into the hole 114*b* and a hole 115*b* formed in the board 106, and inserting a screw into the hole 114*c* and a hole 115*c* formed in the board 106. Specifically, the guide shell 104 is fixed to the casing together with the board 106 after the receptacle connectors 113*a* and 113*b* are mounted on the board 106. At this time, the guide shell 104 is attached to the casing of the portable terminal device from a position (the +Z direction side) opposed to the mounting surface (the surface on the +Z direction side) of the board 106.

Figure 25:
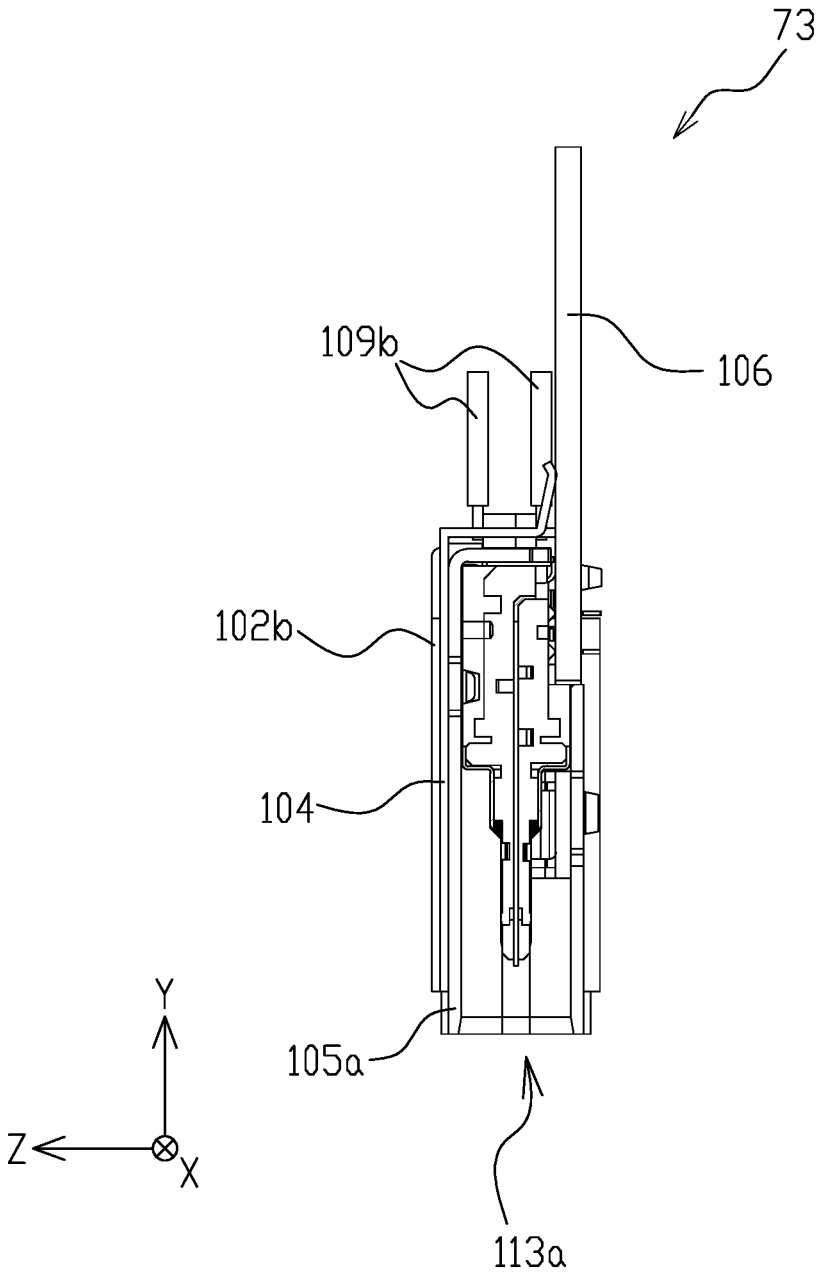
FIG. 25 is a sectional view showing the configuration of the receptacle docking connector according to the second embodiment.

FIG. 25 is a sectional view taken along C-C in FIG. 20. The guide shell 104 and the receptacle shell 105*a* of the receptacle connector 113*a* electrically conduct with each other as shown in FIG. 25. Similarly, the guide shell 104 and the receptacle shell 105*b* of the receptacle connector 113*b* electrically conduct with each other.

With the plug docking connector 75 according to the second embodiment provided with the guide portions 78*a* and 78*b*, the guide portions 78*a* and 78*b* are inserted into the guide reception portions 102*a* and 102*b* of the receptacle docking connector 73 before the plug connectors 76*a* and 76*b* engage with the receptacle connectors 113*a* and 113*b*. Accordingly, the plug connectors 76*a* and 76*b* can be securely engaged with the receptacle connectors 113*a* and 113*b* without damages.

Additionally, with the plug docking connector 75 according to the second embodiment provided with the control portions 89*a* and 89*b*, the plug connectors 76*a* and 76*b* are connected with the cables 83*a*, 83*b*, 84*a*, and 84*b* (flexible portions) via the circuit boards 82*a* and 82*b*, and the flexible portion is held by the first holding portion and the second holding portion. Accordingly, the positions and the postures of the plug connectors 76*a* and 76*b* can be controlled. Specifically, since the plug connectors 76*a* and 76*b* are configured to be movable within a predetermined space, a tolerance can be minimized and the plug connectors 76*a* and 76*b* can be securely engaged with the receptacle connectors 113*a* and 113*b* without damages. Additionally, when not engaged with the receptacle connectors 113*a* and 113*b*, the plug connectors 76*a* and 76*b* can be maintained at a predetermined position and in a predetermined posture by position control and posture control by the control portions 89*a* and 89*b*. Specifically, deviation in a position and a posture of the plug connectors 76*a* and 76*b* at the time of mounting can be securely absorbed.

Additionally, with the receptacle docking connector 73 according to the second embodiment provided with the guide reception portions 102*a* and 102*b*, the guide portions 78*a* and 78*b* are inserted into the guide reception portions 102*a* and 102*b* before the plug connectors 76*a* and 76*b* engage with the receptacle connectors 113*a* and 113*b*. Accordingly, the plug connectors 76*a* and 76*b* can be securely engaged with the receptacle connectors 113*a* and 113*b* without damages.

Additionally, with the receptacle docking connector 73 according to the second embodiment, the receptacle connectors 113*a* and 113*b* are individually mounted on the board 106 and thereafter, at the time of attaching the board 106 to the casing of the portable terminal device, the guide shell 104 is attached together with the board 106. Accordingly, flatness (coplanarity) of the receptacle docking connector 73 with respect to the mounting surface of the board 106 can be excellently maintained to prevent a soldering failure due to poor flatness.

Additionally, with the receptacle docking connector 73 according to the second embodiment, the guide shell 104 covers the receptacle connectors 113*a* and 113*b*, and the guide shell 104 and the receptacle shells 105*a* and 105*b* electrically conduct with each other. Accordingly, while the receptacle shells 105*a* and 105*b* function as inner shells of the receptacle connectors 113*a* and 113*b*, the guide shell 104 is allowed to function as an outer shell of the receptacle connectors 113*a* and 113*b*. Additionally, since the guide shell 104 covers the receptacle connectors 113*a* and 113*b*, and is fixed to the board 106, coming-off of the receptacle connectors 113*a* and 113*b* from the board 106 must be prevented.

Additionally, although when a connector is further added to a docking connector having predetermined standard connectors such as a plurality of connectors conforming to the standard specification, there occurs a problem of increasing the docking connector in size, the plug docking connector 75 according to the second embodiment enables down-sizing thereof because the additional plug connectors 77*a* and 77*b* are arranged in the guide portions 78*a* and 78*b*. Similarly, the receptacle docking connector 73 according to the second embodiment enables down-sizing thereof because the additional receptacle connectors 103*a* and 103*b* are arranged in the guide reception portions 102*a* and 102*b*.

Figure 26:
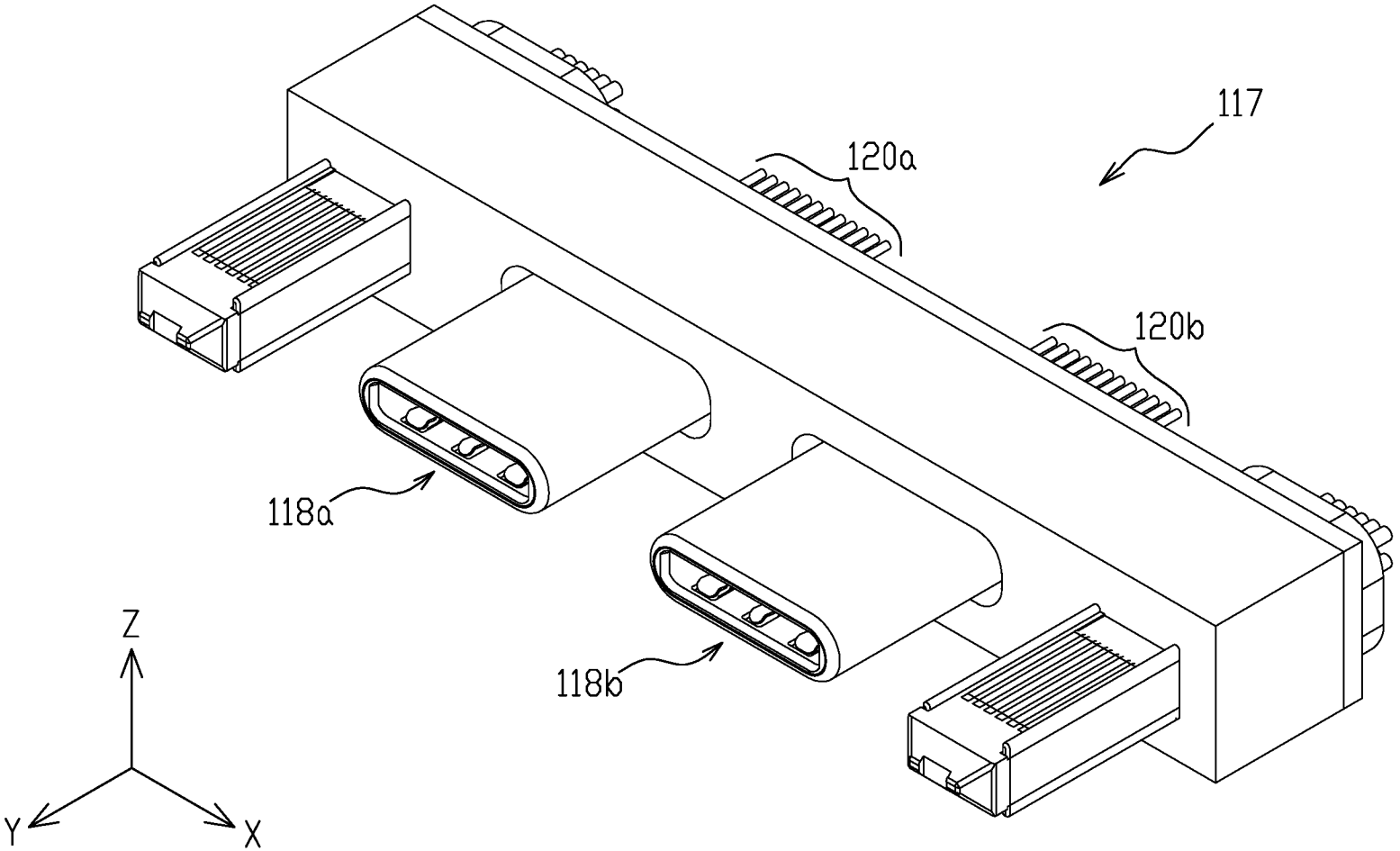
FIG. 26 is a perspective view showing an appearance of other plug docking connector.
Figure 27:
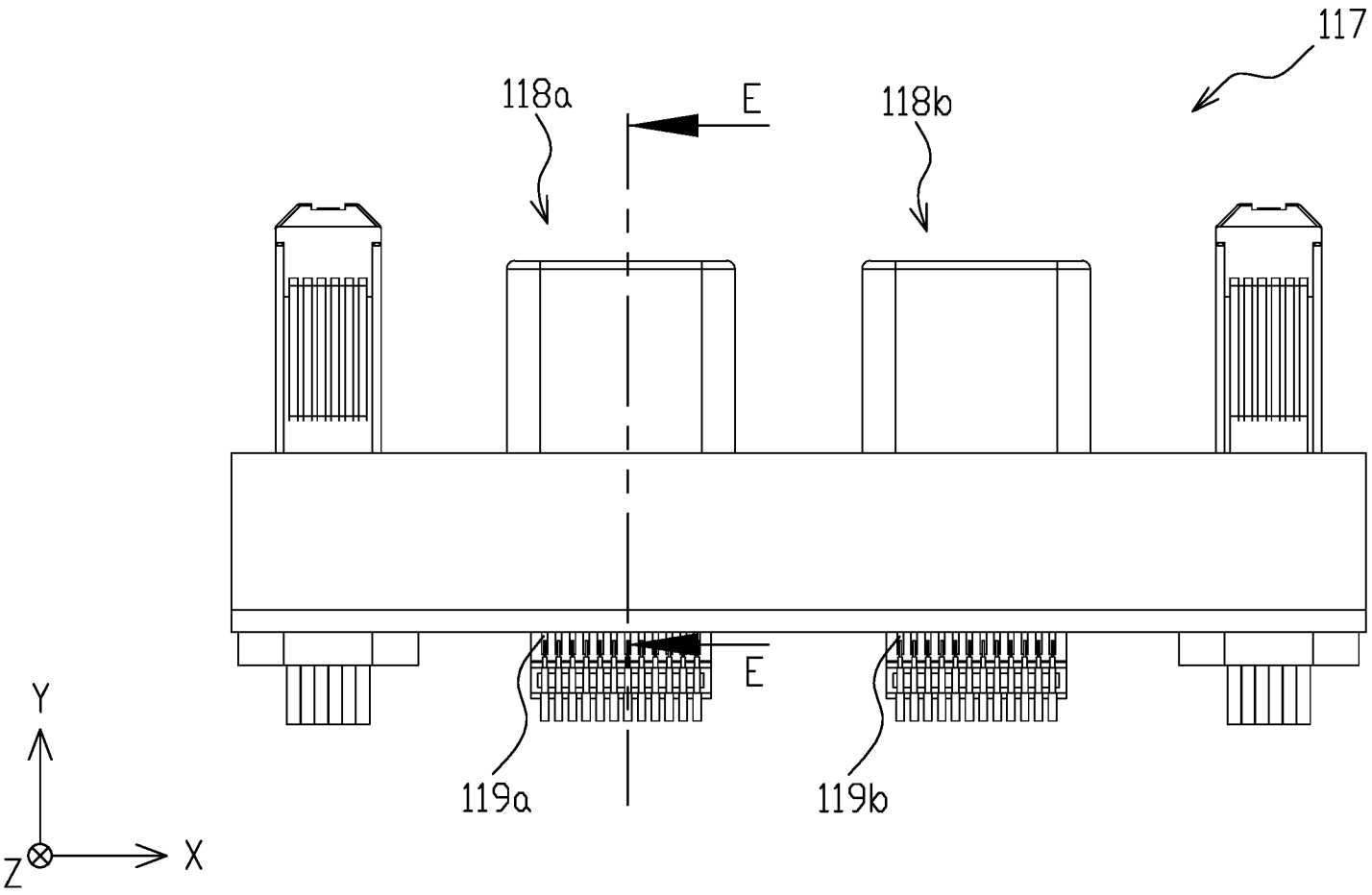
FIG. 27 is a bottom plan view showing the appearance of other plug docking connector.

In the above plug docking connector 75 according to the second embodiment, the plug connectors 76*a* and 76*b* are mounted on the circuit boards 82*a* and 82*b*, and the contacts 85*a*, 59*a*, and 85*b* of the plug connectors 76*a* and 76*b*, and the cables 83*a*, 83*b*, 84*a*, and 84*b* are electrically connected with each other via the circuit boards 82*a* and 82*b*. However, in place of such a configuration, for example, a plug docking connector 117 as shown in FIG. 26 can be used. FIG. 26 is a perspective view showing an appearance of the plug docking connector 117, FIG. 27 is a bottom plan view showing the appearance of the plug docking connector 117, FIG. 28 is an exploded view showing a configuration of the plug docking connector 117, and FIG. 29 is a sectional view taken along E-E in FIG. 27.

Figure 28:
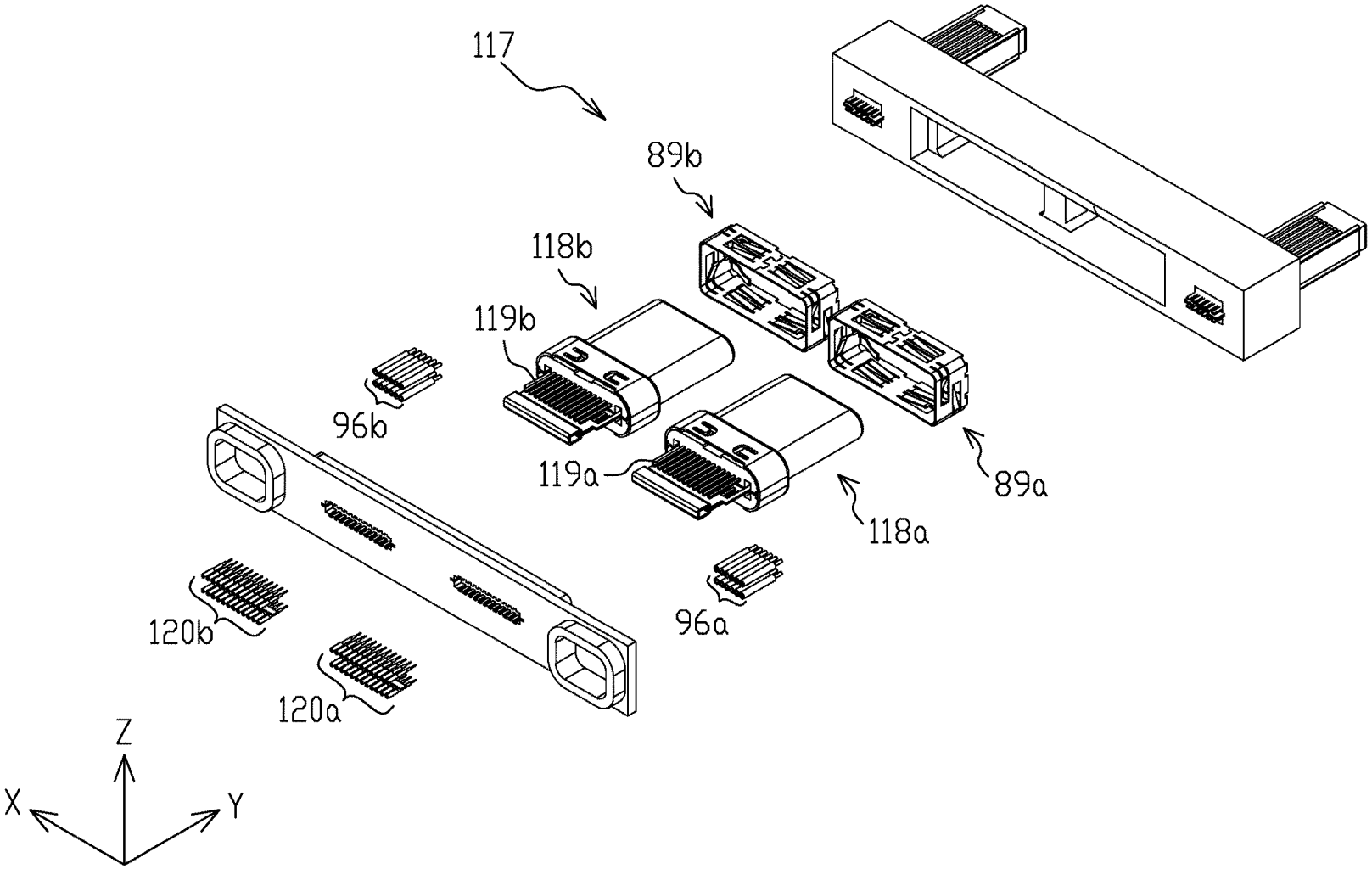
FIG. 28 is an exploded view showing a configuration of other plug docking connector.
Figure 29:
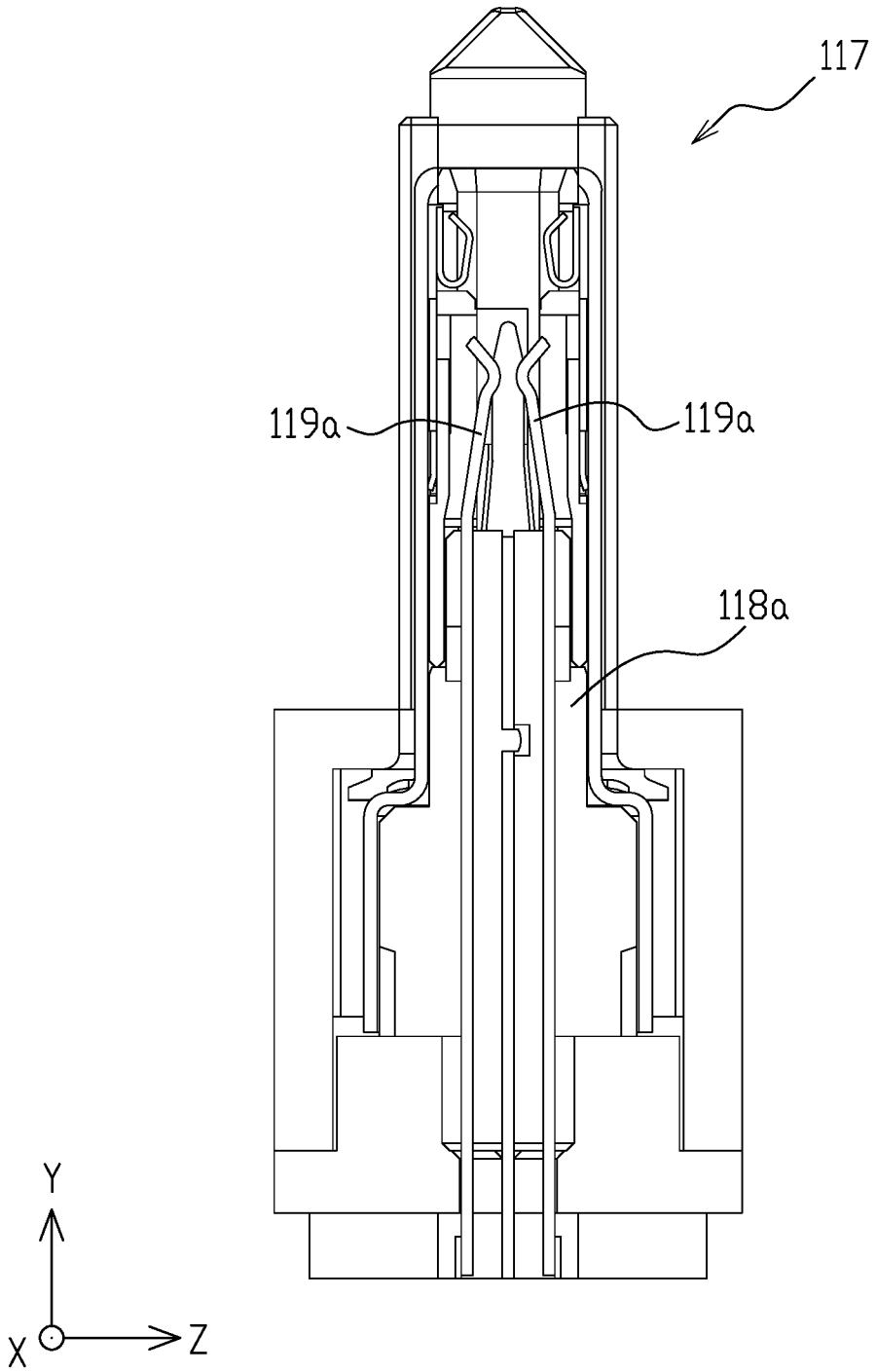
FIG. 29 is a sectional view showing the configuration of other plug docking connector.

As shown in FIG. 28 and FIG. 29, plug connectors 118*a* and 118*b* configuring the plug docking connector 117 are not mounted on the circuit board, and a plurality of contacts 119*a* and 119*b* of the plug connectors 118*a* and 118*b* and the cables 120*a* and 120*b* are directly connected by soldering or the like. Even when the plug docking connector 117 is mounted on an electronic apparatus or the like and a position relative to a printed board mounted on the electronic apparatus differs, connection with the printed board can be realized with ease without changing a shape or a length of the plurality of contacts 119*a* and 119*b* of the plug connectors 118*a* and 118*b*. Specifically, since the contacts 119*a* and 119*b* are connected with the cables 120*a* and 120*b*, connection of the cables 120*a* and 120*b* with the printed board of the electronic apparatus enables electrical connection of the plug connectors 118*a* and 118*b* with the printed board via the cables 120*a* and 120*b*.

Additionally, although in the above plug docking connector 75 according to the second embodiment, the control portion 89*a* controls a position and a posture of the plug connector 76*a*, and the control portion 89*b* controls a position and a posture of the plug connector 76*b*, the plug docking connector can be configured to include only the control portion 89*a*, or only the control portion 89*b*. When only the control portion 89*a* (or 89*b*) is provided, a position and a posture of the plug connector 76*b* (or 76*a*) are defined in advance, and only a position and a posture of the plug connector 76*a* (or 76*b*) are controlled.

Additionally, although in the above plug docking connector 75 according to the second embodiment, the control portions 89*a* and 89*b* control the postures of the plug connectors 76*a* and 76*b* by using the Y side elastic portion 94*a* and the convex portions 67*a* and 67*b* of the rear cover 81, a posture control portion having an elastic portion and a convex portion can be provided between the circuit boards 82*a* and 82*b* and the rear cover 81, so that the posture control portion controls the postures of the plug connectors 76*a* and 76*b*.

Additionally, although in the above receptacle docking connector 73 according to the second embodiment, as shown in FIG. 24, the other end portions of the contacts 107*a* and 107*b* are electrically connected with the wires 109*a* and 109*b*, in place of such a configuration, a second engagement portion can be provided which engages with a connector mounted on the board 106 in advance other than a first engagement portion in which the additional receptacle connectors 103*a* and 103*b* engage with the additional plug connectors 77*a* and 77*b*. In this case, one end portions of the contacts 107*a* and 107*b* electrically connect with the contacts 116*a* and 116*b* and contacts not shown of the additional plug connectors 77*a* and 77*b*, and the other end portions of the contacts 107*a* and 107*b* electrically connect with contacts of the connector mounted on the board 106 in advance.

Figure 30:
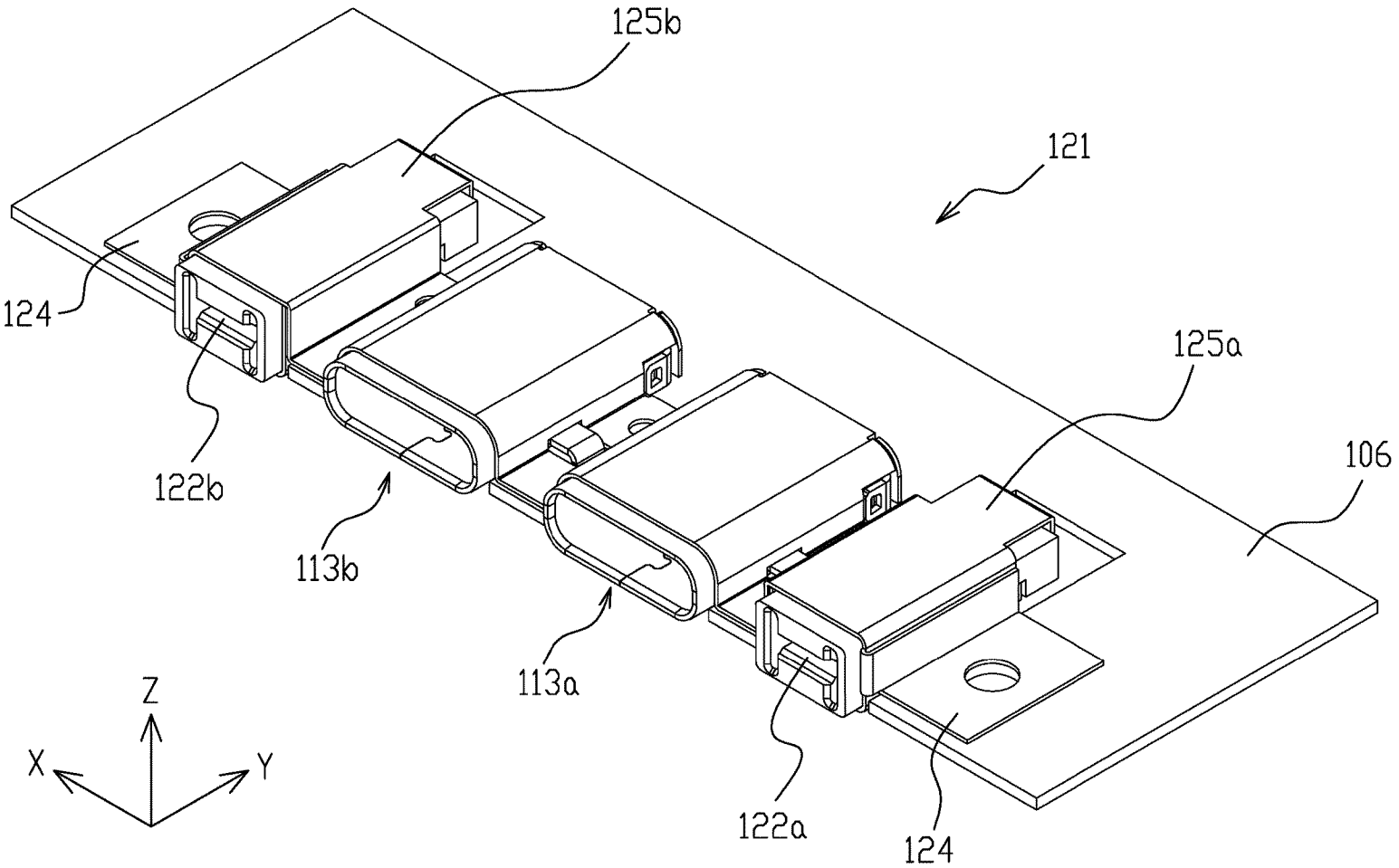
FIG. 30 is a perspective view showing an appearance of other receptacle docking connector.
Figure 31:
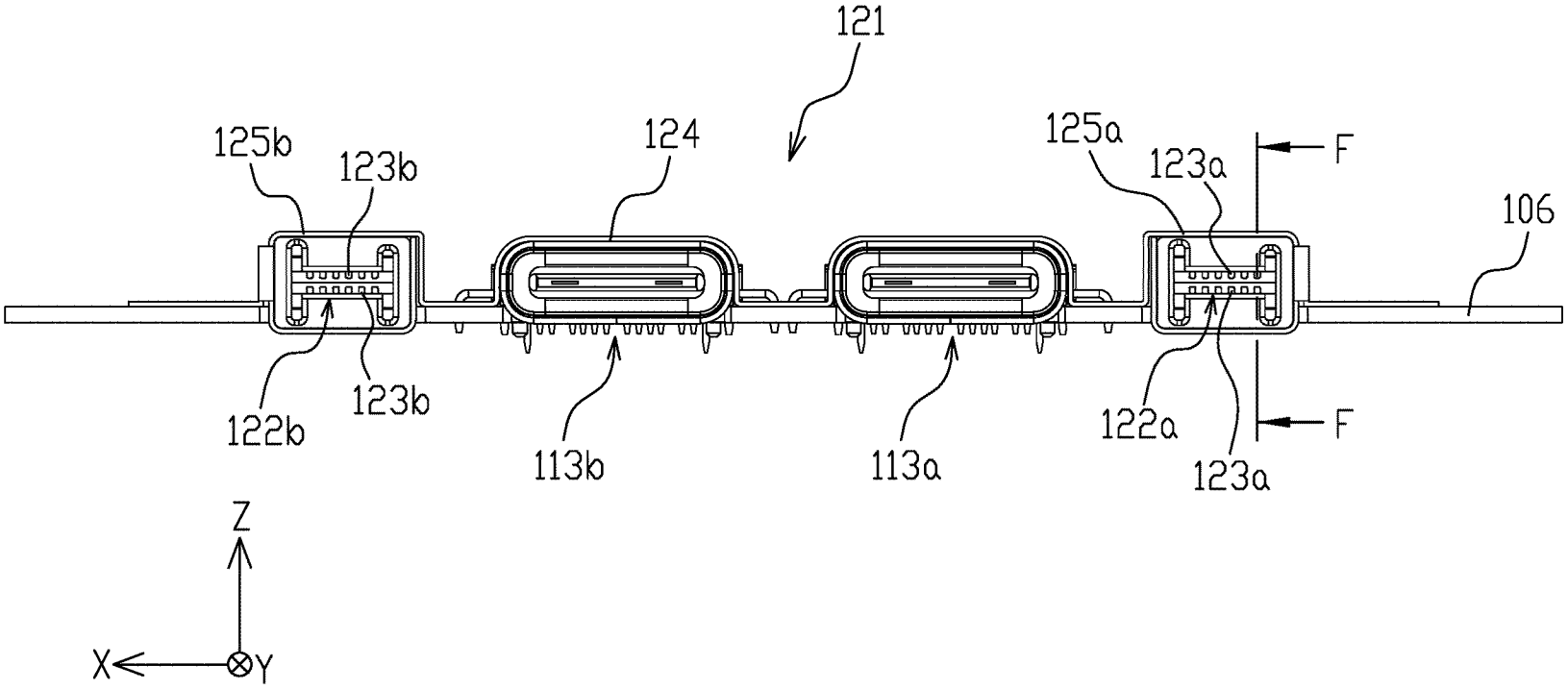
FIG. 31 is a front view showing the appearance of other receptacle docking connector.
Figure 32:
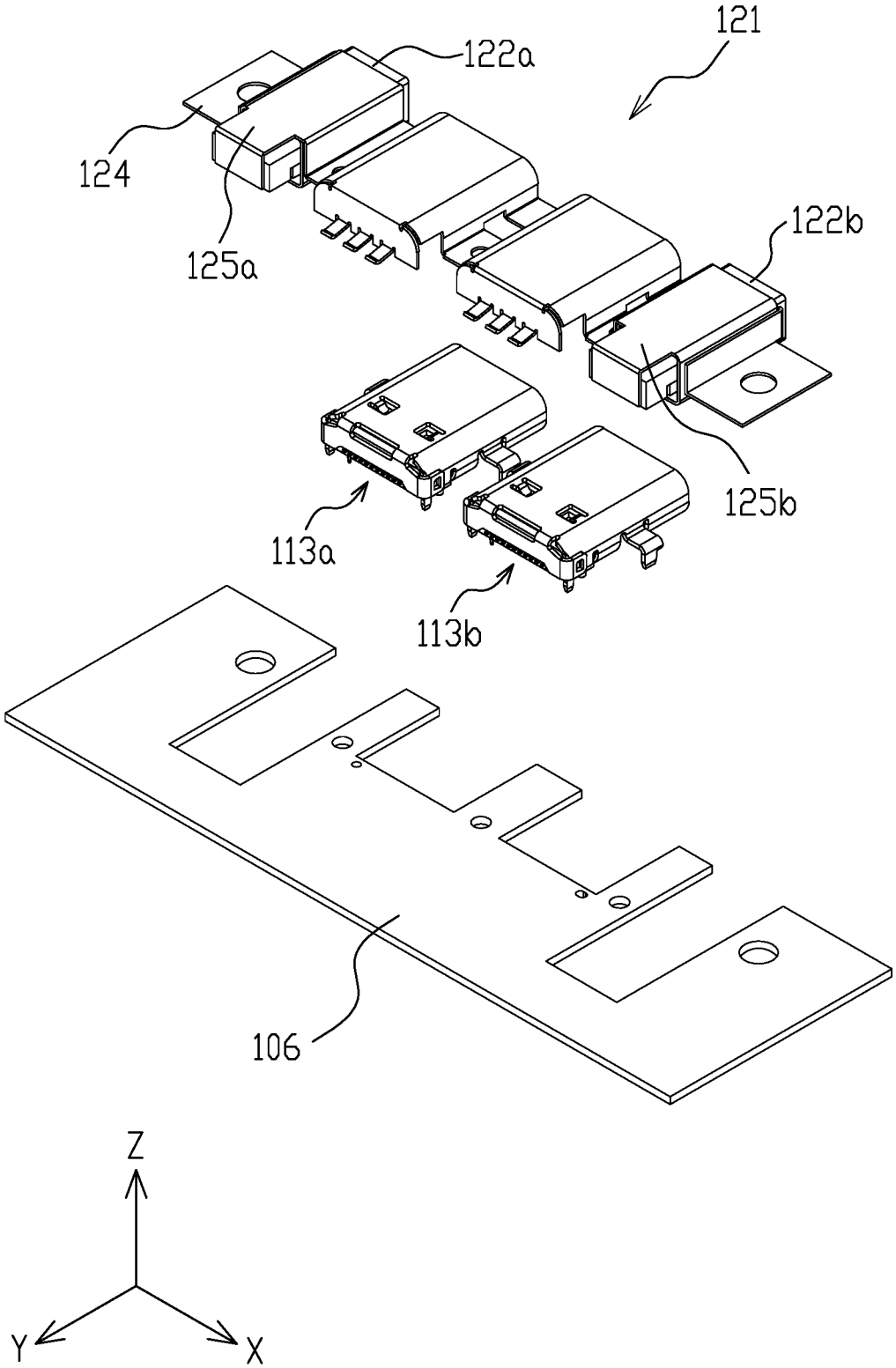
FIG. 32 is an exploded view showing a configuration of other receptacle docking connector.
Figure 33:
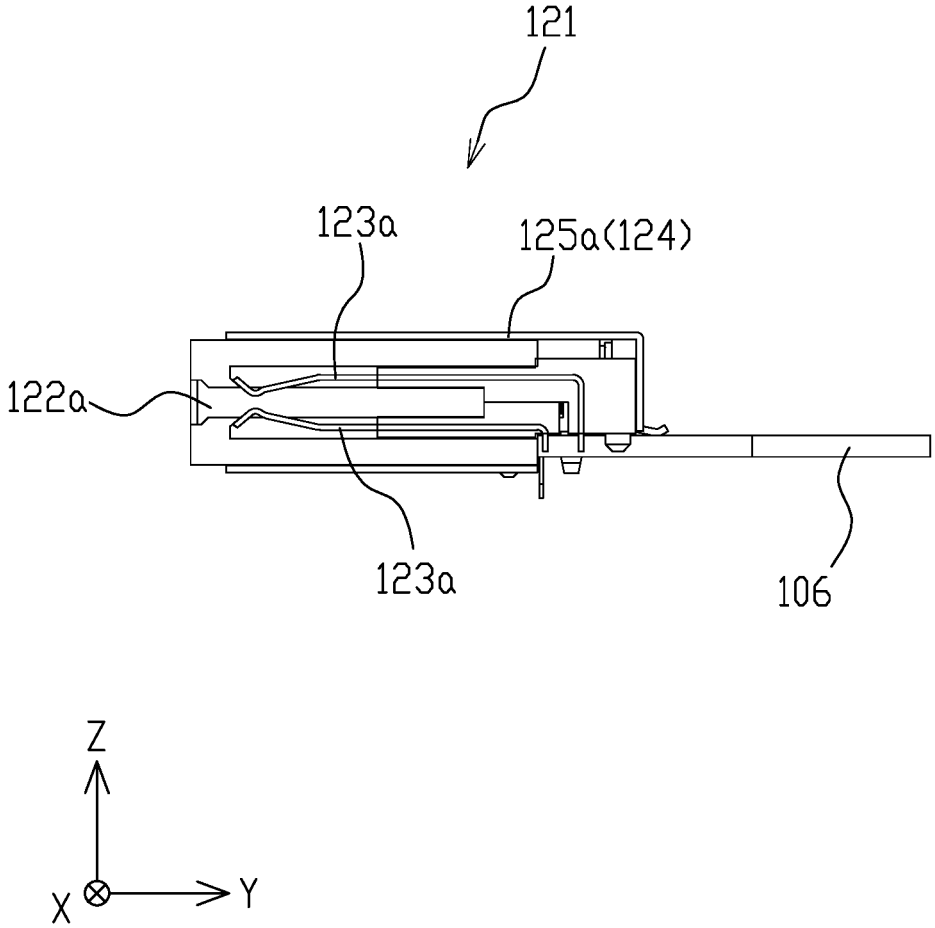
FIG. 33 is a sectional view showing the configuration of other receptacle docking connector.

Additionally, although in the above receptacle docking connector 73 according to the second embodiment, as shown in FIG. 24, the other end portions of the contacts 107*a* and 107*b* are electrically connected with the wires 109*a* and 109*b*, in place of such a configuration, for example, a receptacle docking connector 121 can be used as shown in FIG. 30. FIG. 30 is a perspective view showing an appearance of the receptacle docking connector 121, FIG. 31 is a front view showing the appearance of the receptacle docking connector 121, FIG. 32 is an exploded view showing a configuration of the receptacle docking connector 121, and FIG. 33 is a sectional view taken along F-F in FIG. 31. As shown in FIG. 30 to FIG. 33, to contacts 123*a* and 123*b* of additional receptacle connectors 122*a* and 122*b* configuring the receptacle docking connector 121, no wire is connected. Additionally, a guide shell 124 configuring the receptacle docking connector 121 supports the additional receptacle connectors 122*a* and 122*b* in the insertion direction (the +Y direction) in which the guide portions of the plug docking connector are inserted into guide reception portions 125*a* and 125*b*.

Additionally, although the above receptacle docking connector 73 according to the second embodiment includes the two guide reception portions 102*a* and 102*b*, one guide reception portion, or three or more guide reception portions may be provided. Even when three or more guide reception portions are provided, the guide reception portions are formed integrally.

Additionally, although the receptacle docking connector 73 according to the second embodiment, which is a reversible connector, includes the two additional receptacle connectors 103*a* and 103*b*, one additional receptacle connector may be provided. In this case, when the plug connector 76*a* engages with the receptacle connector 113*a*, the additional plug connector 77*a* engages with the additional receptacle connector, and when the plug connector 76*b* engages with the receptacle connector 113*b*, the additional plug connector 77*b* engages with the additional receptacle connector.

Additionally, although in the above second embodiment, only the front end portions of the guide portions 78*a* and 78*b* protrude more than the front end portions of the plug connectors 76*a* and 76*b*, only front end portions of the guide reception portions 102*a* and 102*b* may protrude more than front end portions of the receptacle connectors 113*a* and 113*b*. Additionally, the front end portions of the guide portions 78*a* and 78*b* may protrude more than the front end portions of the plug connectors 76*a* and 76*b*, and the front end portions of the guide reception portions 102*a* and 102*b* may protrude more than the front end portions of the receptacle connectors 113*a* and 113*b*.

Additionally, although the above plug docking connectors according to second embodiment are each provided with two additional plug connectors, the plug docking connector may be provided with one or three or more additional plug connectors. Similarly, although the above receptacle docking connectors according to second embodiment are each provided with two additional receptacle connectors, the receptacle docking connector may be provided with one or three or more additional receptacle connectors.

Figure 34:
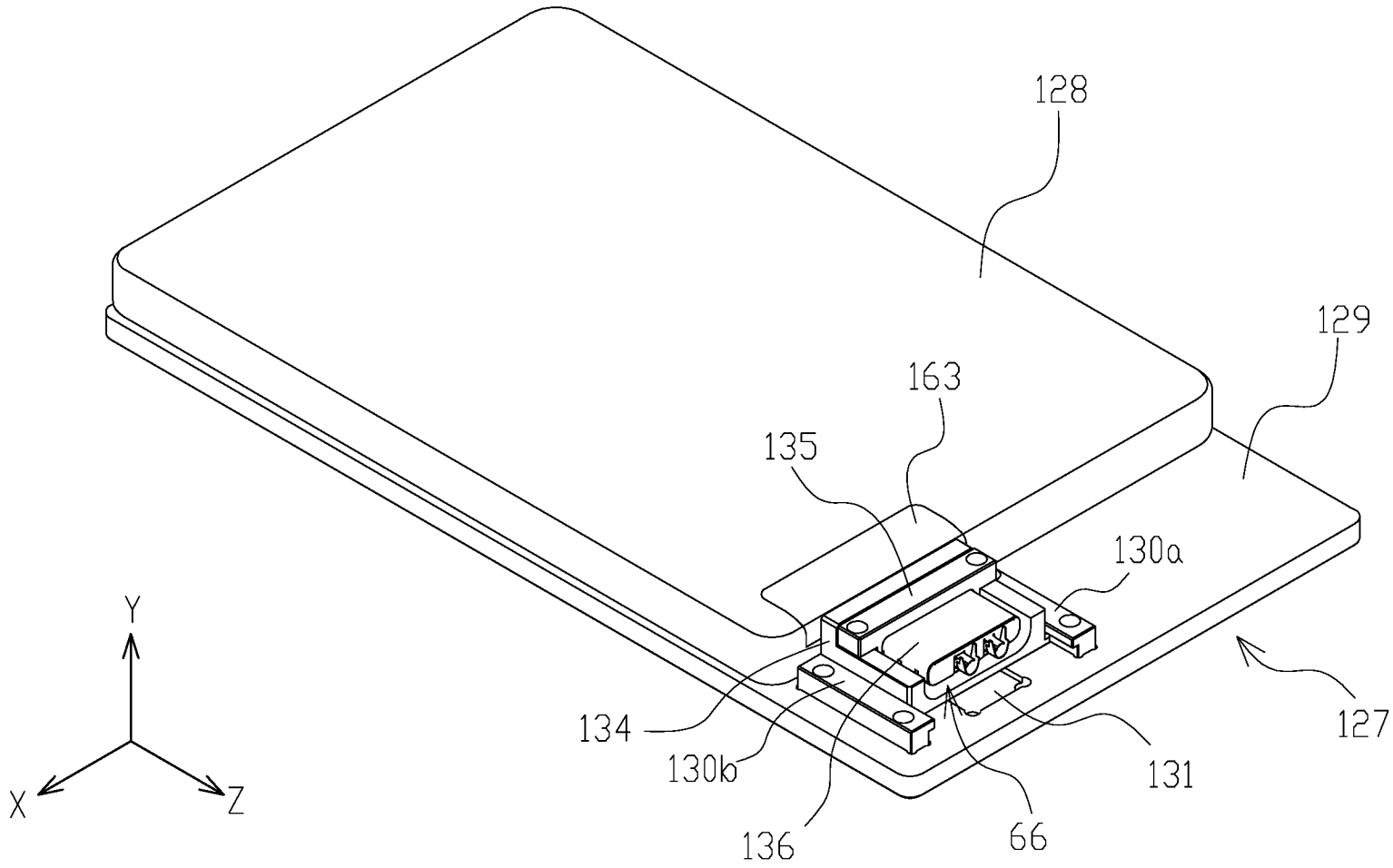
FIG. 34 is a perspective view showing a state where a docking station mounted with a plug unit and a personal computer mounted with a receptacle unit are docked with each other according to a third embodiment.
Figure 35:
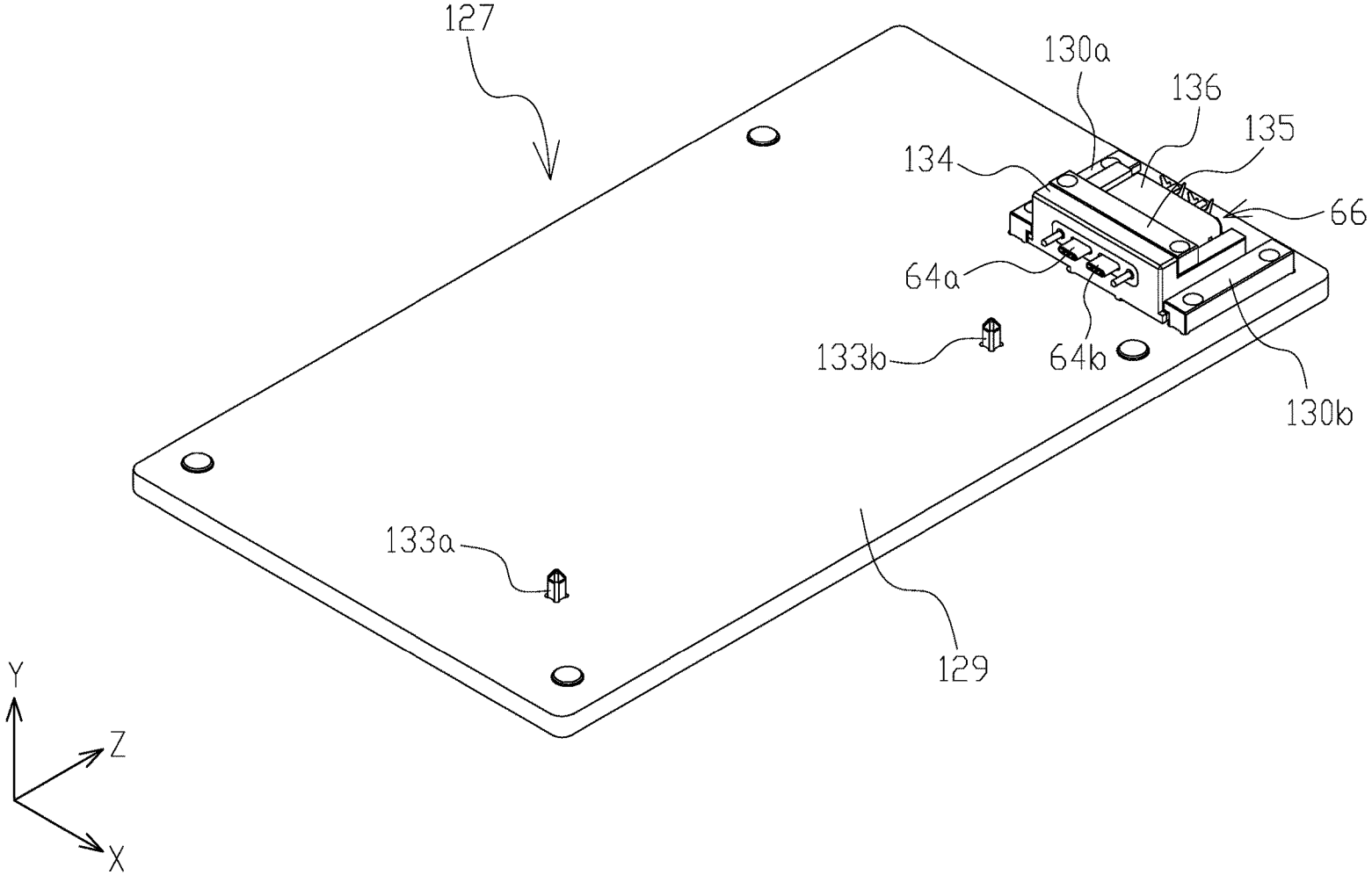
FIG. 35 is a perspective view showing an appearance of the docking station mounted with the plug unit according to the third embodiment.

Next, description will be made of a docking connector according to a third embodiment of the present invention with reference to the drawings. FIG. 34 is a perspective view showing a state where a docking station 127 mounted with a plug unit 66 and a personal computer 128 mounted with a receptacle unit 126 (see FIG. 46) are docked according to the third embodiment, and FIG. 35 is a perspective view showing an appearance of the docking station 127 mounted with the plug unit 66. In the following, with XYZ orthogonal coordinate systems set as shown in FIG. 34 and FIG. 35, description will be made of a positional relationship and the like of each member with reference to the orthogonal coordinate systems. An X axis is set to be parallel to a direction in which two USB Type-C plug connectors 64*a* and 64*b* (see FIG. 35) are arranged. A Z axis is set to be parallel to a direction in which the plug unit 66 and the receptacle unit 126 (see FIG. 46) are engaged with each other. A Y axis is set to be in a direction orthogonal to a ZX plane.

Figure 36:
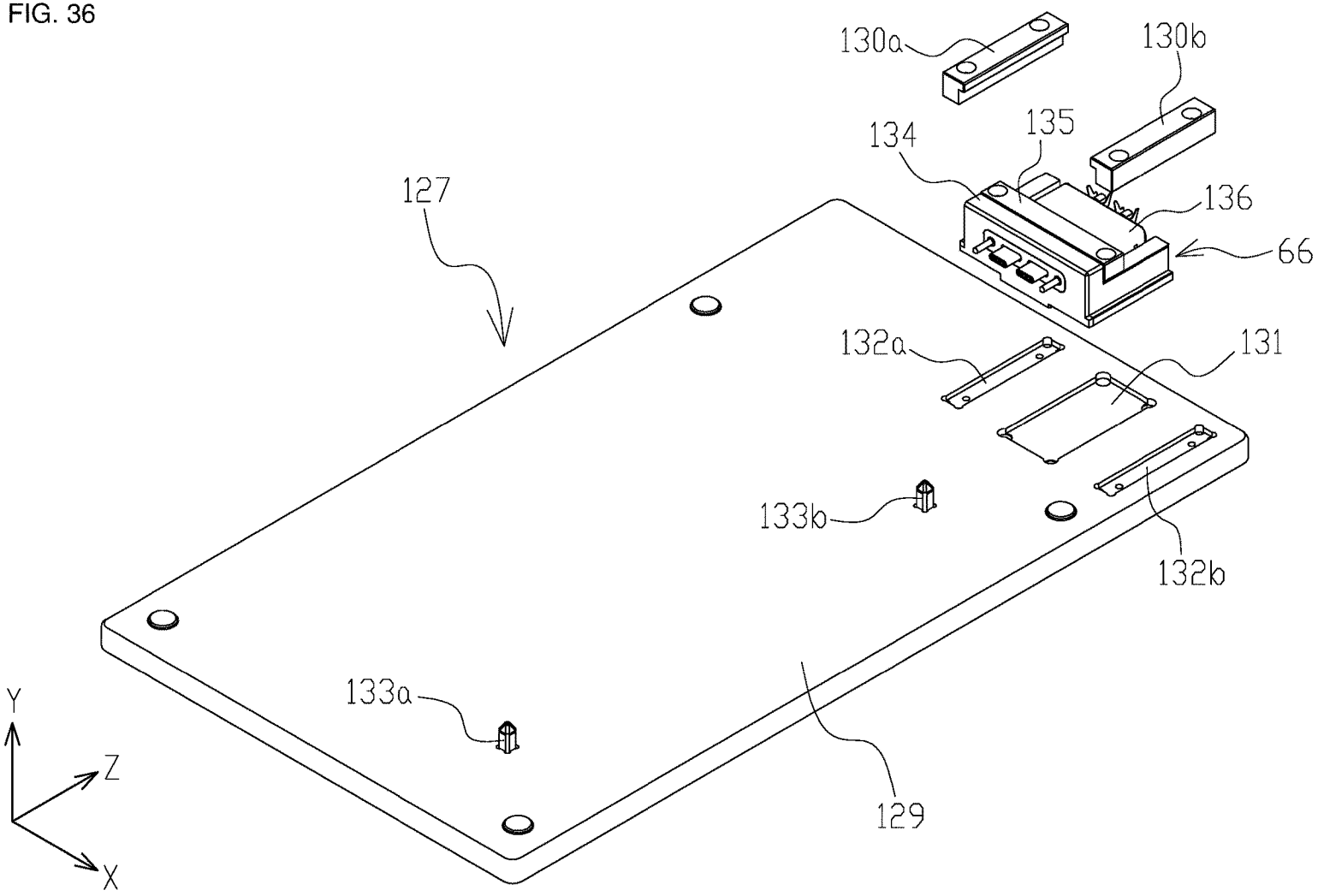
FIG. 36 is an exploded view showing a configuration of the docking station according to the third embodiment.

As shown in FIG. 35, the docking station 127 includes a base 129 and two guide rails 130*a* and 130*b* and is mounted with the plug unit 66. FIG. 36 is an exploded view showing a configuration of the docking station 127. As shown in FIG. 36, on the base 129, there are provided a plug unit reception portion 131 which receives the plug unit 66, and guide rail reception portions 132*a* and 132*b* which receive the two guide rails 130*a* and 130*b*. The guide rail 130*a* is screwed to the base 129 in a state of being received by the guide rail reception portion 132*a*. Similarly, the guide rail 130*b* is screwed to the base 129 in a state of being received by the guide rail reception portion 132*b*. The plug unit 66 is fit in the guide rails 130*a* and 130*b* in a state of being received by the plug unit reception portion 131 so as to be slidable in a ±Z direction. Additionally, on the base 129, two pins 133*a* and 133*b* are provided. Insertion of the pins 133*a* and 133*b*, respectively, into two holes (not shown) formed on a rear surface of the personal computer 128 leads to positioning between the personal computer 128 and the docking station 127.

Figure 37:
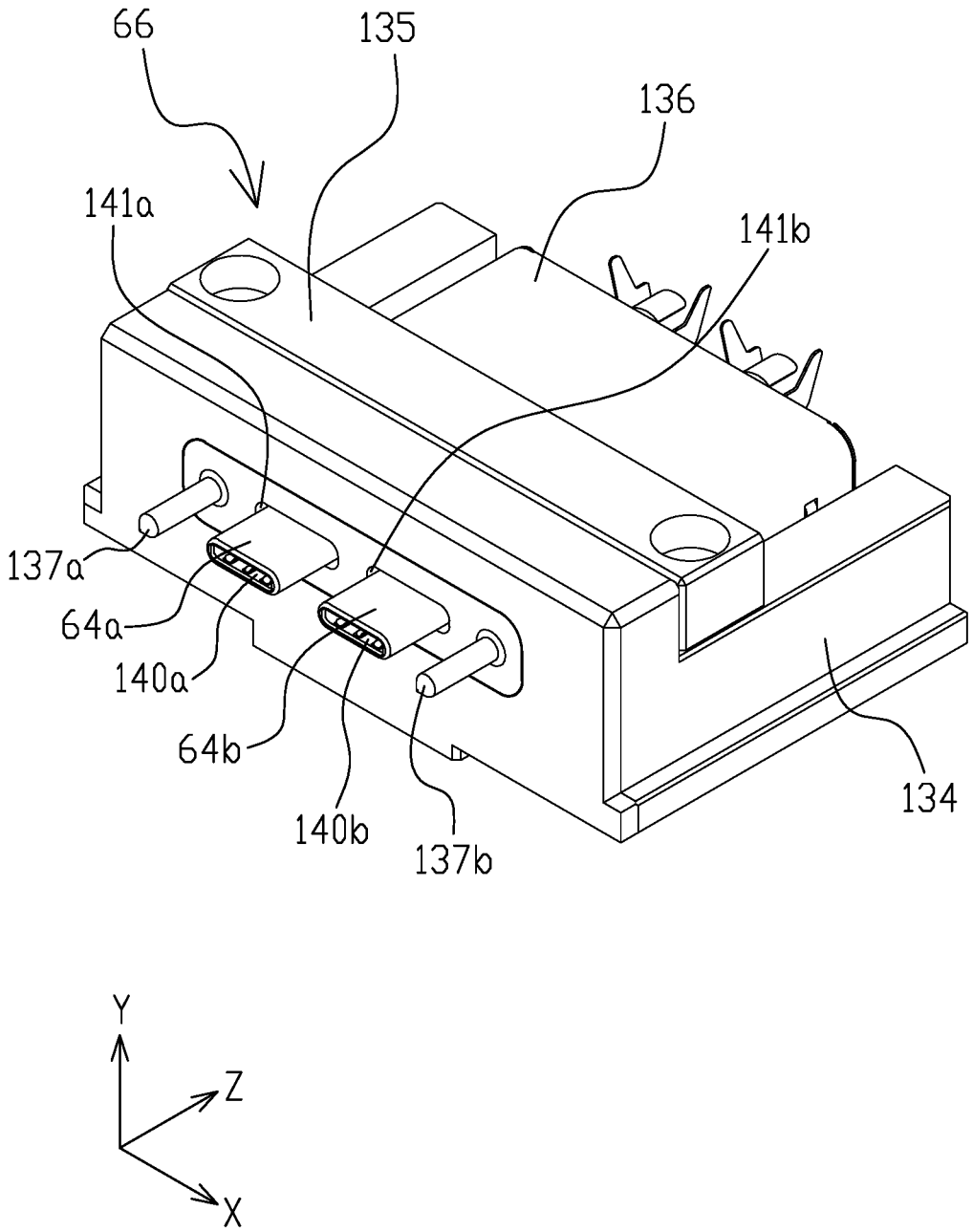
FIG. 37 is a perspective view showing an appearance of the plug unit according to the third embodiment.
Figure 38:
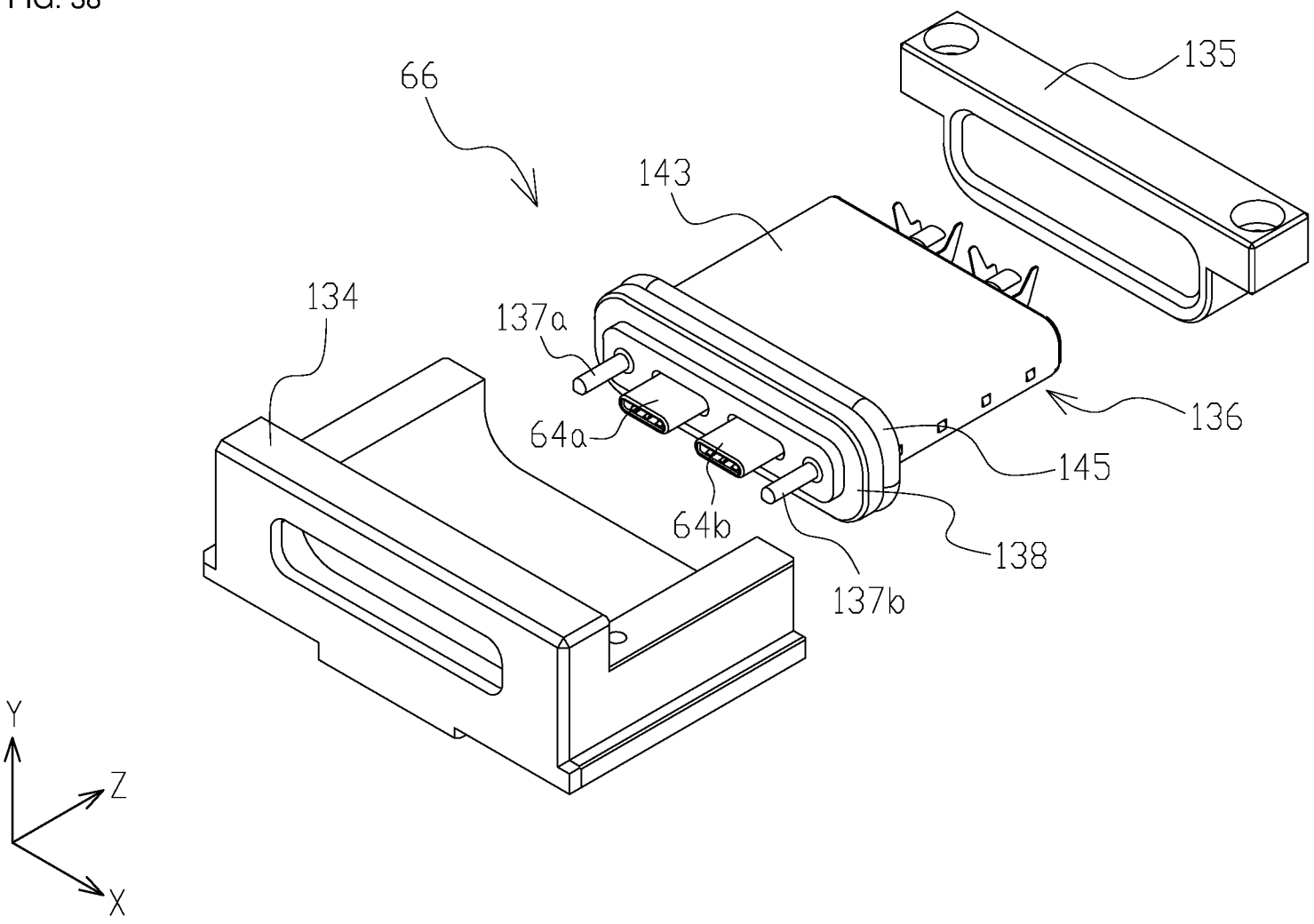
FIG. 38 is an exploded view showing a configuration of the plug unit according to the third embodiment.

FIG. 37 is a perspective view showing an appearance of the plug unit 66, and FIG. 38 is an exploded view showing a configuration of the plug unit 66. As shown in FIG. 37 and FIG. 38, the plug unit 66 includes a docking slider 134, a bracket 135, and a plug docking connector 136. The plug docking connector 136 and the bracket 135 are installed in the docking slider 134, and the bracket 135 is screwed to the docking slider 134. Sliding of the docking slider 134 in the ±Z direction causes also the plug docking connector 136 and the bracket 135 to slide in the ±Z direction. In other words, the plug unit 66 slides in the ±Z direction.

Additionally, as shown in FIG. 38, the plug docking connector 136 includes a front cover 138 having the two USB Type-C plug connectors (hereinafter, simply referred to as plug connectors) 64*a* and 64*b*, and two guide portions 137*a* and 137*b*, an upper shell 143, a lower shell 144 (see FIG. 40), and a cushion rubber 145.

The front cover 138 includes the two guide portions 137*a* and 137*b*. The two guide portions 137*a* and 137*b* are inserted into guide reception portions 161*a* and 161*b* of the receptacle unit 126 (see FIG. 46), respectively, before the plug connectors 64*a* and 64*b* engage with two USB Type-C receptacle connectors (hereinafter, simply referred to as receptacle connectors) 160*a* and 160*b* (see FIG. 46) when the personal computer 128 and the docking station 127 are docked with each other. The guide portion 137*a* is formed on a −X direction side of the plug connector 64*a*, and the guide portion 137*b* is formed on a +X direction side of the plug connector 64*b*. The front cover 138 functions as a cover which covers the plug connectors 64*a* and 64*b*.

Additionally, front end portions on a −Z direction side of the guide portions 137*a* and 137*b* protrude in the −Z direction more than front end portions on the −Z direction side of the plug connectors 64*a* and 64*b*. Specifically, the guide portions 137*a* and 137*b* protrude to an insertion direction (the −Z direction) side on which the guide portions 137*a* and 137*b* are inserted into the guide reception portions 161*a* and 161*b* of the receptacle unit 126 more than the plug connectors 64*a* and 64*b*. Accordingly, the guide portions 137*a* and 137*b* are inserted into the guide reception portions 161*a* and 161*b* of the receptacle unit 126 (see FIG. 46) before the plug connectors 64*a* and 64*b* engage with the receptacle connectors 160*a* and 160*b* (see FIG. 46) when the personal computer 128 and the docking station 127 are docked with each other.

Figure 46:
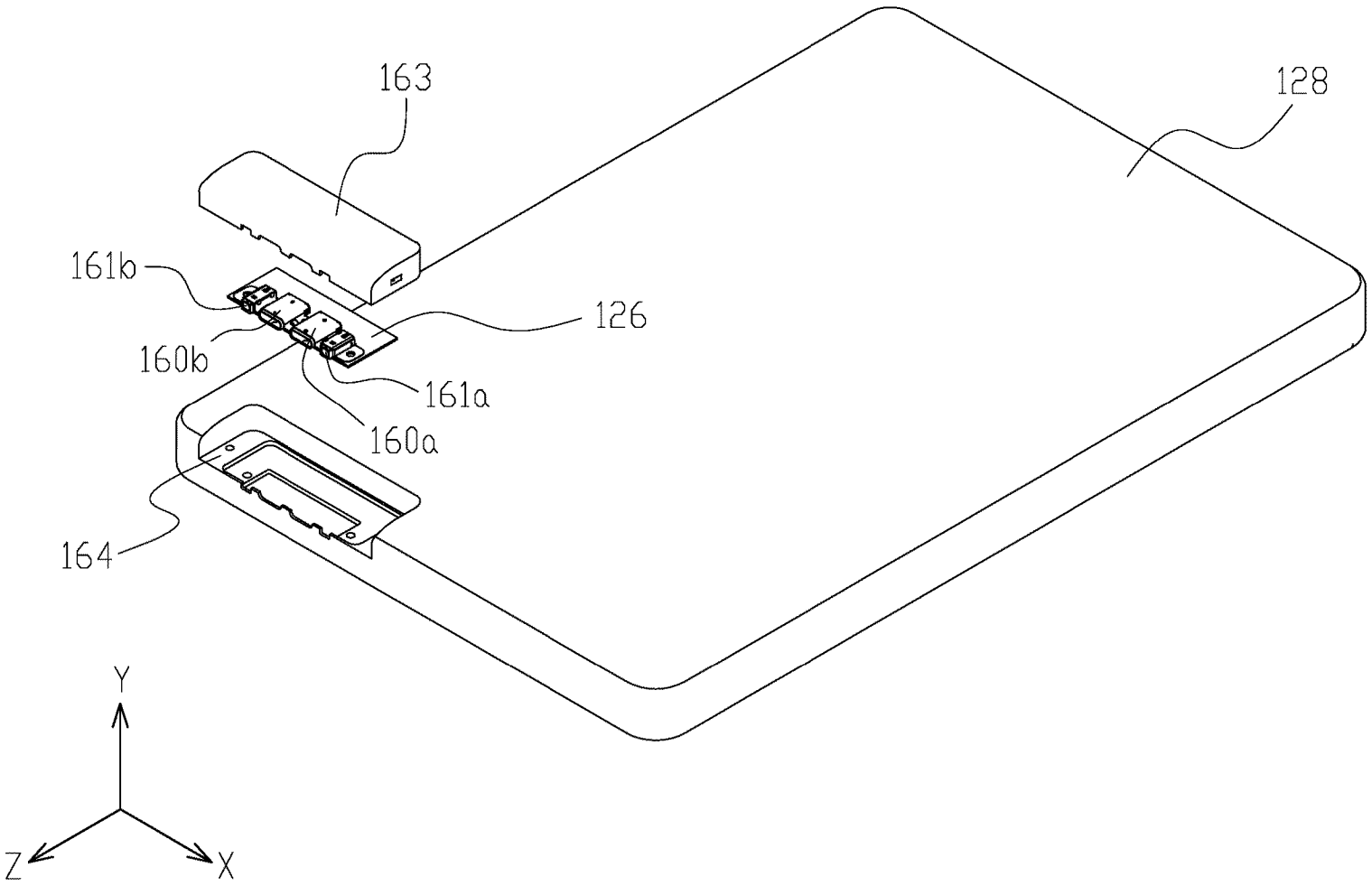
FIG. 46 is an exploded view showing a configuration of the personal computer mounted with the receptacle unit according to the third embodiment.

Additionally, on the −X direction side between the guide portion 137*a* and the guide portion 137*b* of the front cover 138, there is formed an opening portion 141*a* covering the plug connector 64*a* and allowing an engagement portion 140*a* to be exposed, by which engagement portion the plug connector 64*a* engages with the receptacle connector 160*a* (see FIG. 46). Additionally, on the +X direction side between the guide portion 137*a* and the guide portion 137*b* of the front cover 138, there is formed an opening portion 141*b* covering the plug connector 64*b* and allowing an engagement portion 140*b* to be exposed, by which engagement portion, the plug connector 64*b* engages with the receptacle connector 160*b* (see FIG. 46).

Additionally, between an outer wall portion of the plug connector 64*a* and a wall portion 142*a* formed on the −Z direction side of the opening portion 141*a*, a predetermined space is formed such that on a surface (an XY plane) on which the opening portion 141*a* is formed, the plug connector 64*a* can move relative to the front cover 138. Similarly, between an outer wall portion of the plug connector 64*b* and a wall portion 142*b* formed on the −Z direction side of an opening portion 86*b*, a predetermined space is formed such that on a surface (the XY plane) in which the opening portion 141*b* is formed, the plug connector 64*b* can move relative to the front cover 138.

The upper shell 143 and the lower shell 144 (see FIG. 39) cover a +Z direction side of the front cover 138, floating portions 146*a* and 146*b* to be described later, a rear cover 139, and boards 147*a* and 147*b* (see FIG. 40). The cushion rubber 145 is disposed on the +Z direction side of the front cover 138. The cushion rubber 145 absorbs a deviation in position between the guide portions 137*a* and 137*b* and the guide reception portions 161*a* and 161*b* of the receptacle unit 126 (see FIG. 46) when the personal computer 128 and the docking station 127 are docked with each other.

Figure 39:
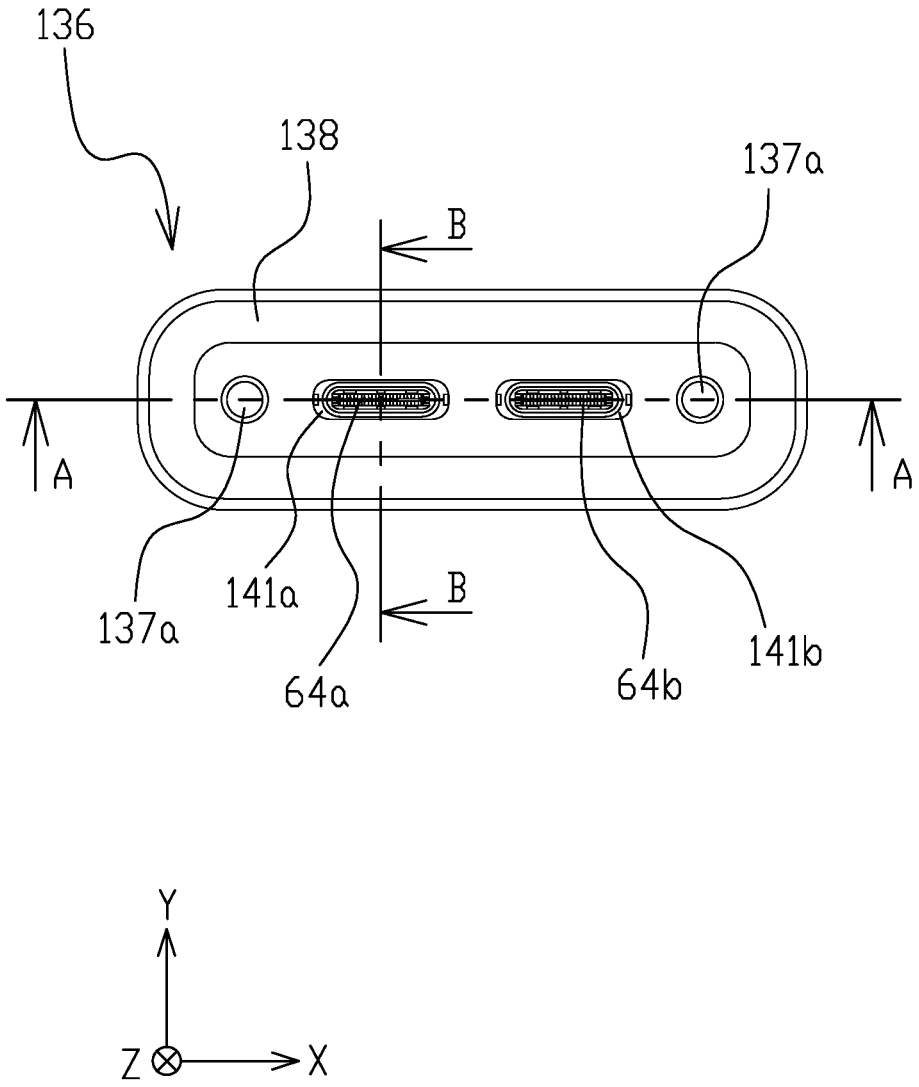
FIG. 39 is a front view showing a configuration of a plug docking connector according to the third embodiment.
Figure 40:
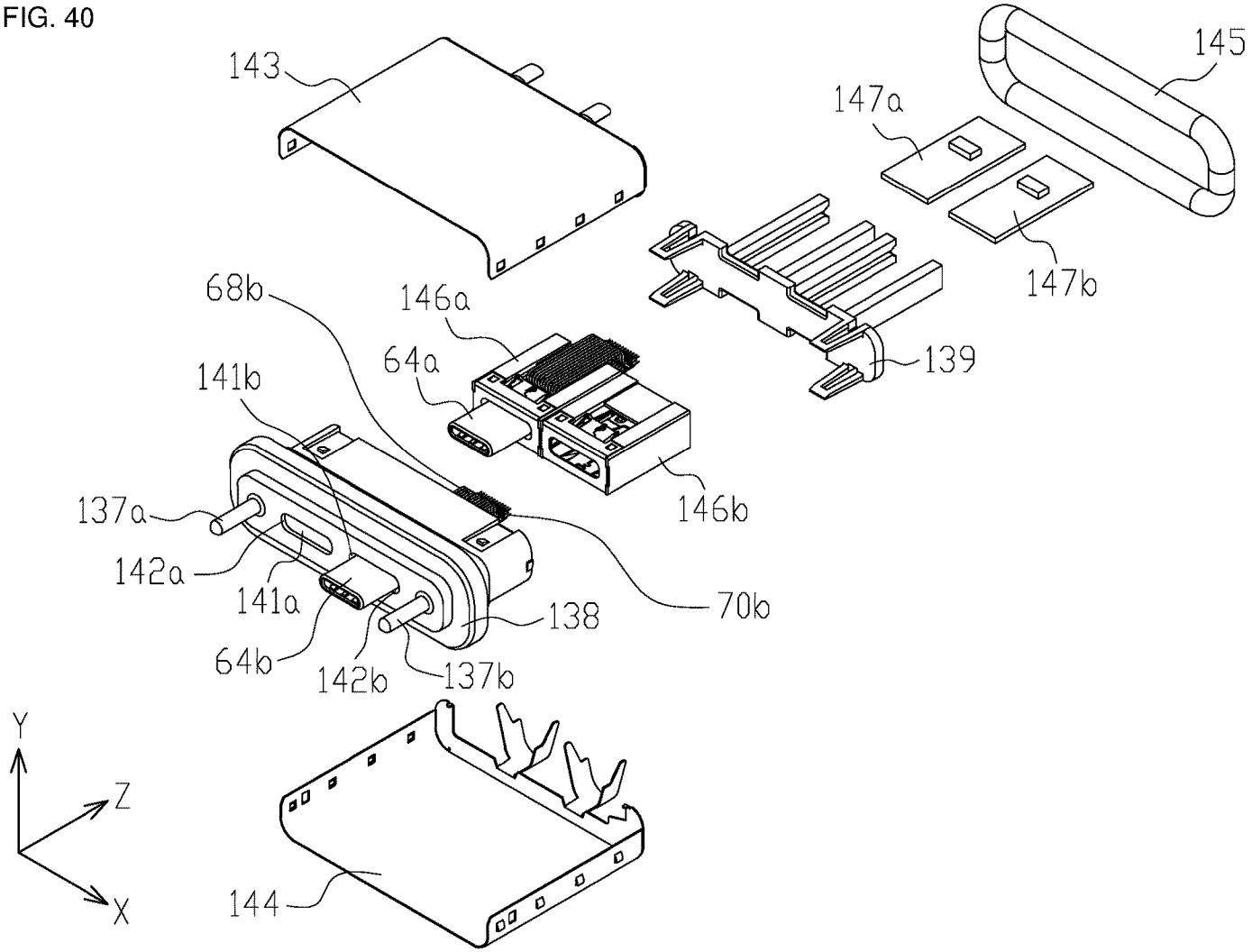
FIG. 40 is an exploded view showing the configuration of the plug docking connector according to the third embodiment.
Figure 41:
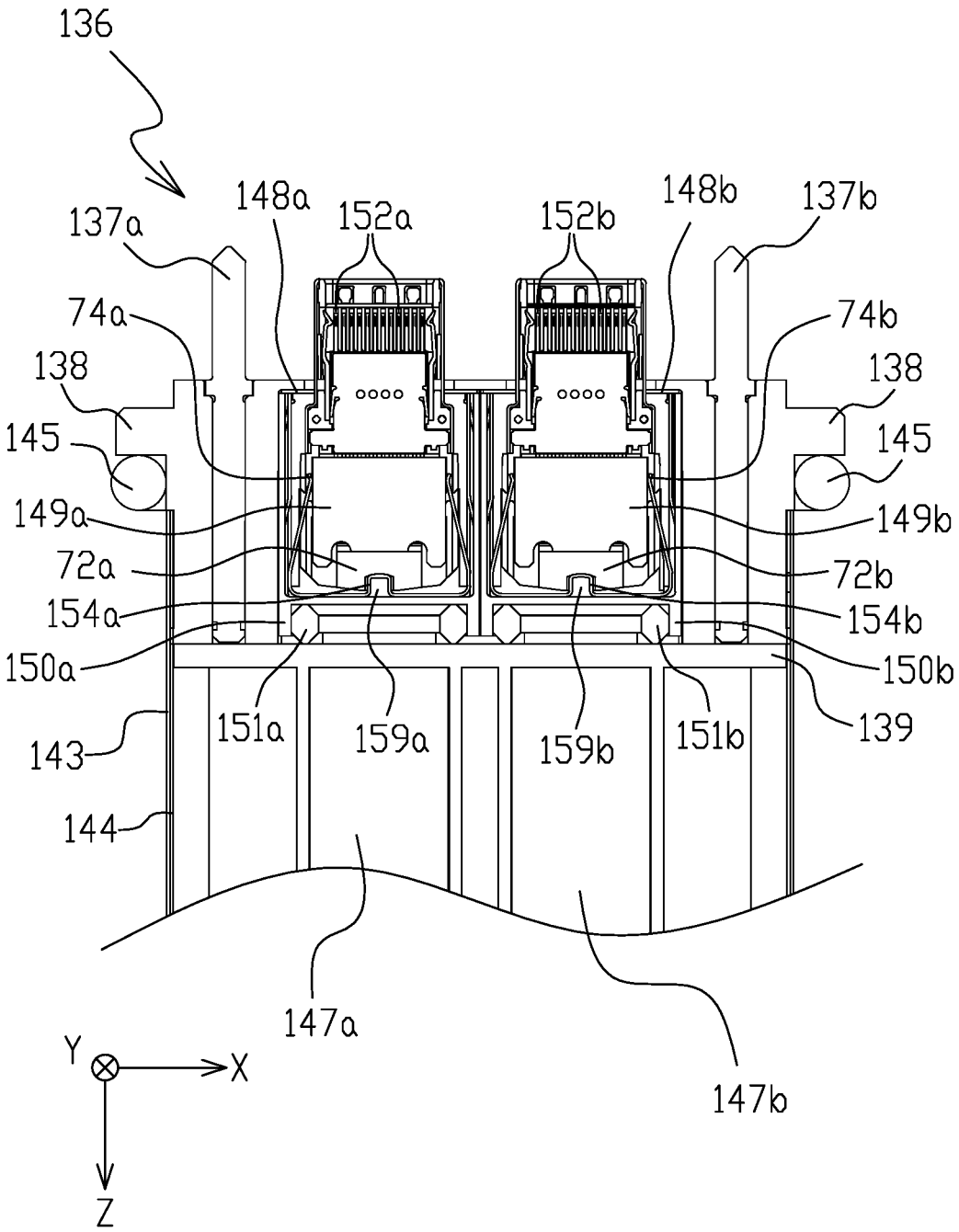
FIG. 41 is a sectional view showing the configuration of the plug docking connector according to the third embodiment.
Figure 42:
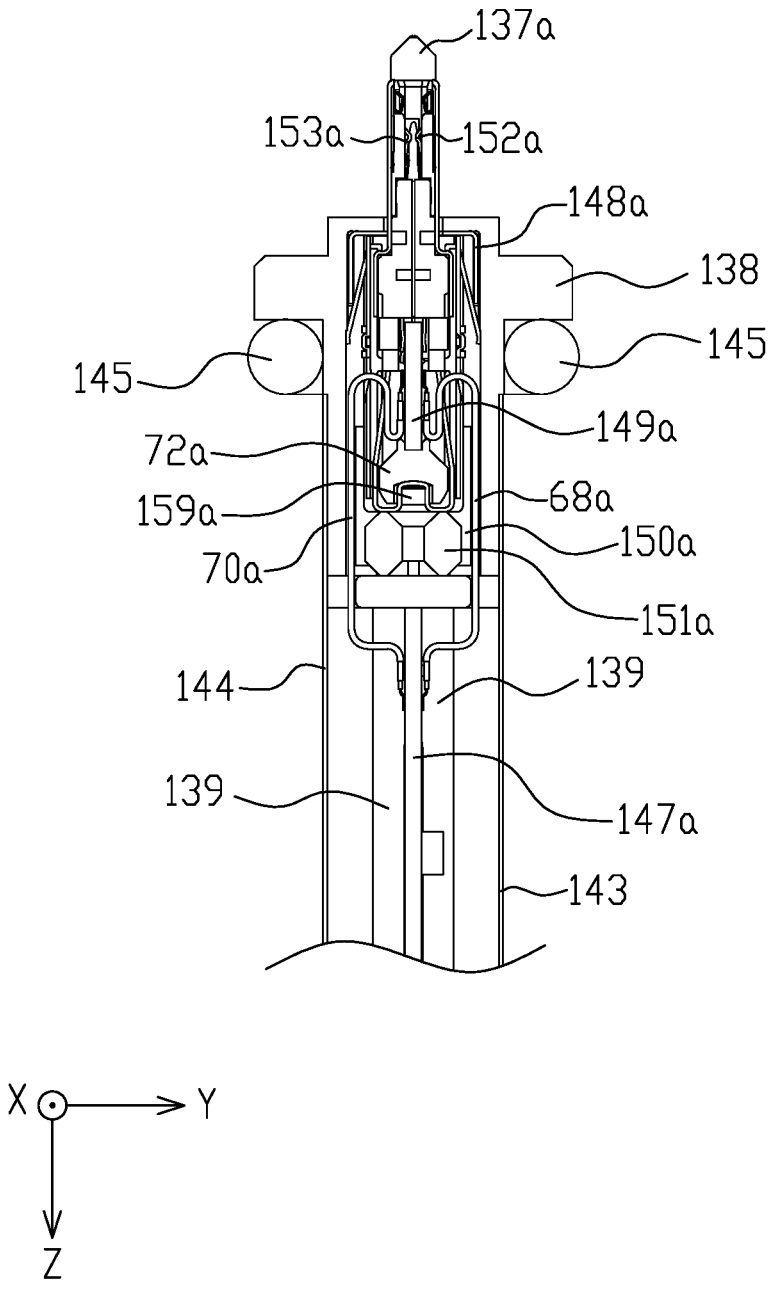
FIG. 42 is a sectional view showing the configuration of the plug docking connector according to the third embodiment.

FIG. 39 is a front view showing a configuration of the plug docking connector 136, FIG. 40 is an exploded view showing the configuration of the plug docking connector 136, FIG. 41 is a sectional view taken along A-A of FIG. 39, and FIG. 42 is a sectional view taken along B-B of FIG. 39. As shown in FIG. 39 to FIG. 42, the plug docking connector 136 includes the floating portions 146*a* and 146*b*, the rear cover 139, and the boards 147*a* and 147*b*. The rear cover 139 is hooked to the front cover 138 after the floating portions 146*a* and 146*b* are inserted into the front cover 138. The boards 147*a* and 147*b* are installed in the rear cover 139. The rear cover 139 functions as a cover which covers the plug connectors 64*a* and 64*b*, together with the front cover 138.

Figure 43:
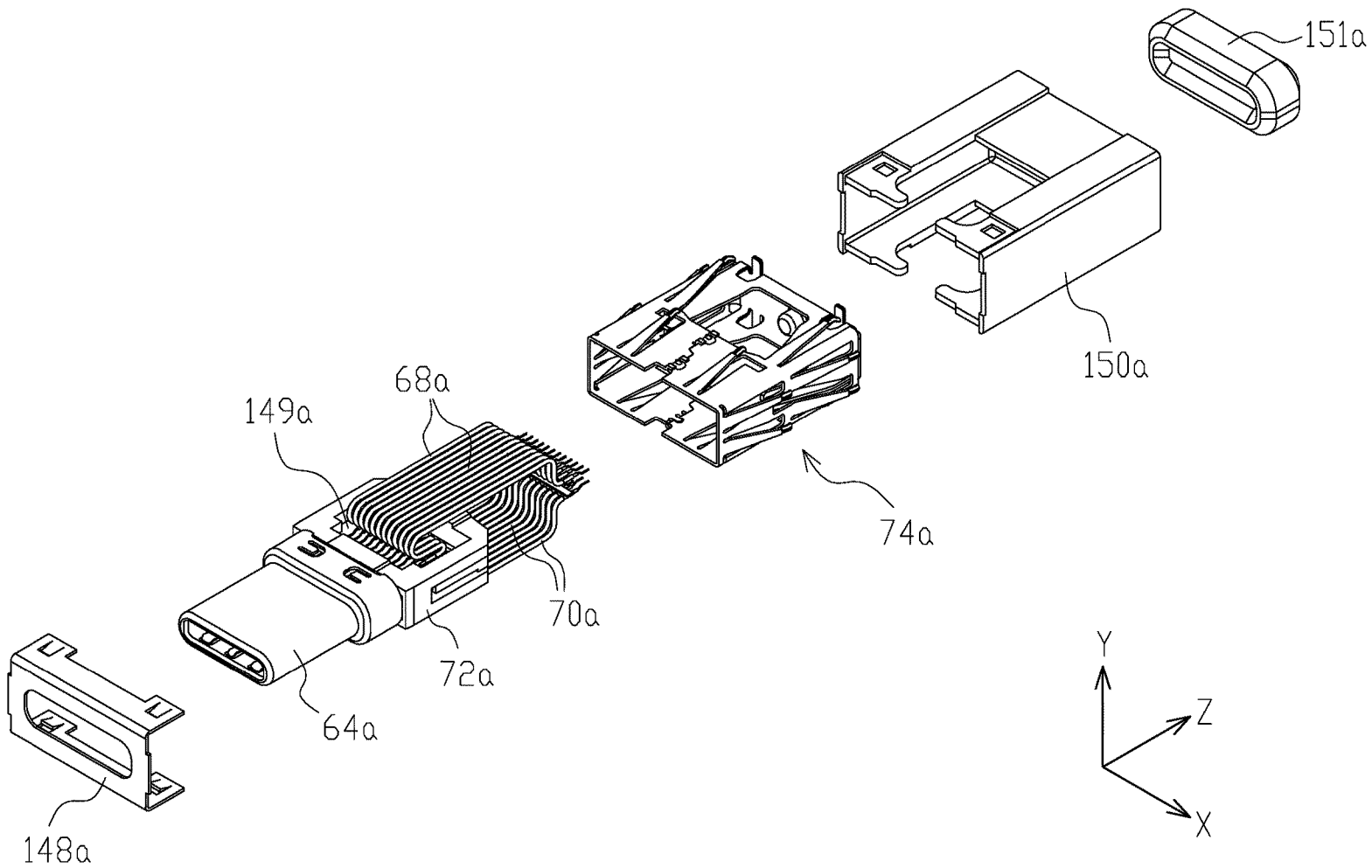
FIG. 43 is an exploded view showing a configuration of a floating portion according to the third embodiment.
Figure 44:
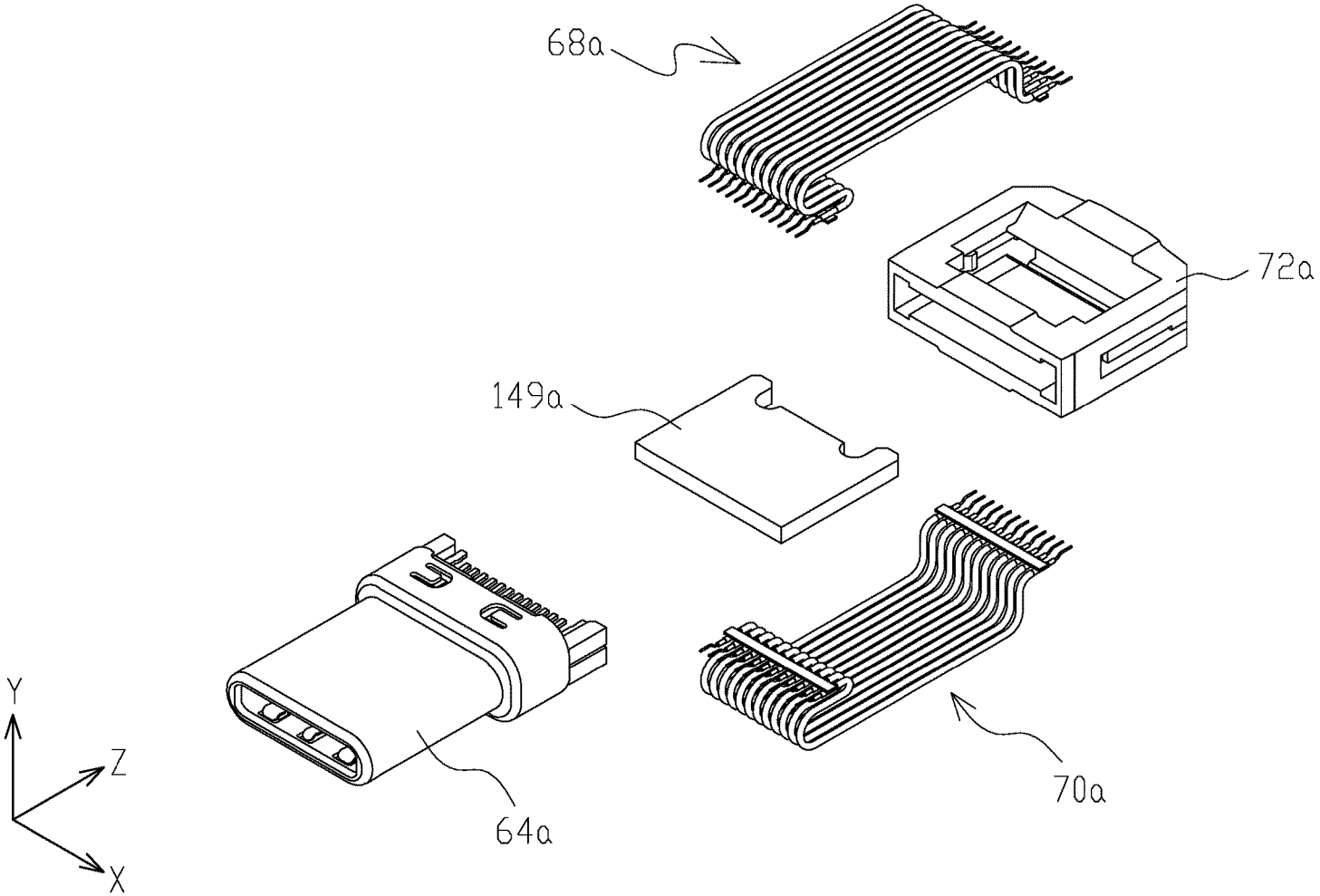
FIG. 44 is an exploded view showing configurations of a plug connector, a circuit board, an upper coaxial cable, a lower coaxial cable, and a swing adaptor according to the third embodiment.

FIG. 43 is an exploded view showing a configuration of the floating portion 146*a*. As shown in FIG. 43, the floating portion 146*a* includes a stopper 148*a*, the plug connector 64*a*, a circuit board 149*a*, a plurality (12 in this embodiment) of upper coaxial cables 68*a*, a plurality (12 in this embodiment) of lower coaxial cables 70*a*, a swing adaptor 72*a*, a control portion 74*a*, a slider 150*a*, and a cushion rubber 151*a*. FIG. 44 is an exploded view showing configurations of the plug connector 64*a*, the circuit board 149*a*, the upper coaxial cable 68*a*, the lower coaxial cable 70*a*, and the swing adaptor 72*a*.

The plug connector 64*a* is packaged on the circuit board 149*a*. The plug connector 64*a* includes a plurality (12 in this embodiment) of upper contacts 152*a* and a plurality (12 in this embodiment) of lower contacts 153*a* which connect with a plurality of contacts (not shown) of the receptacle connector 160*a* (see FIG. 46) as shown in FIG. 41 and FIG. 42. Each of the plurality of upper contacts 152*a* is arranged on a +Y direction side of the plug connector 64*a*, and an end portion of the upper contact 152*a* on the +Z direction side is fixed to the circuit board 149*a* by soldering or the like. Additionally, each of the plurality of upper contacts 152*a* includes a contact portion at an end portion thereof on the −Z direction side, the contact portion for coming into contact with the contact of the receptacle connector 160*a*. Each of the plurality of lower contacts 153*a* is arranged on a −Y direction side of the plug connector 64*a*, and an end portion of the lower contact 153*a* on the +Z direction side is fixed to the circuit board 149*a* by soldering or the like. Additionally, each of the plurality of lower contacts 153*a* includes a contact portion at an end portion thereof on the −Z direction side, the contact portion for coming into contact with the contact of the receptacle connector 160*a*.

Additionally, on a surface on the +Y direction side of the circuit board 149*a*, one end of each of the plurality of upper coaxial cables 68*a* is fixed by soldering or the like. Each of the plurality of cables 68*a* is electrically connected with each of the plurality of upper contacts 152*a* arranged on the −Z direction side of the plug connector 64*a* via the circuit board 149*a*. Additionally, on a surface on the −Y direction side of the circuit board 149*a*, one end of each of the plurality of lower coaxial cables 70*a* is fixed by soldering or the like. Each of the plurality of lower coaxial cables 70*a* is electrically connected with each of the plurality of lower contacts 153*a* arranged on the −Z direction side of the plug connector 64*a* via the circuit board 149*a*. Additionally, on a surface on the +Y direction side of the board 147*a*, the other end of each of the plurality of upper coaxial cables 68*a* is fixed by soldering or the like. Additionally, on a surface on the −Y direction side of the board 147*a*, the other end of each of the plurality of lower coaxial cables 70*a* is fixed by soldering or the like.

Here, since the circuit board 149*a* is fixed to the plug connector 64*a*, and to the circuit board 149*a*, one end of each of the plurality of upper coaxial cables 68*a* and each of the plurality of lower coaxial cables 70*a* is fixed, the circuit board 149*a* functions as a first holding portion which holds one end of each of the plurality of upper coaxial cables 68*a* and each of the plurality of lower coaxial cables 70*a*. Additionally, since the board 147*a* is fixed to the rear cover 139, and to the board 147*a*, the other end of each of the plurality of upper coaxial cables 68*a* and each of the plurality of lower coaxial cables 70*a* is fixed, the board 147*a* functions as a second holding portion which holds the other end of each of the plurality of upper coaxial cables 68*a* and each of the plurality of lower coaxial cables 70*a*. Additionally, the upper coaxial cable 68*a* and the lower coaxial cable 70*a* each have a flexible portion which follows movement of the plug connector 64*a* between the circuit board 149*a* as the first holding portion and the board 147*a* as the second holding portion.

Provision of the flexible portions, and the first holding portion and the second holding portion enables the plug connector 64*a* to move relative to the front cover 138 and the rear cover 139 without being restrained by other member. The flexible portions may not necessarily be the upper coaxial cable 68*a* and the lower coaxial cable 70*a*, but may be, for example, the contacts 152*a* and 153*a* of the plug connector 64*a*. Additionally, the first holding portion may not necessarily be the circuit board 149*a*, but may be, for example, the plug connector 64*a*.

Next, configurations of the swing adaptor 72*a*, the control portion 74*a*, the slider 150*a*, and the cushion rubber 151*a* will be described. The swing adaptor 72*a* is arranged in the vicinity of the circuit board 149*a*. A surface on the +Z direction side of the swing adaptor 72*a* is a curved surface as shown in FIG. 41 and FIG. 43, a center portion of which has a concave portion 154*a* which receives a convex portion 159*a* of the control portion 74*a* (see FIG. 45). The swing adaptor 72*a* rotates along the curved surface, with the concave portion 154*a* fit in the convex portion 159*a* of the control portion 74*a* as an axis.

Figure 45:
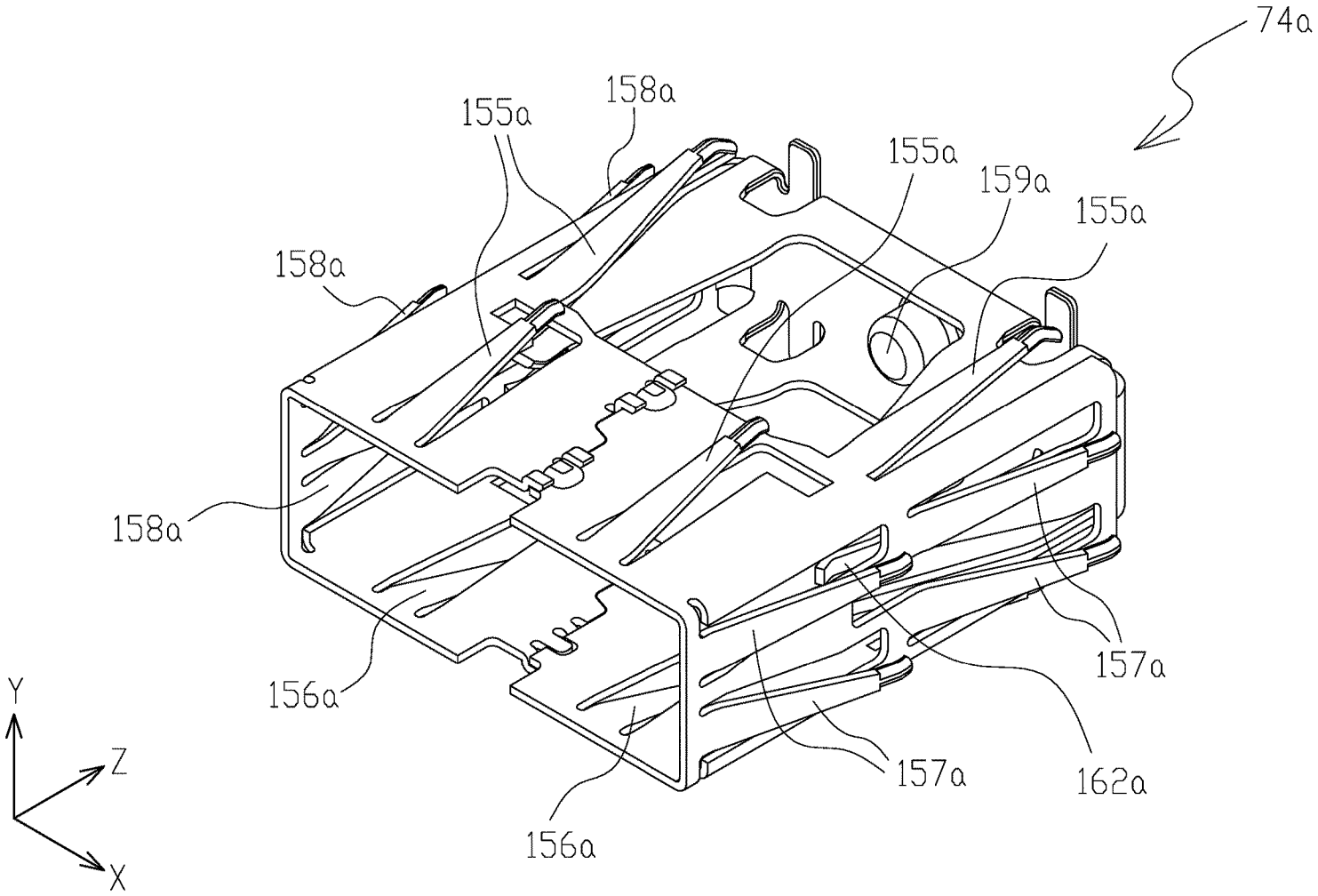
FIG. 45 is a perspective view showing a configuration of a control portion according to the third embodiment.

The control portion 74*a*, which is installed so as to cover the swing adaptor 72*a*, controls a position of the plug connector 64*a* in the X direction and the Y direction, and a posture of the plug connector 64*a*. FIG. 45 is a perspective view showing a configuration of the control portion 74*a*. The control portion 74*a* is formed of a member having conductive properties, for example, metal, and on the +Y direction side of the control portion 74*a*, four Y side elastic portions 155*a* are formed as shown in FIG. 45. Additionally, on the −Y direction side of the control portion 74*a*, four Y side elastic portions (two Y side elastic portions 156*a* and two Y side elastic portions not shown) are formed. The Y side elastic portion 155*a* pushes, in the +Y direction, an inner surface on the +Y direction side of the slider 150*a* by an elastic force. The inner surface on the +Y direction side of the slider 150*a* receives the elastic force of the Y side elastic portion 155*a*. The Y side elastic portion 156*a* pushes, in the −Y direction, an inner surface on the −Y direction side of the slider 150*a* by an elastic force. The inner surface on the −Y direction side of the slider 150*a* receives the elastic force of the Y side elastic portion 156*a*.

The control portion 74*a* controls a position of the plug connector 64*a* in the Y direction with respect to the opening portion 141*a* by using the elastic forces of the Y side elastic portions 155*a* and 156*a*. For example, when a force is applied to the plug connector 64*a* in the −Y direction, the Y side elastic portion 155*a* extends in the +Y direction and the Y side elastic portion 156*a* contracts in the +Y direction. Accordingly, the plug connector 64*a* moves in the −Y direction within the predetermined space formed between the outer wall portion of the plug connector 64*a* and the wall portion 142*a*. When a force is applied to the plug connector 64*a* in the +Y direction, the Y side elastic portion 155*a* contracts in the −Y direction and the Y side elastic portion 156*a* extends in the −Y direction. Accordingly, the plug connector 64*a* moves in the +Y direction within the predetermined space formed between the outer wall portion of the plug connector 64*a* and the wall portion 142*a*.

Additionally, on the +X direction side of the control portion 74*a*, four X side elastic portions 157*a* are formed as shown in FIG. 45. Additionally, on the −X direction side of the control portion 74*a*, four X side elastic portions (three X side elastic portions 158*a* and one X side elastic portion not shown) are formed. The X side elastic portion 157*a* pushes, in the +X direction, an inner surface on the +X direction side of the slider 150*a* by an elastic force. The inner surface on the +X direction side of the slider 150*a* receives the elastic force of the X side elastic portion 157*a*. The X side elastic portion 158*a* pushes, in the −X direction, an inner surface on the −X direction side of the slider 150*a* by an elastic force. The inner surface on the −X direction side of the slider 150*a* receives the elastic force of the X side elastic portion 158*a*.

The control portion 74*a* controls a position of the plug connector 64*a* in the X direction with respect to the opening portion 141*a* by using the elastic forces of the X side elastic portions 157*a* and 158*a*. For example, when a force is applied to the plug connector 64*a* in the −X direction, the X side elastic portion 157*a* extends in the +X direction and the X side elastic portion 158*a* contracts in the +X direction. Accordingly, the plug connector 64*a* moves in the −X direction within the predetermined space formed between the outer wall portion of the plug connector 64*a* and the wall portion 142*a*. When a force is applied to the plug connector 64*a* in the +X direction, the X side elastic portion 157*a* contracts in the −X direction and the X side elastic portion 158*a* extends in the −X direction. Accordingly, the plug connector 64*a* moves in the +X direction within the predetermined space formed between the outer wall portion of the plug connector 64*a* and the wall portion 142*a*.

Additionally, on an inner surface on the +X direction side of the control portion 74*a*, an inner elastic portion 162*a* is formed. Additionally, also on an inner surface on the −X direction side of the control portion 74*a*, an inner elastic portion not shown is formed. Additionally, on a surface on the +Z direction side of the control portion 74*a*, as shown in FIG. 45, the convex portion 159*a* is formed. As described above, the convex portion 159*a* is fit in the concave portion 154*a* of the swing adaptor 72*a* to function as an axis for the swing adaptor 72*a* to rotate. Using the inner elastic portion 162*a*, the inner elastic portion not shown, and the convex portion 159*a*, the swing adaptor 72*a* and the control portion 74*a* control a posture of the plug connector 64*a* with respect to the opening portion 141*a*, i.e. a slant with respect to the Z axis direction. For example, when a force slanting to the Z axis direction is applied to the plug connector 64*a*, the swing adaptor 72*a* slants with the convex portion 159*a* of the control portion 74*a* as an axis. Then, the posture of the plug connector 64*a* changes to a direction in which the force is applied within the predetermined space formed between the outer wall portion of the plug connector 64*a* and the wall portion 142*a*. Specifically, the plug connector 64*a* slants to a surface in which the opening portion 141*a* is formed. The inner elastic portion 162*a* or the inner elastic portion not shown arranged on the side to which the plug connector 64*a* slants functions as a correction portion which corrects a slant of the plug connector 64*a* by using an elastic force to push the plug connector 64*a*. When the force applied to the plug connector 64*a* is released, due to the elastic force of the inner elastic portion 162*a* or the inner elastic portion not shown, the plug connector 64*a* returns to a previous posture as of before the force is applied to the plug connector 64*a*.

The slider 150*a* is installed so as to cover the control portion 74*a* and the cushion rubber 151*a*. The slider 150*a* and the cushion rubber 151*a* function as a control portion which controls a position of the plug connector 64*a* in the Z direction. Specifically, as shown in FIG. 41 and FIG. 42, the slider 150*a* is configured to be movable in the ±Z direction, and the cushion rubber 151*a* absorbs the movement of the slider 150*a* in the Z direction. Accordingly, at the engagement between the plug connector 64*a* and the receptacle connector 160*a* (see FIG. 46), when the front end portion of the plug connector 64*a* comes into contact with an abutting surface of the receptacle connector 160*a*, the slider 150*a* move in the +Z direction, so that the cushion rubber 151*a* absorbs the movement of the slider 150*a*, thereby preventing the front end portion of the plug connector 64*a* from colliding against the abutting surface of the receptacle connector 160*a*. Although in general, the receptacle connector 160*a* is designed to have an abutting surface not coming into contact with the front end portion of the plug connector 64*a*, the front end portion of the plug connector 64*a* might collide with the abutting surface of the receptacle connector 160*a* at the time of engagement due to deviation in installation or packaging of each part. However, even in such a case, provision of the slider 150*a* and the cushion rubber 151*a* avoids collision of the abutting surface of the receptacle connector 160*a* with the front end portion of the plug connector 64*a*, thereby preventing the plug connector 64*a* or the receptacle connector 160*a* from coming out of the board due to collision.

Similarly to the floating portion 146*a*, the floating portion 146*b* includes a stopper 148*b* (see FIG. 41), the plug connector 64*b* (see FIG. 40), a circuit board 149*b* (see FIG. 41), a plurality of upper coaxial cables 68*b* (see FIG. 40), a plurality of lower coaxial cables 70*b* (see FIG. 40), a swing adaptor 72*b* (see FIG. 41), a control portion 74*b* (see FIG. 41), a slider 150*b* (see FIG. 41), and a cushion rubber 151*b* (see FIG. 41). Additionally, the plug connector 64*b* includes a plurality of upper contacts 152*b* (see FIG. 41) and a plurality of lower contacts (not shown) similarly to the plug connector 64*a*. Additionally, the swing adaptor 72*b* has, in a center portion thereof, a concave portion 154*b* (see FIG. 41) which receives a convex portion 159*b* (see FIG. 41) of the control portion 74*b*. Additionally, in the control portion 74*b*, there are formed eight Y side elastic portions (not shown), eight X side elastic portions (not shown), two inner elastic portions (not shown), and the convex portion 159*b*. Since configurations of these portions are the same as those of the stopper 148*a*, the plug connector 64*a*, the circuit board 149*a*, the plurality of upper coaxial cables 68*a*, the plurality of lower coaxial cables 70*a*, the swing adaptor 72*a*, the control portion 74*a*, the slider 150*a*, and the cushion rubber 151*a*, no description will be made thereof.

Next, description will be made of the receptacle unit 126 (see FIG. 46) to be mounted on the personal computer 128 shown in FIG. 34. FIG. 46 is an exploded view showing a configuration of the personal computer 128. As shown in FIG. 46, the personal computer 128 includes the receptacle unit 126 to be engaged with the plug unit 66 for electrical connection. On the +Z direction side of the personal computer 128, a reception portion 164 which receives the receptacle unit 126 is formed, and the receptacle unit 126 is accommodated in the reception portion 164 and covered by a cover 163. The receptacle unit 126 includes the receptacle connector 160*a* which engages with the plug connector 64*a*, the receptacle connector 160*b* which engages with the plug connector 64*b*, the guide reception portion 161*a* which receives the guide portion 137*a*, and the guide reception portion 161*b* which receives the guide portion 137*b*. Since a configuration of the receptacle unit 126 is generally the same as the configuration of the receptacle docking connector 73 according to the second embodiment (see FIG. 18), no description will be made thereof.

Since the plug unit 66 according to the third embodiment includes the guide portions 137*a* and 137*b*, before the plug connectors 64*a* and 64*b* engage with the receptacle connectors 160*a* and 160*b*, the guide portions 137*a* and 137*b* are inserted into the guide reception portions 161*a* and 161*b* of the receptacle unit 126. Accordingly, the plug connectors 64*a* and 64*b* can be securely engaged with the receptacle connectors 160*a* and 160*b* without damages.

Additionally, the plug unit 66 according to the third embodiment includes the control portions 74*a* and 74*b*, the swing adaptors 72*a* and 72*b*, the sliders 150*a* and 150*b*, and the cushion rubbers 151*a* and 151*b*. Additionally, the plug connectors 64*a* and 64*b* are connected with the upper coaxial cables 68*a* and 68*b* and the lower coaxial cables 70*a* and 70*b* (the flexible portions) via the circuit boards 149*a* and 149*b*, which flexible portions are held by the first holding portion and the second holding portion. Accordingly, position control and posture control of the plug connectors 64*a* and 64*b* can be excellently conducted. In other words, since the plug connectors 64*a* and 64*b* are configured to be movable within a predetermined space, a tolerance can be minimized to enable the plug connectors 64*a* and 64*b* to be securely engaged with the receptacle connectors 160*a* and 160*b* without damages. Additionally, without engagement with the receptacle connectors 160*a* and 160*b*, position control and posture control by the control portions 74*a* and 74*b* and the cushion rubbers 151*a* and 151*b* enable the plug connectors 64*a* and 64*b* to be maintained at a predetermined position and in a predetermined posture. In other words, deviation in a position and a posture of the plug connectors 64*a* and 64*b* during mounting thereof can be securely absorbed.

Additionally, since the receptacle unit 126 according to the third embodiment includes the guide reception portions 161*a* and 161*b*, the guide portions 137*a* and 137*b* are inserted into the guide reception portions 161*a* and 161*b* before the plug connectors 64*a* and 64*b* engage with the receptacle connectors 160*a* and 160*b*. Accordingly, the plug connectors 64*a* and 64*b* can be securely engaged with the receptacle connectors 160*a* and 160*b* without damages.

Although in the above-described plug unit 66 according to the third embodiment, the control portion 74*a* and the like control a position and a posture of the plug connector 64*a*, and the control portion 74*b* and the like control a position and a posture of the plug connector 64*b*, only the control portion 74*a* and the like may be provided, or only the control portion 74*b* and the like may be provided. In a case where only the control portion 74*a* and the like (or 74*b* and the like) are provided, a position and a posture of the plug connector 64*b* (or 64*a*) are defined in advance to control a position and a posture of the plug connector 64*a* (or 64*b*).

Figure 47:
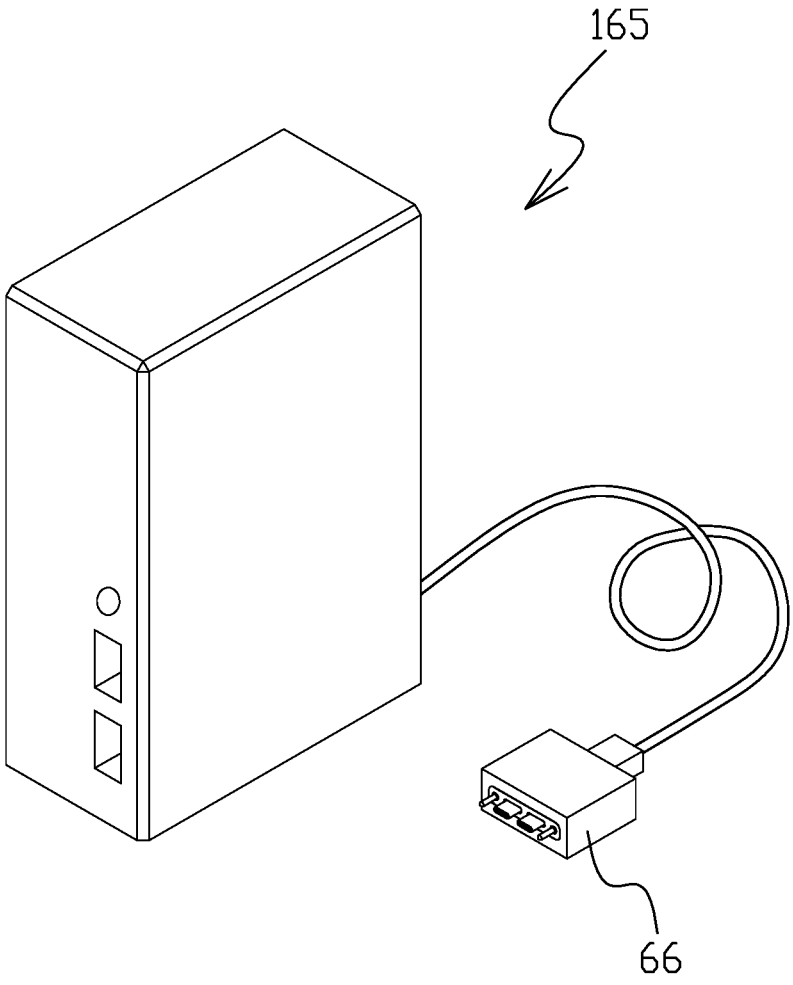
FIG. 47 is a perspective view showing a configuration of a cable dock including a plug unit according to other embodiment.

Additionally, the above-described plug unit 66 according to the third embodiment, which is mounted on the docking station 127, may be mounted on, for example, such a cable dock 165 as shown in FIG. 47.

Although the above plug docking connectors according to the respective embodiments are each provided with two USB Type-C plug connectors, the plug docking connector may be provided with three or more USB Type-C plug connectors. Additionally, a USB Type-C plug connector may be replaced by other plurality of plug connectors conforming to the standard specification than a USB Type-C plug connector. Additionally, a plurality of predetermined standard plug connectors having a predetermined standard may be provided other than the plug connectors conforming to the standard specification.

Similarly, although the above receptacle docking connectors according to second embodiment are each provided with two USB Type-C receptacle connectors, the receptacle docking connector may be provided with three or more USB Type-C receptacle connectors. Additionally, a USB Type-C receptacle connector may be replaced by other plurality of receptacle connectors conforming to the standard specification than a USB Type-C receptacle connector. Additionally, a plurality of predetermined standard receptacle connectors having a predetermined standard may be provided other than the receptacle connectors conforming to the standard specification.

Additionally, although the above respective embodiments are configured such that a position and a posture of the plug connector are controlled, the embodiments may be configured such that only a position of the plug connector is controlled, or such that only a posture of the plug connector is controlled.

Additionally, although in the above-described second and third embodiments, the guide portion and the guide reception portion are provided, neither guide portion nor guide reception portion may be provided.

The above embodiments have been described for illustrative purpose only and are not to be construed as limiting the present invention. Accordingly, each element disclosed in the above embodiments intends to include all design changes and equivalents within a technical range of the present invention.

The invention claimed is:

1. A connector comprising:

a plurality of predetermined standard connectors which connects with a partner connector; and a cover covering the plurality of predetermined standard connectors and having a first opening portion allowing an engagement portion to be exposed, the engagement portion to be engaged with the partner connector of the predetermined standard connector, wherein between an outer wall portion of the predetermined standard connector and a wall portion forming the first opening portion, a predetermined space is formed such that the predetermined standard connector is movable relative to the cover on a cross plane crossing an engagement direction of engagement with the partner connector when the connector connects with the partner connector, the connector comprising:

a first control portion which controls, with respect to the first opening portion, at least one of a position and a posture of at least one of the predetermined standard connectors when the connector connects with the partner connector.

2. The connector according to claim 1, further comprising:

an additional connector to be connected with a partner's additional connector, wherein the cover covers the additional connector and has a second opening portion allowing an engagement portion of the additional connector to be exposed, the engagement portion to be engaged with the partner's additional connector, and between an outer wall portion of the additional connector and a wall portion forming the second opening portion, a predetermined space is formed such that the additional connector is movable on the cross plane, the connector comprising:

a second control portion which controls, with respect to the second opening portion, at least either one of a position and a posture of the additional connector.

3. The connector according to claim 2, wherein the first control portion and the second control portion each include an elastic body.

4. The connector according to claim 2, wherein the second control portion is provided in the outer wall portion of the additional connector or in the wall portion forming the second opening portion.

5. The connector according to claim 1, wherein the first control portion is provided in the outer wall portion of the predetermined standard connector or in the wall portion forming the first opening portion.

6. The connector according to claim 1, wherein the first control portion is provided between the predetermined standard connector and the cover.

7. The connector according to claim 1, wherein the first control portion comprises:

a convex portion which supports the predetermined standard connector in a direction orthogonal to a surface in which the first opening portion is formed; and a correction portion which corrects a slant of the predetermined standard connector when the predetermined standard connector slants with respect to the surface in which the first opening portion is formed, and controls a posture of the predetermined standard connector with respect to the first opening portion by using the convex portion and the correction portion.

8. The connector according to claim 1, wherein the cover and a shell of the predetermined standard connector electrically conduct with each other.

9. The connector according to claim 1, further comprising:

a flexible portion which follows movement of the predetermined standard connector;

a first holding portion fixed to the predetermined standard connector and holding one of the flexible portion; and a second holding portion fixed to the cover and holding the other of the flexible portion.

10. The connector according to claim 1, wherein the predetermined standard connector is of the USB Type C.

* * * * *